US006574442B2

(12) United States Patent
Kibune

(10) Patent No.: US 6,574,442 B2
(45) Date of Patent: Jun. 3, 2003

(54) IMAGE FORMING METHOD

(75) Inventor: Hideaki Kibune, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/915,501

(22) Filed: Jul. 27, 2001

(65) Prior Publication Data

US 2002/0020313 A1 Feb. 21, 2002

(30) Foreign Application Priority Data

| | | |
|---|---|---|
| Jul. 28, 2000 | (JP) | 2000-229421 |
| Nov. 15, 2000 | (JP) | 2000-348485 |
| Jun. 8, 2001 | (JP) | 2001-174662 |

(51) Int. Cl.[7] ..... G03G 15/00; G03G 15/01; G03G 15/08

(52) U.S. Cl. ..... 399/49; 399/72

(58) Field of Search ..... 399/49, 72, 223, 399/298, 299, 300, 302

(56) References Cited

U.S. PATENT DOCUMENTS

| | | | | |
|---|---|---|---|---|
| 5,991,051 A | * | 11/1999 | Tamagaki | 358/448 |
| 6,157,797 A | | 12/2000 | Saito et al. | 399/107 |
| 6,181,892 B1 | * | 1/2001 | Fujimori | 399/72 |
| 6,222,566 B1 | | 4/2001 | Takeyama et al. | 347/116 |
| 6,243,542 B1 | * | 6/2001 | Fujimoto et al. | 399/49 |

FOREIGN PATENT DOCUMENTS

| | | | |
|---|---|---|---|
| JP | 05-061339 | * | 3/1993 |
| JP | 10-177286 | * | 6/1998 |
| JP | 11-109708 | * | 4/1999 |
| JP | 11-125968 | * | 5/1999 |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An image forming method causes each of a plurality of image stations to form a test patch image on a respective image carrier and senses the density of the test patch image for executing image quality compensation control. The test patch image is formed after image formation using an upstream one of two developing portions in a direction of rotation of the image carrier or before image formation using a downstream one of the developing portions. This method promotes high-speed operation, miniaturization and low-cost configuration of an image forming apparatus.

39 Claims, 42 Drawing Sheets

IMAGE FORMING METHOD

BACKGROUND OF THE INVENTION

The present invention relates to an image forming method for a printer, copier facsimile apparatus or similar image forming apparatus.

To better understand the present invention, conventional technologies relating to image formation will be described first.

Japanese Patent Laid-Open Publication No.10-177286 (prior art 1 hereinafter) contemplates reducing the size of an image forming apparatus, increasing the number of images to be formed for a unit period of time, and reducing the number of processing units. Specifically, prior art 1 pertains to an image forming apparatus of the type transferring a color image from an intermediate image transfer belt to a recording medium with image transferring means. The apparatus includes first and second image forming units spaced from each other along the belt. The first image forming unit includes a single photoconductive drum and two developing means each for developing a particular latent image formed on the drum with toner of color A or B. Likewise, the second image forming unit includes a single photoconductive drum and two developing means each for developing a particular latent image formed on the drum with toner of color C or black toner.

Japanese Patent Laid-Open Publication No. 11-109708 (prior art 2 hereinafter) proposes an image forming apparatus of the type including two image stations arranged around an intermediate image transfer body. The image stations each include a respective photoconductive element and two developing means facing the photoconductive element. At each image station, the developing means are switched to form toner images of different colors on the photoconductive element. The toner images are sequentially transferred to the intermediate image transfer body one above the other. The resulting color image is transferred from the image transfer body to a recording medium. In accordance with prior art 2, each image station includes a single driveline for driving the two developing means and switching means for selectively transmitting the drive of the driveline to either one of the two developing means.

Japanese Patent Laid-Open Publication No. 11-125968 (prior art 3 hereinafter) discloses an image forming apparatus of the type including a rotatable image carrier and two developing means adjoining each other while facing the outer circumference of the image carrier. A developing function is switched from one developing means to the other developing means while the image carrier is in rotation, so that latent images are sequentially developed in two different colors. To provide a period of time necessary for switching the developing means, prior art 3 starts development with upstream one of the developing means in the direction of rotation of the image carrier and then starts development with downstream one of the developing means.

Japanese Patent Laid-Open Publication No. 11-218974 (prior art 4) discloses a device for image quality compensation that executes, based on the density of a test patch image, image quality control in accordance with the condition of an image to thereby maintain preselected image quality. Specifically, the device senses at least the density of the edge of an image where density is high and that of a center portion where density is stable. The device then sets an amount of exposure by comparing the sensed density of the high density portion and the condition of the image, e.g., the reference density of a line image. Also, the device controls the quantity of exposure by comparing the sensed density with, e.g., the reference density of a halftone image or similar solid image. In this manner, the device executes image quality compensation with a single test patch image in accordance with the condition of an image. Prior art 4 describes in paragraph "0047" that it usually executes the image quality compensation control before the start of image formation, e.g., on the power-up of an image forming apparatus or when the apparatus is not operating.

Japanese Patent Laid-Open Publication No. 11-218696 (prior art 5 hereinafter) teaches a multicolor image forming apparatus capable of preventing the quality of an image printed on a recording medium and output speed from falling. The apparatus forms test patterns of different colors for positional shift detection on a primary image transfer body during intervals between image formation. The apparatus reads the test patterns to determine the shift of write start positions in the subscanning direction and then varies the duty of a reference clock to be fed to a polygonal mirror, thereby controlling the rotation phase of the mirror. This is successful to correct the write start positions by controlling only the phase of the reference clock instead of frequency. Consequently, the variation of rotation of the polygonal mirror and therefore the mirror rotation control time is reduced.

Further, Japanese Patent Laid-Open Publication No. 11-2394 (prior art 6 hereinafter) discloses an image forming apparatus constructed to obviate image deterioration ascribable to fog toner deposited on the surface of an intermediate image transfer body without resorting to a cleaner. When the number of sheets fed in an A4 profile position reaches a preselected number, control means so controls a tray shift motor as to shift a sheet tray in the lateral direction. At the same time, the control means varies a position for starting forming a latent image in accordance with the position of sheet conveyance.

The conventional technologies described above have various problems left unsolved, as will be described hereinafter.

Prior art 4 usually executes image quality compensation control before the start of image formation, as stated earlier. In practice, however, it is likely that images are deteriorated even during image formation when a number of images are continuously output. It is therefore necessary to execute the above control even during image formation by sensing the densities of test patches.

Prior arts 1, 2 and 3 each include two image stations each having a respective intermediate image transfer body and two developing means arranged around the image transfer body. The process for forming toner images of different colors by switching the two developing means is executed with each of the two photoconductive elements. The resulting color images are transferred to the intermediate image transfer body one above the other and then to a sheet. In this case, the developing function is switched from the upstream developing means in the direction of rotation of the photoconductive element to the downstream developing means or from the latter to the former. The interval between the time when the trailing edge of an image developed by one developing means passes the developing means and the time when the leading edge of a latent image to be formed by the other developing means arrives at the other developing means differs between the above two different cases, as described in paragraph "0019" of prior art 3.

Prior art 5 pertains to control over image forming timing that detects a shift on the intermediate image transfer body by using test patterns. Prior art 5 describes in paragraphs "0002" through "0005" the purpose of image forming timing control and prior art control schemes based on test pattern images. Particularly, in paragraph "0004", prior art 5 describes why image forming timing control based on the position of a test pattern during image formation is necessary.

Prior art 6 proposes a solution to the deterioration of images ascribable to fog toner. Particularly, in paragraph "0007", prior art 6 describes specifically why images are deteriorated by fog toner when they are formed at a preselected position on the intermediate image transfer belt at all times. Further, in paragraphs "0024" through "0029", prior art 6 describes that output images are counted and, when the count reaches preselected one, a plurality of home position sensors senses a mark formed on the intermediate image transfer body to thereby shift the image forming position on the transfer body. A problem with prior art 6 is that a controller must count output images and must control the image forming position, making the apparatus sophisticated and expensive. The plurality of sensors aggravates this problem. Another problem is that when the image forming position on the intermediate image transfer body is preselected, the image transfer body deteriorates more in the image portion than in the non-image portion. This prevents the life of the intermediate image transfer body from being extended.

SUMMARY OF THE INVENTION

It is therefore an object of the present invention to provide a method capable of promoting the high speed, small size, low cost configuration of an image forming apparatus in relation to image quality compensation control, which is executed during image formation by using test patches.

It is another object of the present invention to provide a method capable of promoting the high speed, small size, low cost configuration of an image forming apparatus in relation to image forming timing control, which is executed during image formation by using test pattern images.

It is a further object of the present invention to provide a method capable of extending the life of an intermediate image transfer body, obviating image deterioration ascribable to fog toner, and promoting the high speed, small size, low cost configuration of an image forming apparatus In accordance with the present invention, an image forming method uses a plurality of image stations each including a single rotatable image carrier and two developing means each for developing a particular latent image formed on the image carrier in a respective color to thereby produce a toner image. The method switches a developing function from one developing means to the other developing means while the image carrier is in rotation, sequentially transfers toner images produced by the developing means to an intermediate image transfer body one above the other, and transfers the resulting color image from the intermediate image transfer body to a recording medium. A test patch image is formed on the image carrier at each image station after image formation using upstream one of the developing means in the direction of rotation of the image carrier or before image formation using downstream one of the developing means. Image quality compensation control is effected by sensing the density of the test patch image.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

First, an image forming apparatus to which the present invention is applied will be described. The image forming apparatus includes a photoconductive drum, photoconductive belt or similar image carrier. Toner images are sequentially formed on the image carrier in at least three primary colors A, B and C. The toner images A, B and C are then transferred to an intermediate image transfer belt one above the other, completing a color image. Image transferring means transfers the color image from the intermediate image transfer belt to a paper sheet or similar recording medium.

Figure 15:
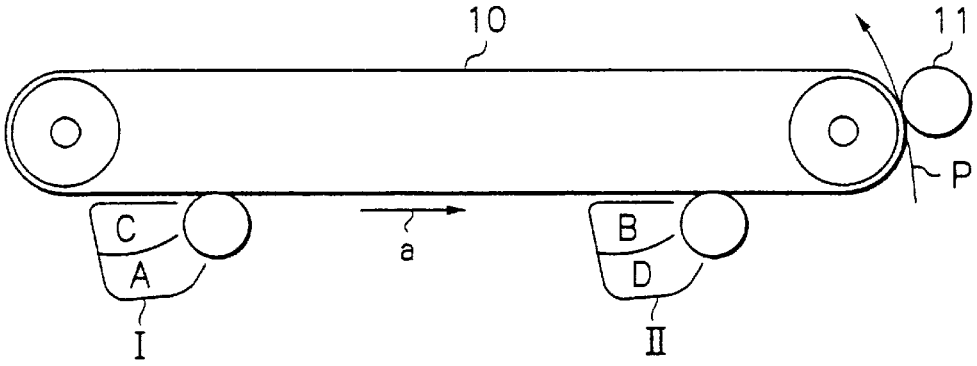
FIG. 15 is a view showing a specific configuration to which any one of the above embodiments is applicable FIGS. 16A through 16F demonstrate specific color image forming steps available with the configuration shown in FIG. 15.

Specifically, as shown in FIG. 15, the intermediate image transfer belt (simply belt hereinafter), labeled 10, turns in a direction indicated by an arrow a. First and second image forming means I and II are positioned at a preselected distance from each other along the same run of the belt 10. The image forming means I and II each include a photoconductive drum, charging means, and developing means. The image forming means I and II transfer toner images of different colors to the belt 10 one above the other by a sequence shown in FIGS. 16A through 16F or FIGS. 17A through 17H. Image transferring means 11 transfers the resulting color image from the belt 10 to a paper sheet or similar recording medium P.

Assume that the belt 10 has a circumferential length L, that the paper sheet P has a length 1' (not shown in the drawings, but used in formulas below) in the direction of movement of the paper sheet P, and that a non-image region on the belt 10 has a length a (also not shown but referred to below) in the direction of movement of the belt 10. Then, FIGS. 16A through 16F and FIGS. 17A through 17H respectively show a color image forming sequence executed when $L=1'\pm\alpha$ and a color image forming sequence executed when $L=2(1'+\alpha)$. In FIGS. 16A through 16F and FIGS. 17A through 17H, the length a is assumed to be smaller than the length 1'. It is k to be noted that the length a depends on the length of an image region on the belt 10 or the length of the paper sheet P. The length a may therefore be greater than the length 1', depending on the length of the paper sheet P. The length $\alpha$ may therefore be greater than the length 1', depending on the length of the paper sheet P.

Figure 16A:
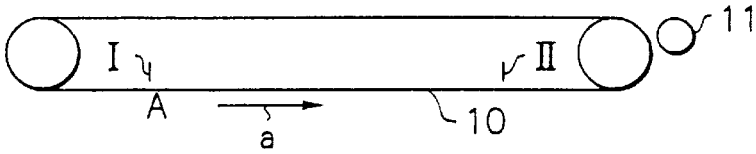
Figure 16B:
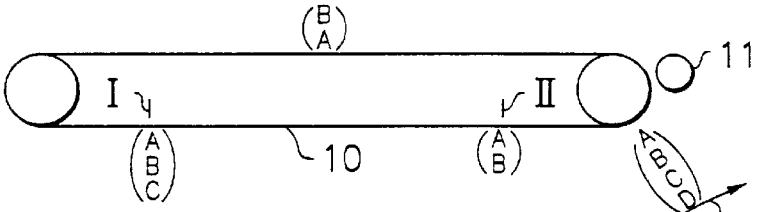

The color image forming sequence shown in FIGS. 16A through 16F will be described specifically hereinafter. As shown in FIG. 16A, the first image forming means I forms a toner image in the color A with A developing means and transfers the A toner image to the belt 10. As shown in FIG. 16B, the second image forming means II forms a toner image in the color B with B developing means and transfers the B toner image to the belt 10 over the A toner image, thereby forming an AB toner image. Subsequently, the first image forming means I forms a toner image in the color C with C developing means and transfers the C toner image to the belt 10 over the AB toner image, thereby forming an ABC toner image. At this instant, the belt 10 completes substantially one turn.

Figure 16C:
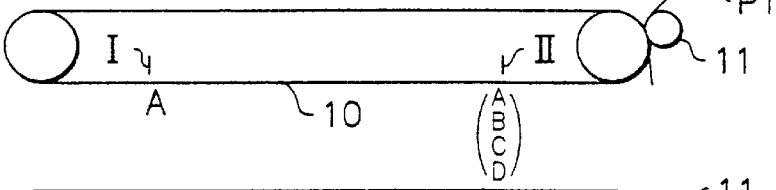

As shown in FIG. 16C, the second image forming means II forms a toner image in a color D (black) and transfers the D toner image to the belt 10 over the ABC toner image, thereby completing an ABCD or full-color image. The image transferring means 11 transfers the full-color image from the belt 10 to a paper sheet or similar recording medium P1. This image transfer occurs while the belt 10 is performing the second turn.

Figure 16D:
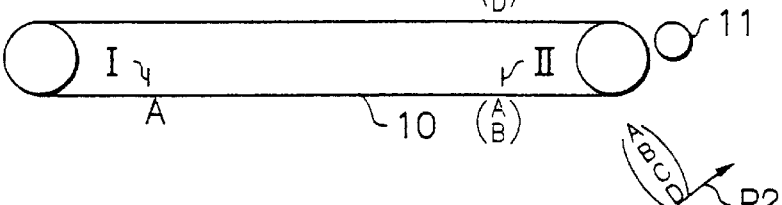
Figure 16E:
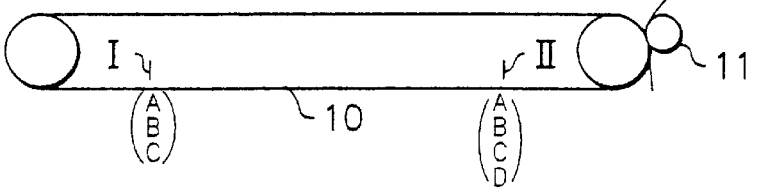

Assume that the operator of the image forming apparatus desires a plurality of color prints. Then, as shown in FIG. 16D, the first image forming means I forms another A toner image and transfers it to the belt 10 at the same time as the second image forming means II forms the D toner image and transfers it to the belt 10 (FIG. 16C). Subsequently, the second image forming means II forms another B toner image and transfers it to the belt 10 over the above A toner image, thereby forming an AB toner image. As shown in FIG. 16E, the first image forming means I forms a C toner image and transfers it to the belt 10 over the AB toner image so as to form an ABC toner image. Thereafter, the second image forming means II forms a D toner image and transfers it to the belt 10 over the ABC toner image, thereby completing a full-color image. This full-color image is transferred from the belt 10 to the second paper sheet P2. The transfer of the full-color image to the paper sheet P2 occurs while the belt 10 is performing the fourth turn.

Figure 16F:
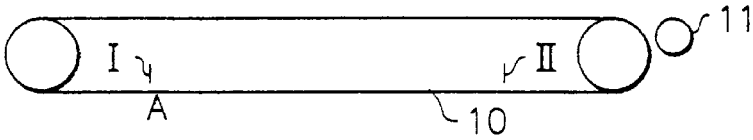

As shown in FIG. 16F, the step shown in FIG. 16C and successive steps are repeated to produce the third print and successive prints. Such prints are sequentially output after the sixth turn of the belt 10.

Figure 17A:
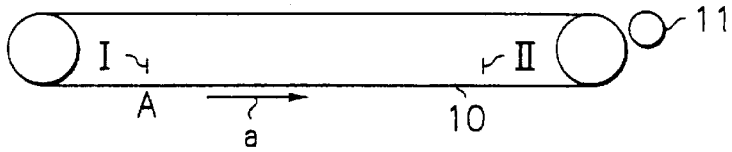
FIGS. 17A through 17H demonstrate another specific color image forming steps available with the configuration shown in FIG. 15.
Figure 17B:
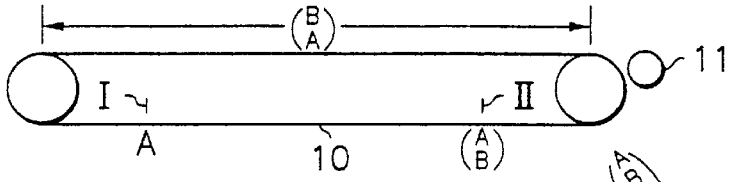

Next, the color image forming sequence shown in FIGS. 17A through 17H and pertaining to a relation of $L/2=1'+\alpha$ will be described. As shown in FIG. 17A, the first image forming means I forms an A toner image and transfers it to the belt 10. As shown in FIG. 17B, while the first image forming means I transfers a second A toner image to the belt 10, the second image forming means II forms a B toner image and transfers it to the belt 10 over the first A toner image, thereby forming an AB toner image. At this instant, the belt 10 completes substantially one turn.

Figure 17C:
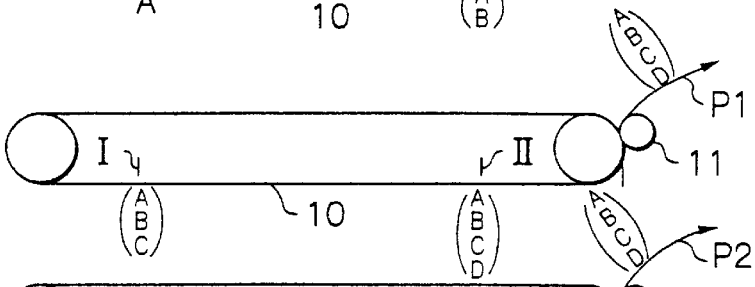

As shown in FIG. 17C, the first image forming means I forms a C toner image and transfers it to the belt 10 over the AB toner image, thereby forming an ABC toner image. The second image forming means II forms a D toner image and transfers it to the belt 10 over the ABC toner image so as to complete a full-color image. The image transferring means 11 transfers the full-color image from the belt 10 to the paper sheet P1. This image transfers begins when the belt 10 completes substantially one and half turns.

Figure 17D:
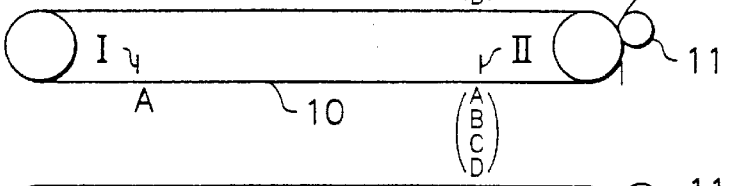

Assume that the operator of the image forming apparatus desires a plurality of color prints. Then, as shown in FIG. 17D, the first image forming means I forms the ABC toner image and then forms another A toner image and transfers it to the belt 10 (FIG. 17C). At the same time, the second image transferring means II forms a D toner image and transfers it to the belt 10 over the ABC toner image, thereby completing a full-color image. The full-color image is transferred from the belt 10 to the second paper sheet P2. The image transfer to the second paper sheet P2 begins when the belt 10 completes substantially two turns.

Figure 17E:
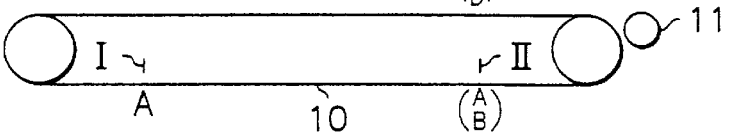
Figure 17F:
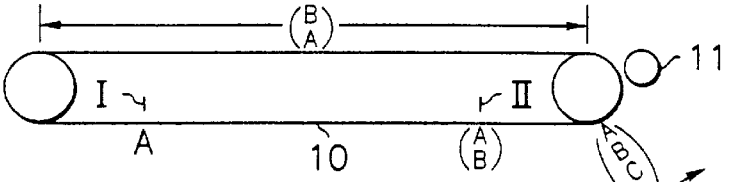

As shown in FIG. 17E, the second image forming means II forms a B toner image and transfers it to the belt 10 over the A toner image. As shown in FIG. 17F, the first image forming means I transfers another A toner image to the belt 10 while the second image forming means II forms a B toner image and transfers it to the belt 10 over the above A toner image to thereby form an AB toner image.

Figure 17G:
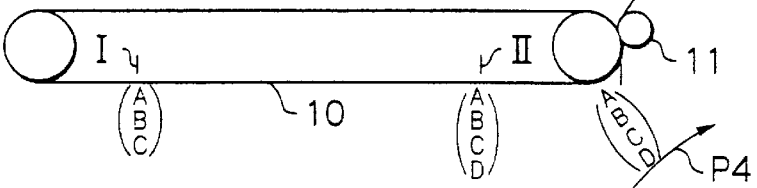

As shown in FIG. 17G, the first image forming means I forms a C toner image and transfers it to the belt 10 over the AB toner image for thereby forming an ABC toner image. The second image forming means forms a D toner image and transfers it to the belt 10 over the ABC toner image, thereby completing a full-color image. This full-color image is transferred to a third paper sheet P3. The image transfer to the third paper sheet P3 begins when the belt 10 completes substantially three and half turns.

Figure 17H:
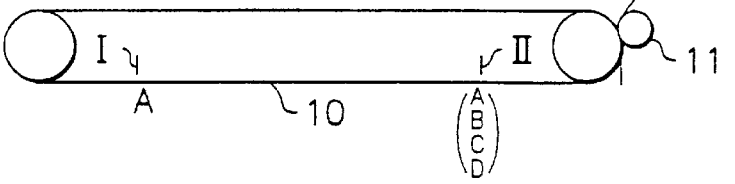

As shown in FIG. 17H, the first image forming means I forms an A toner image and transfers it to the belt 10 while the second image forming means II forms a D toner image and transfers it to the belt 10 over the ABC toner image. The resulting full-color image is transferred to a fourth paper sheet P4. This image transfer begins when the belt 10 completes substantially four turns.

As stated above, when the length of the belt 10 is two times or more as great as the length of the paper sheet P, the first print is output when the belt 10 makes two turns. The second print is output when the belt 10 makes two and half turns while the third print is output when the belt 10 makes four turns. Further, the fourth print is output when the belt 10 makes four and half turns.

In the image forming apparatus described above, the image forming means or image stations I and II each form a respective test patch image on the image carrier. At each of the image stations I and II, the test patch image is formed after upstream one of the two developing means has formed an image or before downstream one of the developing means forms an image.

First Embodiment

Figure 18:
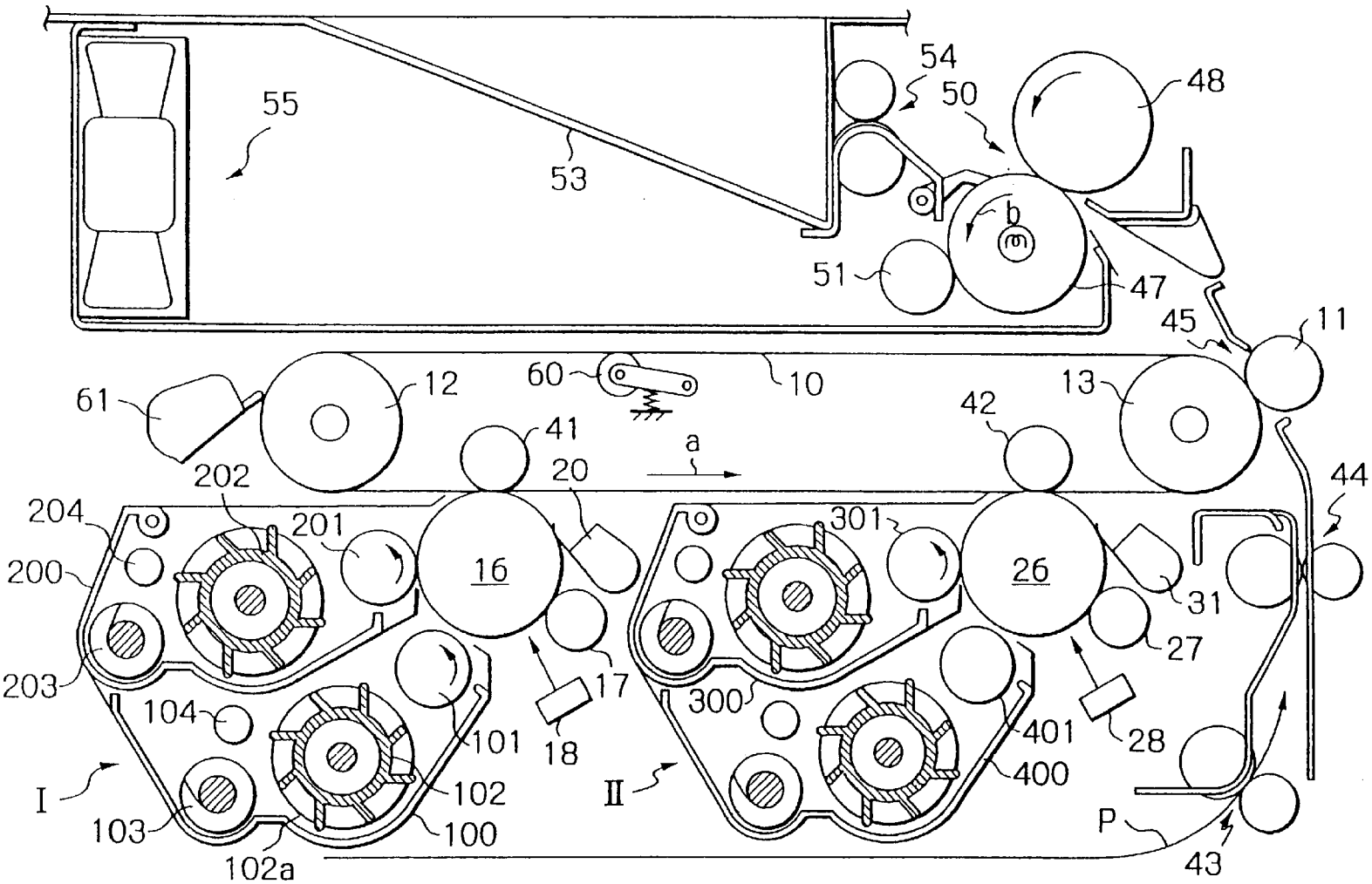
FIG. 18 is a view showing a drive transmission mechanism with which the first embodiment is practicable.

Referring to FIG. 18, an image forming apparatus with which a first embodiment of the present invention is shown. As shown, the apparatus includes a drive roller 13 and a driven roller 12 over which the belt 10 is passed. A drive source, not shown, drives the drive roller 13 such that the belt 10 turns in the direction a. A tension roller 60 applies optimal tension to the belt 10. A first and a second image forming unit I and II, respectively, are positioned at a preselected distance from each other along the lower run of the belt 10. The belt 10 is longer than a paper sheet of maximum size applicable to the illustrative embodiment, as measured in the direction of movement of the paper sheet, by the length of a non-image region.

The first image forming unit I includes a photoconductive drum or image carrier (drum hereinafter) 16, a charger 17 implemented as a roller, writing means 18, an A developing section 100, a C developing section 200, and cleaning means 20. The charger 17 uniformly charges the surface of the drum 16. The writing means 18 scans the charged surface of the drum 16 with a light beam modulated in accordance with an image signal, thereby forming a latent image on the drum 16.

The A developing section 100 includes a developing roller 101, a paddle roller 102, a screw conveyor 103, and an opening 104 for the replenishment of a developer. The paddle roller 102 has a screw-like fin 102*a* and rotates in one direction to convey a developer stored in the A developing section 100 while agitating it. The screw conveyor 103 conveys the developer stored in the A developing section 100 in the direction opposite to the direction in which the paddle roller 102 conveys it. Consequently, the developer is sufficiently agitated by the paddle roller 102 and screw conveyor 103 before it deposits on the developing roller 101.

A toner container storing fresh A toner, not shown, is removably set in the opening 104. The fresh A toner is adequately replenished to one end of the screw conveyor 103 so as to maintain the toner content of the developer constant.

The C developing section 200 includes a developing roller 201, a paddle roller 202, a screw conveyor 203, and an opening 204 for the replenishment of a developer. These constituents are identical in function as the corresponding ones of the A developing section 100.

Figure 19:
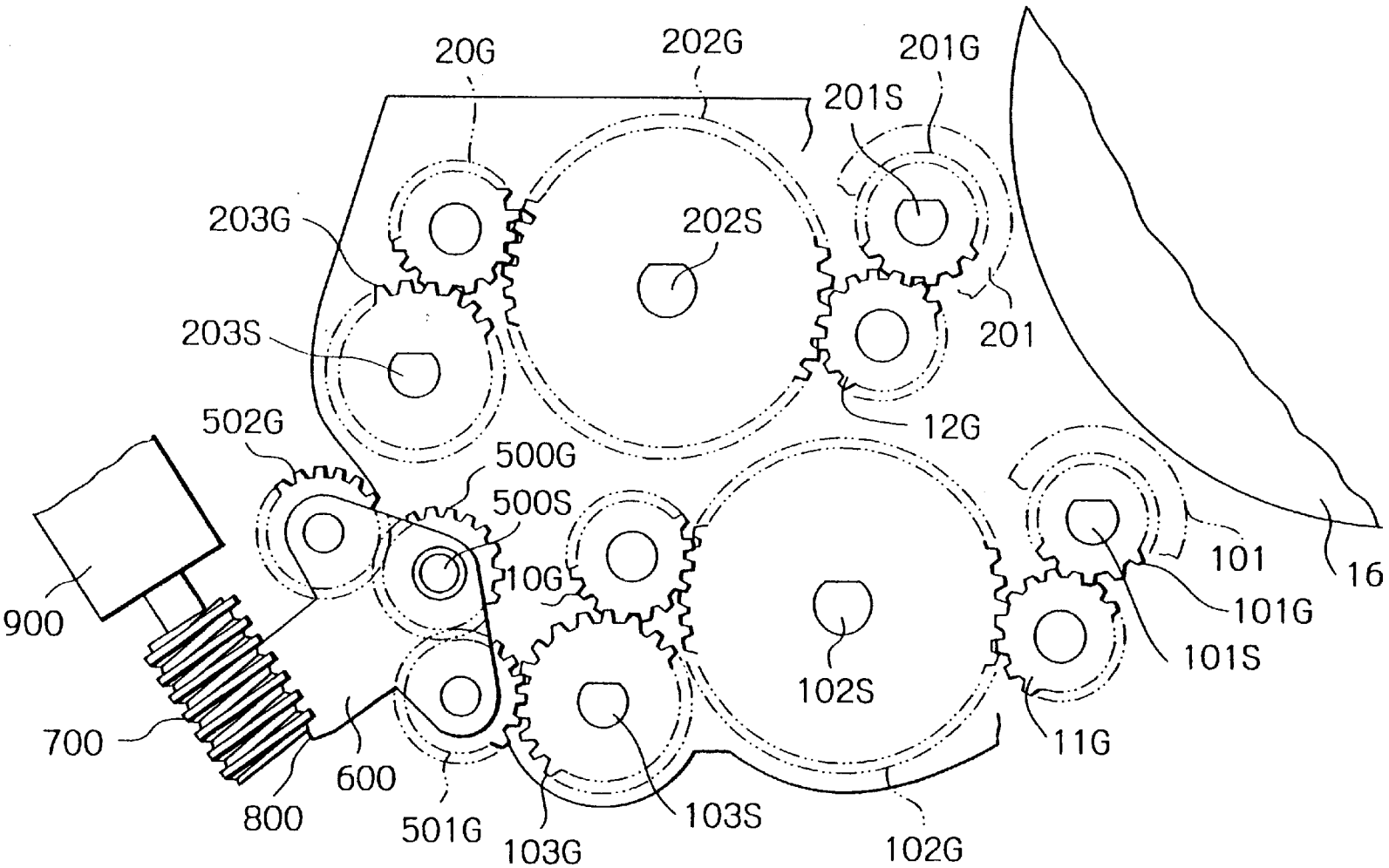
FIG. 19 is a side elevation of the drive transmission mechanism shown in FIG. 18.

As shown in FIG. 19, the paddle roller 102 and screw conveyor 103 included in the A developing section 100 are mounted on shafts 102S and 103S, respectively. Gears 102G and 103G are respectively affixed to the ends of the shafts 102S and 103S outside of one of opposite end walls, which delimit the A developing section 100. The gears 102G and 103G and therefore the paddle roller 102 and screw conveyor 103 are interconnected via an idle gear 10G. Likewise, the paddle roller 102 and developing roller 101 are interconnected via gears 102G and 101G affixed to their shafts 102S and 101S, respectively, and an idle gear 11G.

As shown in FIG. 19, the paddle roller 202 and screw conveyor 203 included in the C developing section 200 are also interconnected via gears 202G and 203G affixed to their shafts 202S and 203S, respectively, and an idle gear 20G. Further, the paddle roller 202 and developing roller 201 are interconnected via gears 202G and 201G affixed to their shafts 202S and 201S, respectively, and an idle gear 12G.

A drive source, not shown, drives the gears 103G and 203G of the screw conveyors 103 and 203 such that the developing rollers 101 and 201 rotate in a direction indicated by an arrow in FIG. 18. A motor or drive source, not shown, mounted on the apparatus body has an output shaft 500S on which a drive gear 500G is mounted. A pair of switch gears 501G and 502G are held in mesh with the drive gear 500G. The switch gears 501G and 502G are rotatably mounted on a switch plate 600, which is pivotable about the drive shaft 500S. The switch plate 600 pivots about the drive shaft 500S in order to selectively bring the switch gear 501G or 502G into mesh with the gear 103G or 203G, respectively. In FIG. 19, the switch gear 501G is shown as meshing with the gear 103G, causing the developing roller 101 to rotate.

A worm 700 is mounted on the output shaft of a motor 900. Part of the switch plate 600 is formed with a worm gear 800 meshing with the worm 700. The motor 900 causes the worm 700 to rotate either forward or backward for thereby causing the switch plate 600 to pivot.

As shown in FIG. 18, the second image forming unit II, like the first image forming unit I, includes a photoconductive drum 26, a charger 27, writing means 28, a B developing section 300, a D developing section 400, and cleaning mans 31. The image forming unit II is mounted on the apparatus body in the same posture as the image forming section I. The drive transmission shown in FIG. 19 is applied to the image forming unit II as well.

The image forming units I and II are removable from the apparatus body. The drums 16 and 26 each rotate in synchronism with the movement of the belt 10. More specifically, the peripheral speed of the drums 16 and 26 is precisely coincident with the running speed of the belt 10. The chargers 17 and 27 may be replaced with charging means implemented by corona chargers or brushes, If desired.

In the first image forming unit I, the A developing section 100 and C developing section store magenta toner and cyan toner, respectively. In the second image forming unit II, which is closer to an image transfer station 45 than the first image forming unit I, the B developing unit 300 and D developing unit 400 store yellow toner and black toner, respectively. Black toner is used to produce not only color copies but also black-and-white copies. Therefore, to increase a copying speed during black-and-white mode operation, the D developing unit 400 should advantageously be arranged in the second developing unit II, which adjoins the image transfer station 45.

Yellow toner is low in contrast with respect to white paper sheets and therefore consumed more than the other color toner except for black toner. Black toner is frequently used for black-and-white copies and also consumed in a great amount. Therefore, assuming a toner container having a given capacity, then yellow toner and black toner are replenished at substantially the time timing. It follows that a yellow toner container and a black toner container should preferably be mounted to the same image forming unit, i.e., the second image forming unit II and replaced at the same time.

The charger 17 and writing means 18 and the charger 27 and writing means 28 each cooperate to form a latent image on the drum 16 or 26 by a conventional process. The developing rollers 101, 201, 301 and 401 each develop the respective latent image. The developing sections 100, 200, 300 and 400 are identical in construction and may be implemented as a color developing section taught in, e.g., Japanese Patent Laid-Open Publication No. 8-160697.

A first and a second transfer roller 41 and 42, respectively, face and selectively contact the drums 16 and 26 with the intermediary of the belt 10. A bias voltage for image transfer is applied to each of the transfer rollers 41 and 42. A transfer roller 11 selectively contacts the drive roller 13 with the intermediary of the belt 10 and also applied with a bias voltage for image transfer.

Usually, the drums 16 and 26 are positioned slightly below the belt 10 while the transfer rollers 41 and 42 are positioned slightly above the belt 10. To transfer toner images from the drums 16 and 26 to the belt 10, the transfer roller 41 and/or the second transfer roller 42 causes the belt 10 to contact the drum 16 and/or the drum 26.

The drive roller 13 and transfer roller 11 constitutes the image transfer station 45 for color image transfer. The transfer rollers 41 and 42, which play the role of image transferring means, may be replaced with corona chargers or brush chargers, if desired. A belt cleaner 61 selectively contacts the driven roller 12 with the intermediary of the belt 10 for removing toner left on the belt 10 after image transfer.

A sheet feeder, not shown, is positioned below the image forming units I and II for feeding paper sheets to the right, as viewed in FIG. 18. A paper sheet P paid out from the sheet feeder is conveyed to the image transfer station 45 by a pickup roller pair 43 and a registration roller pair 44.

A fixing unit 50 is positioned obliquely above the image transfer station 45 and made up of a heat roller 47 and a press roller 48 pressed against the heat roller 47. The heat roller 47 is caused to rotate in a direction indicated by an arrow b in FIG. 18. A roller 51 selectively contacts the heat roller 47 for coating an offset preventing liquid thereon.

An outlet roller pair 54 is positioned downstream of the fixing unit 50 in the direction of paper feed in order to drive the paper sheet coming out of the fixing unit 50 to a tray 53. An exhaust fan 55 is positioned in the upper left portion of FIG. 18 for discharging heat, so that electric parts arranged below the tray 53 are protected from heat.

The operation of the image forming apparatus will be described hereinafter, taking the condition $L=l'+\alpha$ as an example.

(1) In the first image forming unit I, the charger 17 and writing means 18 form a latent image to be developed by the A developing section 100 on the drum 16. The developing section 100 develops the latent image with the magenta toner to thereby produce a magenta toner image (M toner image hereinafter). The first transfer roller 41 transfers the M toner image to the belt 10.

(2) Before the M toner image being conveyed by the belt 10 in the direction a arrives at the second image forming unit II, the charger 27 and writing means 28 form a latent image to be developed by the B developing section 300 on the drum 26. The B developing unit develops the latent image with yellow toner to thereby produce a yellow toner image (Y toner image hereinafter). The second transfer roller 42 transfers the Y toner image to the belt 10 over the M toner image existing on the belt 10, thereby forming a YM toner image.

(3) Before the MY toner image being conveyed by the belt 10 arrives at the first image forming unit I, the charger 17 and writing means 18 form a latent image to be developed by the C developing unit 200 on the drum 16. The C developing unit 200 develops the latent image with cyan toner to thereby produce a cyan toner image (C toner image hereinafter). The transfer roller 41 transfers the C toner image to the belt 10 over the MY toner image, thereby forming a YMC toner image.

(4) Before the MYC toner image being conveyed by the belt 10 arrives at the second image forming unit II, the charger 27 and writing means 28 form a latent image to be developed by the D developing unit 400 on the drum 26. The D developing unit 400 develops the latent image with black toner to thereby form a black toner image (BK toner image hereinafter). The second transfer roller 42 transfers the BK toner image to the belt 10 over the MYC toner image.

Around the time when a full-color image is completed on the belt 10, the registration roller pair 44 drives a paper sheet P fed from the sheet feeder to the image transfer station 45. As a result, the full-color image is transferred from the belt 10 to the paper sheet P. The fixing unit 50 fixes the full-color image on the paper sheet P. The outlet roller pair 54 drives the paper sheet P carrying the fixed image to the tray 53. The belt cleaner 61 removes the toner left on the belt 10 after the image transfer.

To produce a plurality of color prints, when the second image forming unit II transfers the MY toner image to the belt 10, the first image forming unit I transfers the next M toner image to the belt 10. This is followed by the steps (1) through (4) described above.

While one of the two developing rollers 101 and 201 (or 301 and 401) is in rotation for developing a latent image formed on the associated drum, the other developing roller is held in a halt. For the developing roller, use may be made of a nonmagnetic sleeve rotatable during development and a magnet roller disposed in the sleeve as conventional.

The prerequisite with the above construction is that while one developing roller is in operation, the developer deposited on the other developing roller is prevented from being transferred to the drum and bringing about color mixture. For this purpose, the magnet roller disposed in the developing roller in a halt is slightly rotated to shift its magnetic pole facing the drum. This successfully prevents the developer on the developing roller from contacting the drum. Alternatively, use may be made of a mechanism for moving the developing roller in a halt slightly away from the drum.

Assume that the circumference of the drum 16 or 26 moves over a circumferential length L1 within a period of time necessary for the developing function to be switched from one of the developing sections 100 and 200 to the other developing section or from one of the developing sections 300 and 400 to the other developing section, respectively. Also, assume that the drum 16 or 26 has a circumferential length L2 between a developing position assigned to the upstream developing section 100 or 400, respectively, in the direction of rotation of the drum and a developing position assigned to the downstream developing section 200 or 300 in the above direction. Then, there exist a case wherein a relation of $L1 \leqq L2$ holds, as shown in FIGS. 1A and 1B, and a case wherein a relation of $L1 \geqq L2$ holds, as shown in FIGS. 2A and 2B.

Figure 1A:
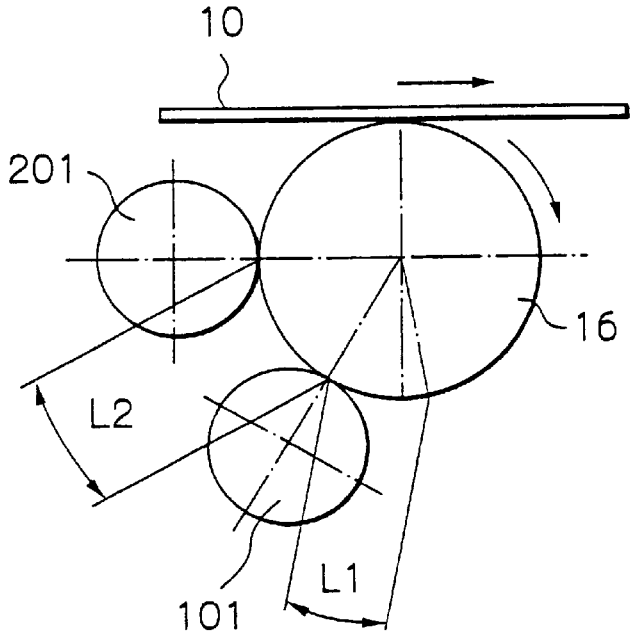
FIGS. 1A and 1B are views respectively showing a case of $L1 \leqq L2$ and a case of $L1 \geqq L2$ particular to a first embodiment of the present invention.

As shown in FIG. 1A, in the case of $L1 \leqq L2$, an image cannot be formed on the drum 16 located at the image station I over a range of L2+L1 (non-formable range hereinafter). This non-formable corresponds to an interval between the time when the switching function is switched from the downstream developing roller 201 to the upstream developing roller 101 at the same time as the trailing edge of an image forming range on the drum 16 (formation range hereinafter) arrives at the downstream developing roller 201 to be developed thereby and the time when the upstream developing roller 101 is enabled to effect development.

Figure 1B:
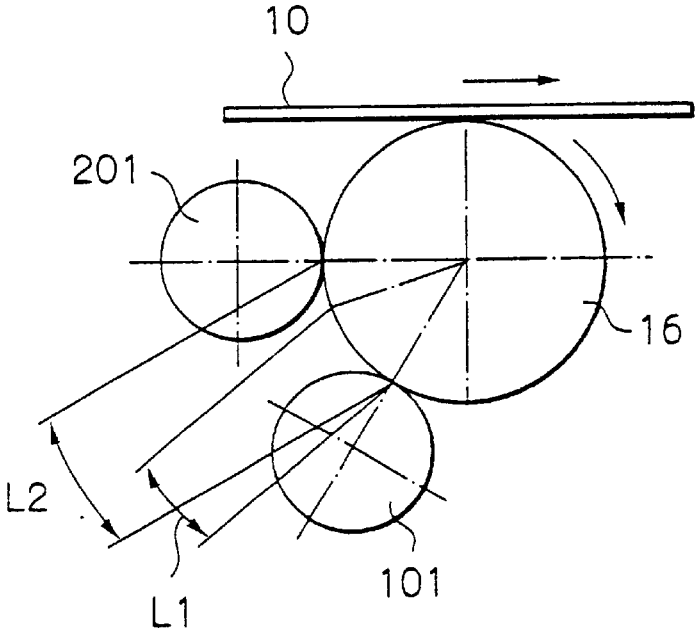

As shown in FIG. 1B, the above non-formable range does not exist on the drum 16 over an interval between the time when the switching function is switched from the upstream developing roller 101 to the downstream developing roller 201 at the same time as the trailing edge of a formation range on the drum 16 assigned to the developing roller 101 arrives at the roller 101 and the time when the downstream developing roller 201 is enabled to effect development. The conditions shown in FIGS. 1A and 1B apply to the other image station II as well.

Figure 2A:
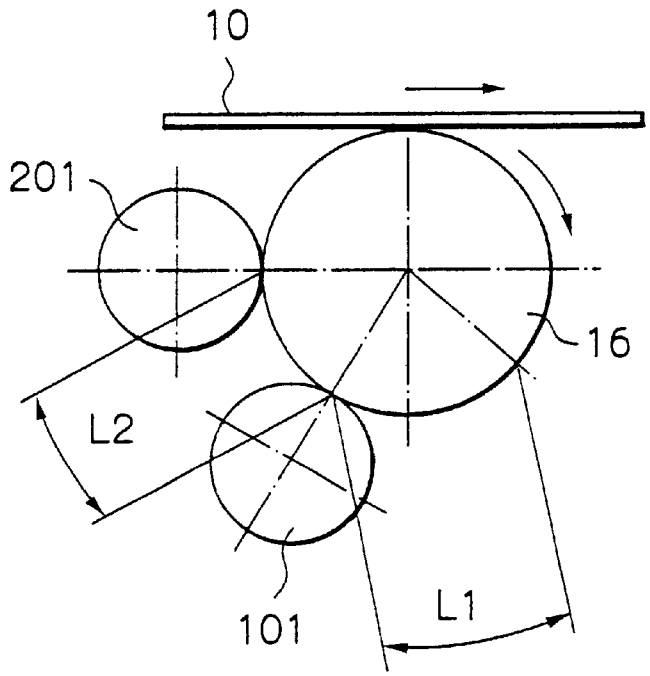
FIGS. 2A and 2B are views for describing the first embodiment.
Figure 2B:
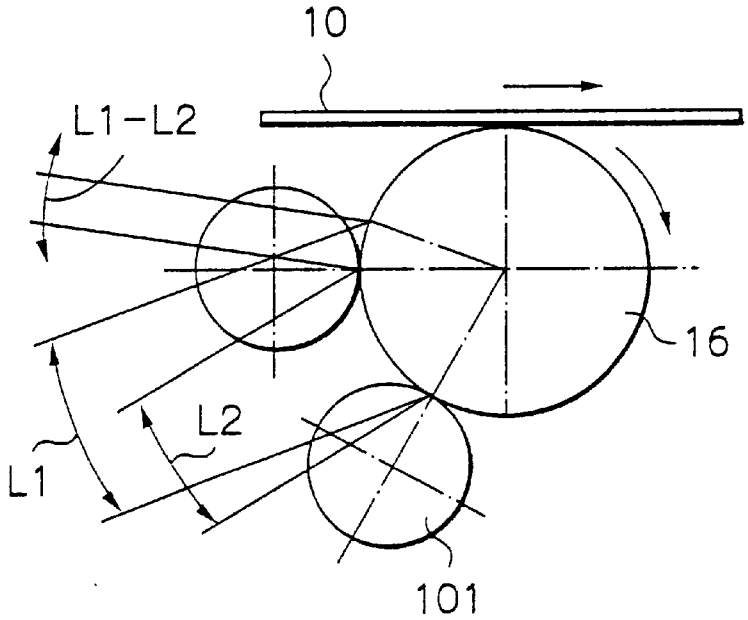

As shown in FIG. 2A, in the case of $L1 \geqq L2$, a non-formable range on the drum 16 located at the image station I is L2+L1. This non-formable range corresponds to an interval between the time when the switching function is switched from the downstream developing roller 201 to the upstream developing roller 101 at the same time as the trailing edge of a formation range on the drum 16 assigned to the downstream developing roller 201 arrives at the developing roller 201 and the time when the upstream developing roller 101 is enabled to effect development.

As shown in FIG. 2B, a non-formable range of L1–L2 exists on the drum 16 over an interval between the time when the switching function is switched from the upstream developing roller 101 to the downstream developing roller 201 at the same time as the trailing edge of a formation range on the drum 16 assigned to the developing roller 101 arrives at the roller 101 and the time when the downstream developing roller 201 is enabled to effect development. The conditions shown in FIGS. 2A and 2B also apply to the other image station II as well.

Figure 3A:
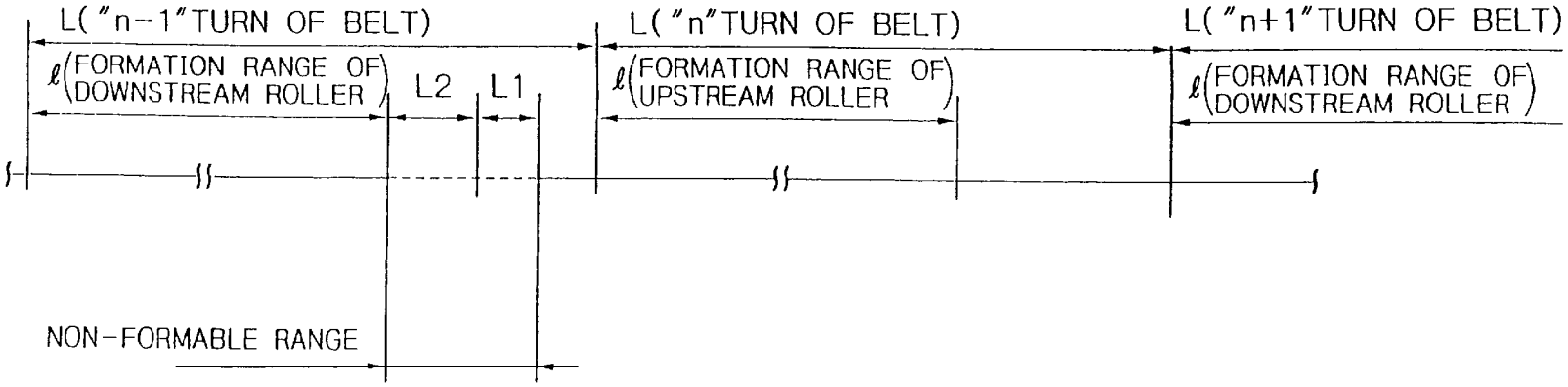
FIGS. 3A, 3B, 4A, 4B, 5A, 5B, 6A and 6B are timing charts for describing a second embodiment of the present invention.
Figure 3B:
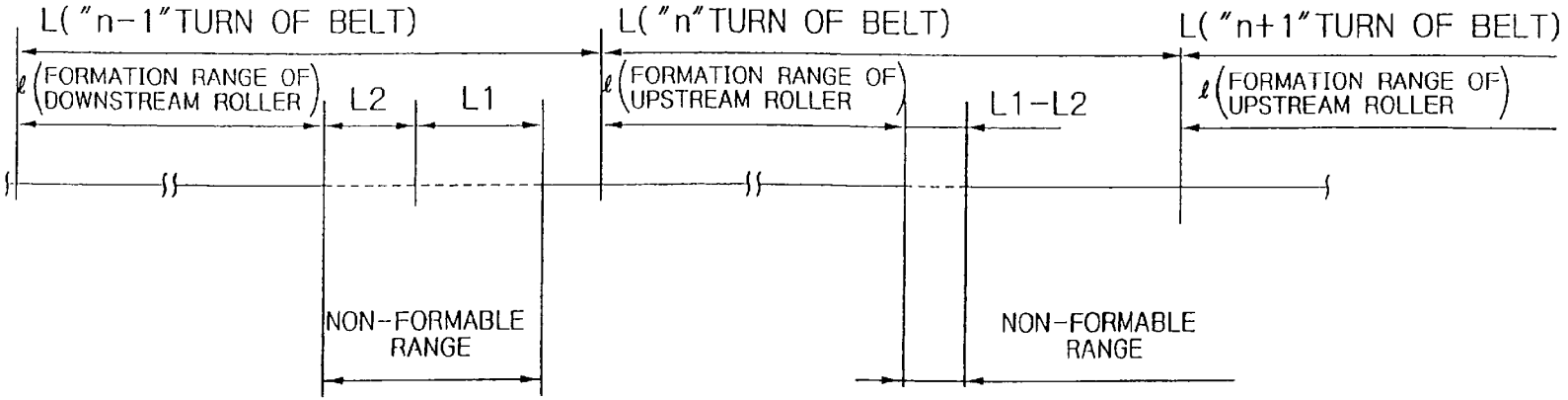

As for the conditions shown in FIGS. 1A and 1B, FIG. 3A shows formation ranges over which images are transferred from the drum 16 to the belt 10 and non-formable ranges over which no images are transferred from the former to the latter. FIG. 3B shows formation ranges and non-formable ranges particular to the conditions described with reference to FIGS. 2A and 2B.

Assume that the belt 10 has a circumferential length L, and that a formation range for a single turn of the belt 10 is l. The formation range l sometimes includes a margin for absorbing a sheet registration error in addition to the actual length of an output image. Further, when images are formed on a plurality of paper sheets during one turn of the belt 10, the formation range l additionally includes an interval between consecutive paper sheets.

To execute image quality compensation control during image formation, it is necessary to form a test patch image on the drum 16 between a formation range assigned to one of the developing rollers 101 and 102 and a formation range assigned to the other developing roller. As FIGS. 3A and 3B clearly indicate, the non-formable range extending from the formation range assigned to the downstream developing roller 201 to the formation range assigned to the upstream developing roller 101 is broader than one extending from the latter to the former. It follows that the circumferential length of the belt 10 must be further increased to allocate a sufficient range for the formation of a test patch image. Therefore, if a test patch image is formed on the drum 16 in the range extending from the formation range assigned to the upstream developing roller 101 to the formation range assigned to the downstream developing roller 201, then the belt 10 can be reduced in size. This is also true with the other image station II.

In light of the above, control means, not shown, controls the image stations I and II such that test patch images are formed on the belt 10 in the range extending from the formation range assigned to the upstream developing roller 101 to the formation range assigned to the downstream developing roller 201 and the range extending from the formation range assigned to the upstream developing roller 401 to the formation range assigned to the downstream developing roller 301. More specifically, the chargers 17 and 27 and writing means 18 and 28 located at the image stations I and II, respectively, cooperate to form latent images representative of test patch images on the drums 16 and 26, respectively. One of the developing units 100 and 200 and one of the developing units 300 and 400 develop the latent images formed on the drums 16 and 26, respectively, for thereby producing test patch images. The test patch images are sequentially transferred to the belt 10. A sensor, not shown, senses the density (amount of toner deposition) of each test patch image formed on the belt 10. The control means compares, based on the outputs of the sensor, the densities of the test patch images with a reference density. The control means then controls a bias for development, the quantity of exposure by the writing means and other image forming conditions in accordance with the result of comparison such that the reference image density is maintained. In a repeat print mode, the control means controls the image stations I and II in accordance with a print start command and a desired number of prints input on an operation panel, not shown, such that color image formation is repeated a number of times corresponding to the desired number of prints.

As stated above, in the illustrative embodiment, the image stations I and II form test patch images on the drums 16 and 26, respectively. The densities of the test patch images are sensed to execute image quality compensation control. Further, the test patches each are formed after the upstream developing section 100 or 400 in the direction of rotation of the drum 16 or 26 has formed an image or before the downstream developing section 200 or 300 forms an image. This successfully reduces the circumferential length of the belt 10 necessary for image quality compensation control to be executed during repeat print mode operation, thereby promoting high-speed image formation and small-size configuration.

Second Embodiment

As FIGS. 3A and 3B indicate, the prerequisite with the first embodiment is that the circumferential length L of the belt 10 be greater than or equal to l+L1+L2. If only image formation and the switching of the developing function are taken into account as essential operation, then the length L is equal to l+L1+L2.

Figure 4A:
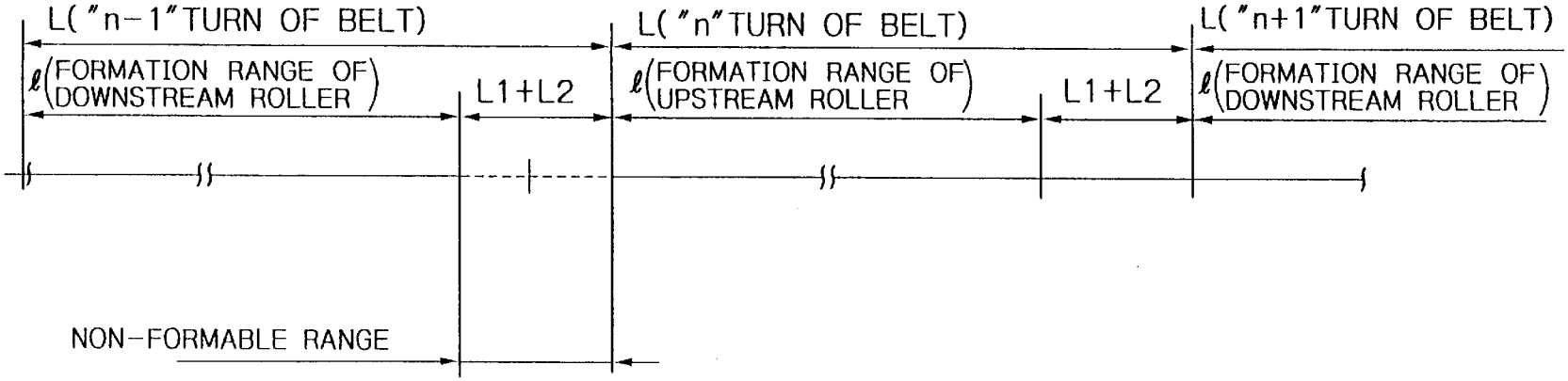
Figure 4B:
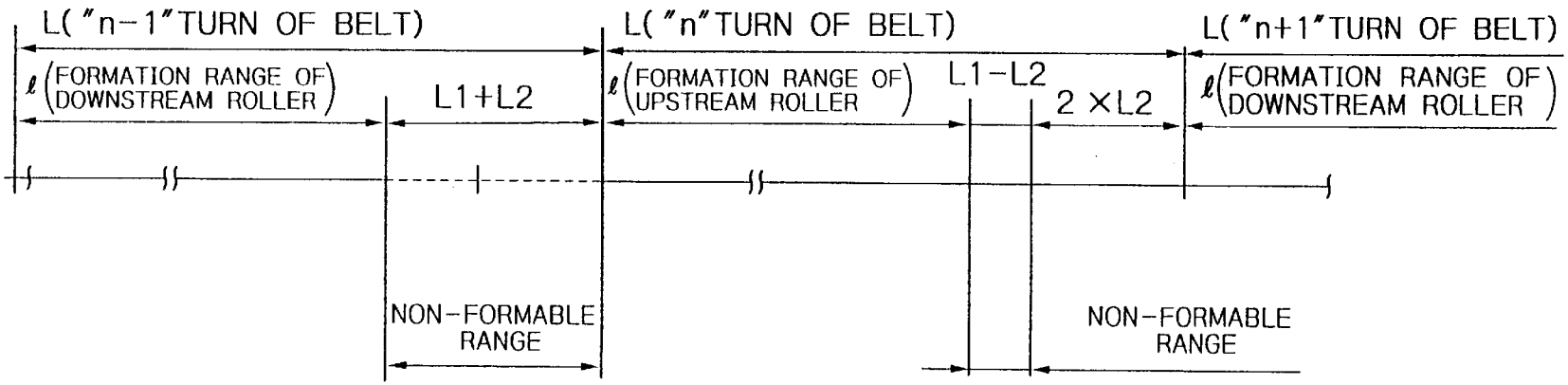

The illustrative embodiment differs from the first embodiment in that the length L is selected to be l+L1+L2, as shown in FIGS. 4A and 4B. FIGS. 4A and 4B relate to the case of L1≦L2 and the case of L1≧L2, respectively. In the condition shown in FIG. 4A, a formation range of L1+L2 is available on the belt 10 and extends from the formation range assigned to the upstream developing roller 101 or 401 to the formation range assigned to the downstream developing roller 201 or 301, respectively.

The illustrative embodiment therefore selects a range p for forming a test patch image (test patch range hereinafter) that is smaller than or equal to L1+L2. This implements image quality compensation control during image formation with the minimum necessary length of the belt 10, i.e., without any additional length otherwise allocated to the above control, thereby reducing the size of the belt 10.

Figure 5A:
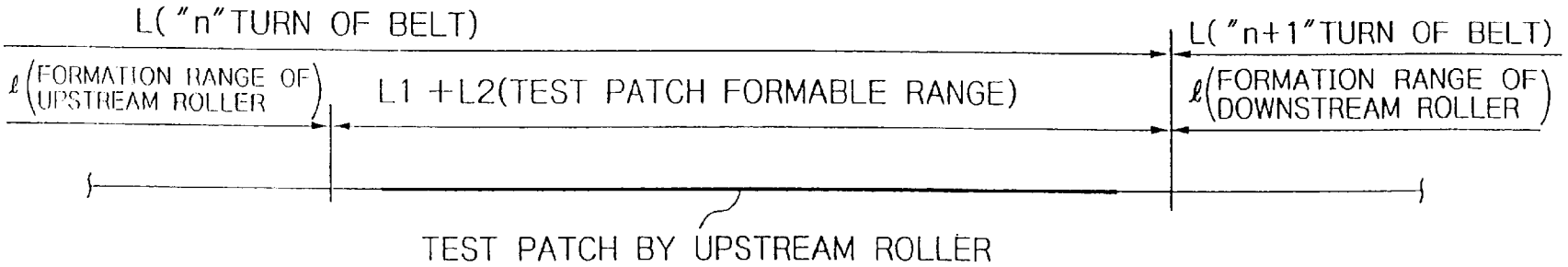
Figure 5B:
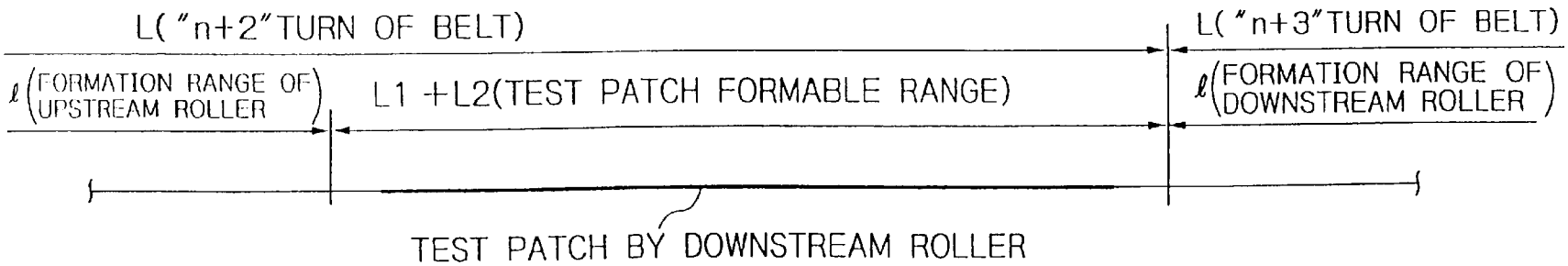

FIG. 5A shows a timing assigned to each of the upstream developing rollers 101 and 401 for forming a test patch image in the respective color. As shown, the control means controls each K image station 1 or 11 such that after the formation range assigned to the upstream developing roller 101 or 401, the developing roller 101 or 401 forms a test patch image at any point in the range of L1+L2. Subsequently, the control means switches the developing function from the upstream developing roller 101 or 401 to the downstream developing roller 201 or 301, respectively. The control means then causes the developing roller 201 or 301 to start forming an image. FIG. 5B shows a timing assigned to each of the downstream developing rollers 201 and 301 for forming a test patch in the respective color. As shown, the control means controls each image station I or II such that after the formation range assigned to the upstream developing roller 101 or 401, the developing function is switched from the developing roller 101 or 401 to the downstream developing roller 201 or 301. The control means then causes the developing roller 201 or 301 to form a test patch image at any point in the range of L1±L2. Subsequently, the control means causes the developing roller 201 or 301 to start forming an image.

FIG. 5B shows a timing assigned to each of the downstream developing rollers 201 and 301 for forming a test patch in the respective color. As shown, the control means controls each image station I or II such that after the formation range assigned to the upstream developing roller 101 or 401, the developing function is switched from the developing roller 101 or 401 to the downstream developing roller 201 or 301. The control means then causes the developing roller 201 or 301 to form a test patch image at any point in the range of L1+L2. Subsequently, the control means causes the developing roller 201 or 301 to start forming an image.

As shown in FIG. 4B, in the case of L1≧L2, a range of 2×L2 in which an image can be formed is available from the formation range assigned to each upstream developing roller 101 or 401 to the formation range assigned to the associated downstream developing roller 201 or 301. In this case, the test patch range p is selected to be smaller than or equal to 2×L2. This also implements image quality compensation control during image formation with the minimum necessary length of the belt 10, i.e., without any additional length otherwise allocated to the above control, thereby reducing the size of the belt 10.

Figure 6A:
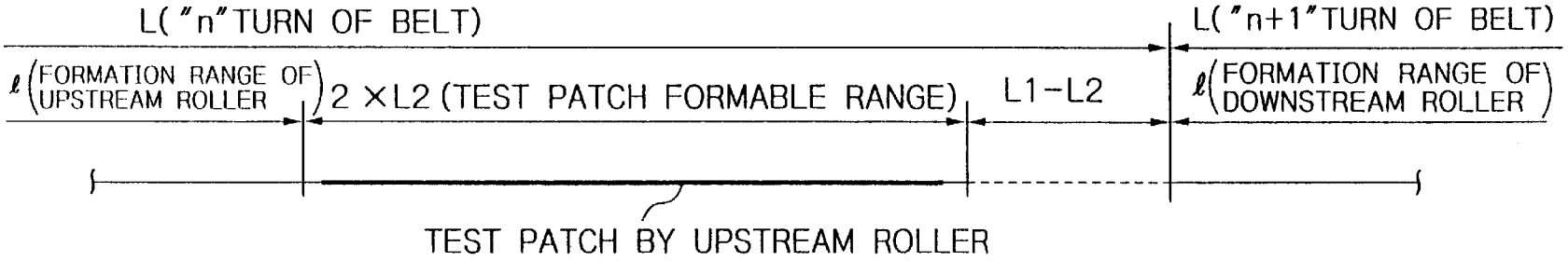

FIG. 6A shows a timing assigned to each of the upstream developing rollers 101 and 401 for forming a test patch in the respective color. As shown, the control means controls each image station I or II such that after the formation range assigned to the upstream developing roller 101 or 401, the developing roller 101 or 401 forms a test patch image at any point in the range of 2×L2. Subsequently, the control means switches the developing function from the upstream developing roller 101 or 401 to the downstream developing roller 201 or 301, respectively. The control means then causes the developing roller 201 or 301 to start forming an image.

Figure 6B:
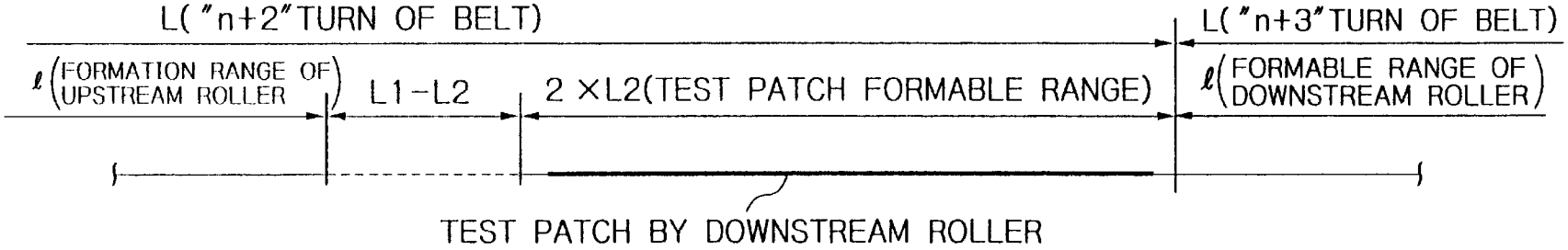

FIG. 6B shows a timing assigned to each of the downstream developing rollers 201 and 301 for forming a test patch in the respective color. As shown, the control means controls each image station I or II such that after the formation range assigned to the upstream developing roller 101 or 401, the developing function is switched from the developing roller 101 or 401 to the downstream developing roller 201 or 301. The control means then causes the developing roller 201 or 301 to form a test patch image at any point in the range of 2×L2. Subsequently, the control means causes the developing roller 201 or 301 to start forming an image.

In the illustrative embodiment, as in the previous embodiment, the length L is l+L1+L2 while the length L1 is smaller than or equal to L2. In addition, the test patch range p in the direction of rotation of the drum is selected to be smaller than or equal to L1+L2. This also implements image quality compensation control during image formation with the minimum necessary length of the belt 10, i.e., without any additional length otherwise allocated to the above control, thereby reducing the size of the belt 10.

Further, in the illustrative embodiment, L1 is selected to be greater than or equal to L2 while the patch image range p is selected to be smaller than or equal to 2×L2. This, coupled with the length L that is l+L1+L2, also implements image quality compensation control during image formation with the minimum necessary length of the belt 10, thereby further promoting high-speed image formation and small-size configuration.

Third Embodiment

In the second embodiment, a test patch image for image quality compensation control during image formation can be formed only in the range extending from the formation range assigned to the upstream developing roller 101 or 401 to the formation range assigned to the downstream developing roller 201 or 301, respectively. A test patch image is therefore formed once for two turns of the belt 10, i.e., once for one time of image transfer to a paper sheet. It follows that when an upstream patch image and a downstream patch image are formed alternately with each other, each test patch image is formed once for four consecutive turns of the belt 10, i.e., once for two times of image transfer to paper sheets.

Figure 7:
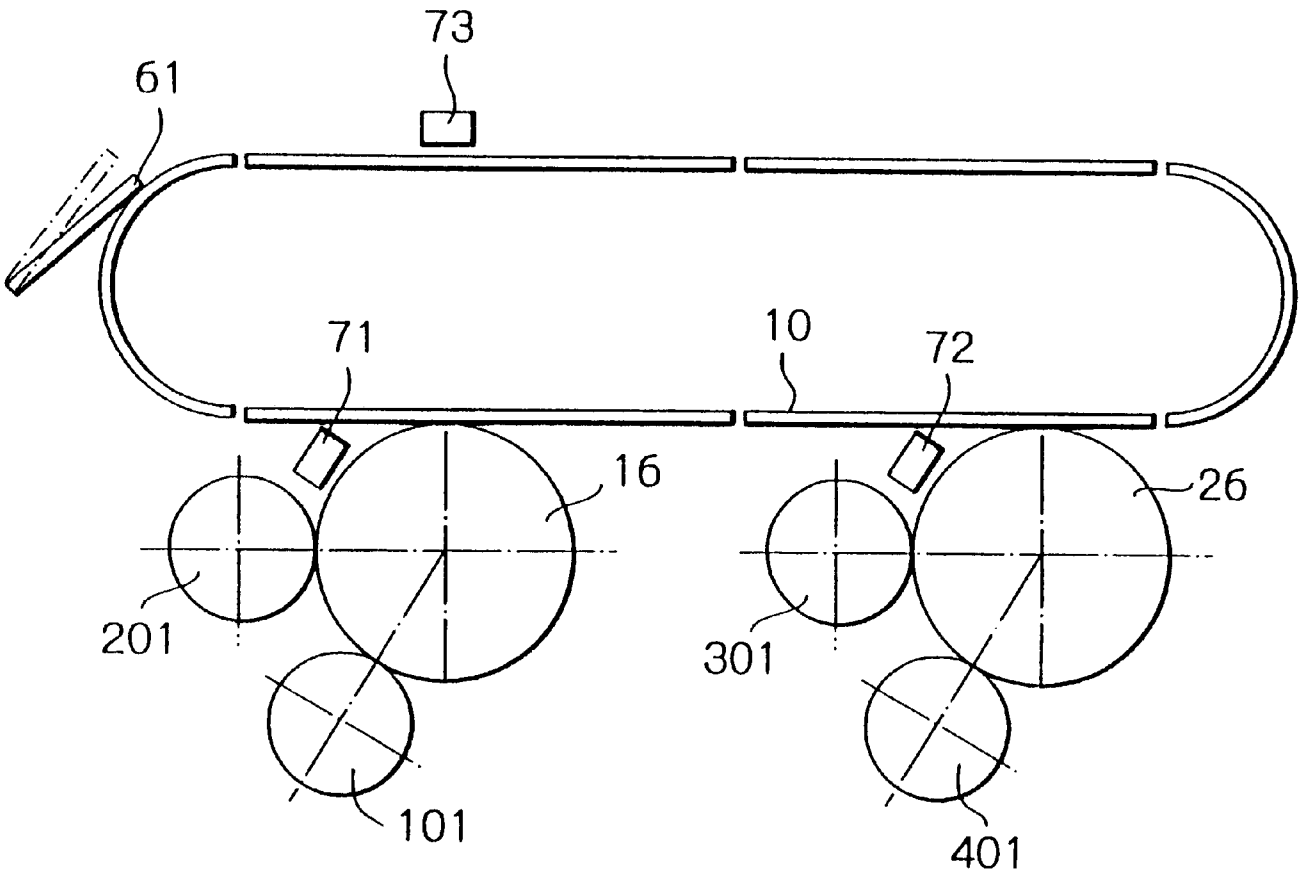
FIG. 7 is a view showing a third embodiment of the present invention.

As shown in FIG. 7, assume that two sensors 71 and 72 respectively sense the densities of test patch images formed on the drums 16 and 26. Then, the sensors 71 and 72 not only increase the cost of the apparatus, but also obstruct the miniaturization of the image stations I and II.

As also shown in FIG. 7, assume that a single sensor 73 senses the densities of the test patch images formed on the belt 10. Then, it is necessary to prevent the test patch images formed at the image stations I and II from overlapping each other. Therefore, when the test patch images are formed at half a frequency, i.e., once for eight turns of the belt 10 (once for four times of image transfer to paper sheets), it is likely that the accuracy of image quality correction control falls. If the positions where the image stations I and II are shifted in the main scanning direction and if two sensors 73 are arranged side by side in the same direction, then the cost of the apparatus increases.

On the other hand, assume that the test patch image formed by the upstream developing roller of one image station and the test patch image formed by the downstream developing roller of the other image station are transferred to the belt 10 one above the other. Then, if the belt cleaner 61 is ON/OFF controlled in such a manner as to clean only the test patch portion of the belt 10 after the sensor 73 has sensed the density of the test patch image, then the frequency of test patch formation can be reduced to once for four turns of the belt 10, i.e., two times of image transfer to paper sheets. This, however, needs sophisticated, highly accurate control over the belt cleaner 61 and also increases the cost.

Figure 8A:
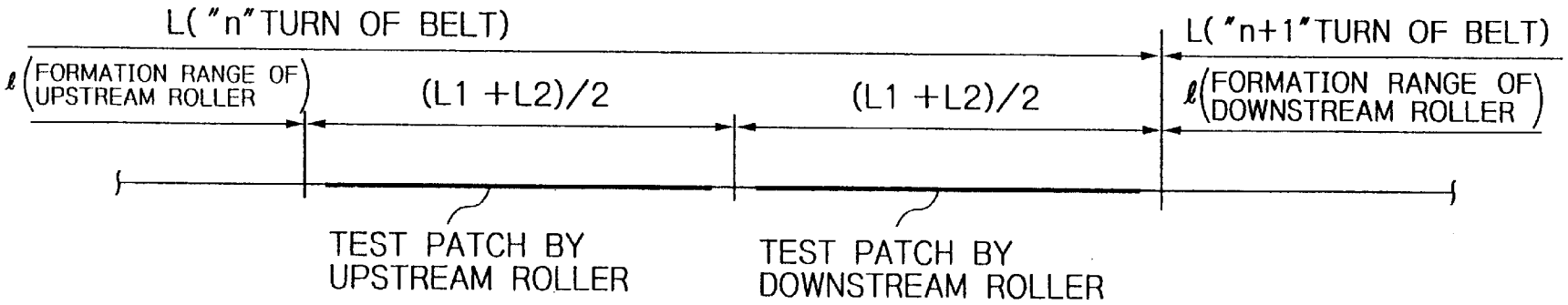
FIGS. 8A and 8B are timing charts for describing the operation of the third embodiment.
Figure 8B:
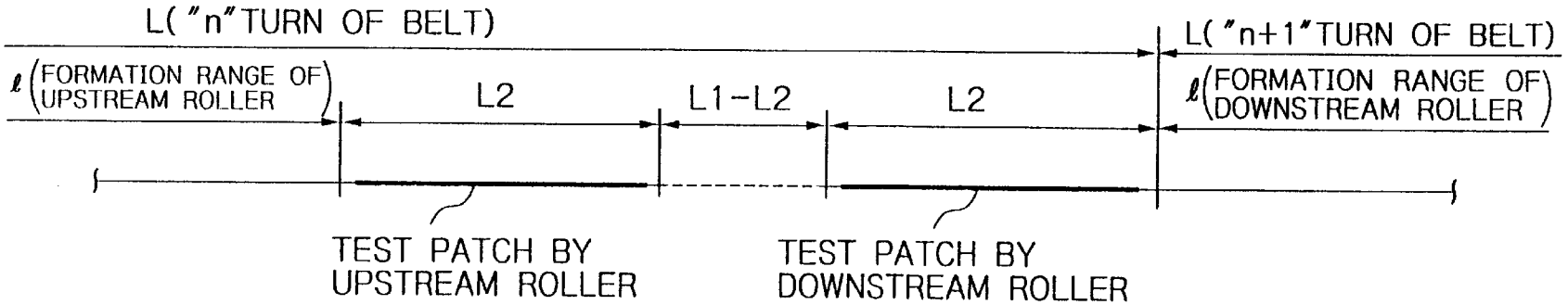

In the second embodiment, the third embodiment selects the circumferential length L of the belt 10 that is $l+L1+L2$. FIGS. 8A and 8B show the case of $L1<L2$ and the case of $L1 \geqq L2$, respectively. In the case shown in FIG. 8A, a range of $L1+L2$ in which an image can be formed is available from the formation range assigned to the upstream developing roller 101 or 401 to the formation range assigned to the downstream developing roller 201 or 301, respectively.

In light of the above, the test patch range p for image quality compensation control is selected to be smaller than or equal to $(L1+L2)/2$. In this condition, the control is achievable during image formation with the minimum necessary length of the belt 10 necessary for image formation. In addition, the sensor 73 should only sense the densities of the test patch images of different colors once for four turns of the belt 10, i.e., once for two times of image transfer to paper sheets.

As shown in FIG. 8A, after the formation range assigned to the upstream developing roller 101 or 401, the control means causes the roller 101 or 401 to form a test patch image at any point in the range of $(L1+L2)/2$. Subsequently, the control means switches the developing function from the upstream developing roller 101 or 401 to the downstream developing roller 201 or 301 and causes it to form a test patch image at any point in the range of $(L1+L2)/2$. The control means then causes the downstream developing roller 201 or 301 to start forming an image. As shown in FIG. 8B, in the case of $L1 \geqq L2$, a range of $2 \times L2$ in which an image can be formed extends from the formation range assigned to the upstream developing roller 101 or 401 to the formation range assigned to the downstream developing roller 201 or 301, respectively. In light of this, the test patch range p is selected to be smaller than or equal to the length L2. In this condition, the control is achievable during image formation with the minimum necessary length of the belt 10 necessary for image formation. Moreover, the sensor 73 should only sense the densities of the test patch images of different colors once for four turns of the belt 10, i.e., once for two times of image transfer to paper sheets.

More specifically, as shown in FIG. 8B, after the formation range assigned to the upstream developing roller 101 or 401, the control means causes the roller 101 or 401 to form a test patch image at any point in the range of L2. Subsequently, the control means switches the developing function from the upstream developing roller 101 or 401 to the downstream developing roller 201 or 301 and causes it to form a test patch image at any point in the range of L2. The control means then causes the downstream developing roller 201 or 301 to start forming an image.

As stated above, the illustrative embodiment selects a relation of $p \leqq (L1+L2)/2$. The upstream developing section 100 or 400 forms an image and then forms a test patch image in the respective color. Subsequently, the developing function is switched from the upstream developing section 100 or 400 to the associated downstream developing section 200 or 300, causing the developing section 200 or 300 to form a test patch image in the respective color. The developing section 200 or 300 then starts forming an image. This successfully reduces the number of sensors responsive to test patch images or enhances accurate image quality compensation control and thereby reduces the size and cost of the apparatus or surely prevents image quality from falling.

Also, the illustrative embodiment selects a relation of $p \leqq L2$. The upstream developing section 100 or 400 forms an image and then forms a test patch image in the respective color. Subsequently, the developing function is switched from the upstream developing section 100 or 400 to the associated downstream developing section 200 or 300, causing the developing section 200 or 300 to form a test patch image in the respective color. The developing section 200 or 300 then starts forming an image. This also successfully reduces the number of sensors responsive to test patch images or enhances accurate image quality compensation control and thereby reduces the size and cost of the apparatus or surely prevents image quality from falling.

Fourth Embodiment

Figure 9A:
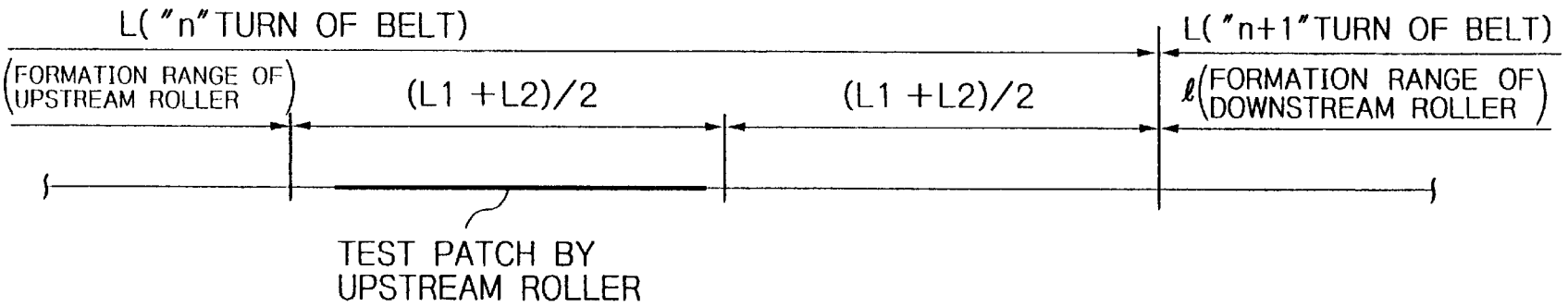
FIGS. 9A and 9B are timing charts for describing a fourth embodiment of the present invention.
Figure 9B:
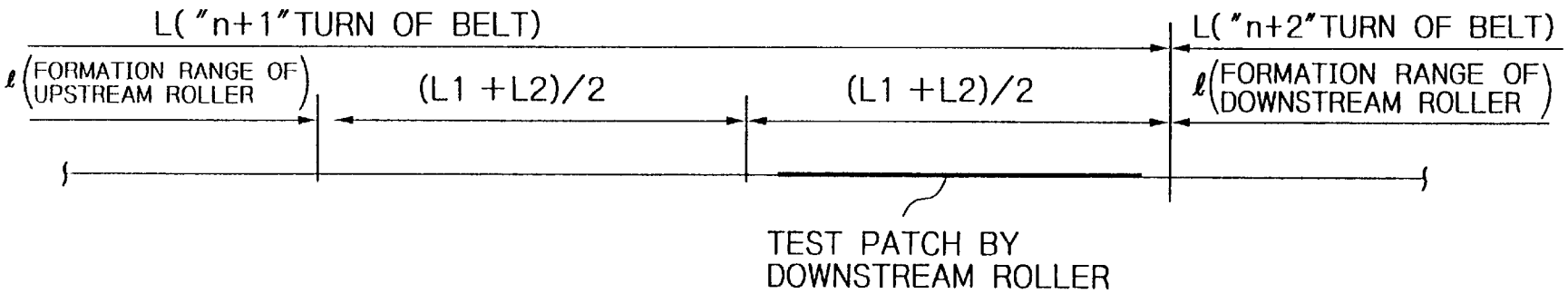

As shown in FIGS. 9A and 9B, in the second embodiment, a fourth embodiment selects the length L of the belt 10 that is $l+L1+L2$ and the length L1 that is smaller than or equal to L2. A range of $L1+L2$ in which an image can be formed is available from the formation range assigned to the upstream developing roller 101 or 401 to the formation range assigned to the downstream developing roller 201 or 301, respectively.

The control means selects a test patch image range p that is smaller than or equal to $(L1+L2)/2$, and prevents test patch images formed at the image stations I and II from overlapping each other on the belt 10. This implements image quality compensation control during image formation with the minimum necessary length of the belt 10 for image formation. Moreover, the sensor 73 should only sense the densities of the test patch images once for four turns of the belt 10, i.e., for two times of image transfer to paper sheets.

Specifically, FIG. 9A shows a case wherein one of the image stations I and II forms a test patch image during the "n" turn of the belt 10. As shown, after the formation range assigned to the upstream developing roller 101 or 401, the control means causes the developing roller 101 or 401 to form a test patch image in the respective color at any point in the range of (L1+L2)/2. The control means then switches the developing function from the upstream developing roller 101 or 401 to the downstream developing roller 201 or 301. Subsequently, after non-image portion extending over (L1+L2)/2, the control means causes the developing roller 201 or 301 to start forming an image.

FIG. 9B shows a case wherein the other of the image stations I and II forms a test patch image during the "n+1" turn of the belt 10. As shown, after the formation range assigned to the upstream developing roller 101 or 401, the control means switches the developing function from the developing roller 101 or 401 to the downstream developing roller 201 or 301. The control means then causes the developing roller 201 or 301 to form a test patch image in the respective color at any point in the range of (L1+L2)/2, which follows a non-image portion extending over (L1+L2)/2. Subsequently, the control means then causes the developing roller 201 or 301 to start forming an image.

With the above procedure, the illustrative embodiment prevents test patch images of different colors from overlapping each other. This reduces the number of sensors for sensing the densities of test patch images or enhances accurate image quality compensation control and thereby reduces the size and cost of the apparatus or surely prevents image quality from falling.

Fifth Embodiment

Figure 10A:
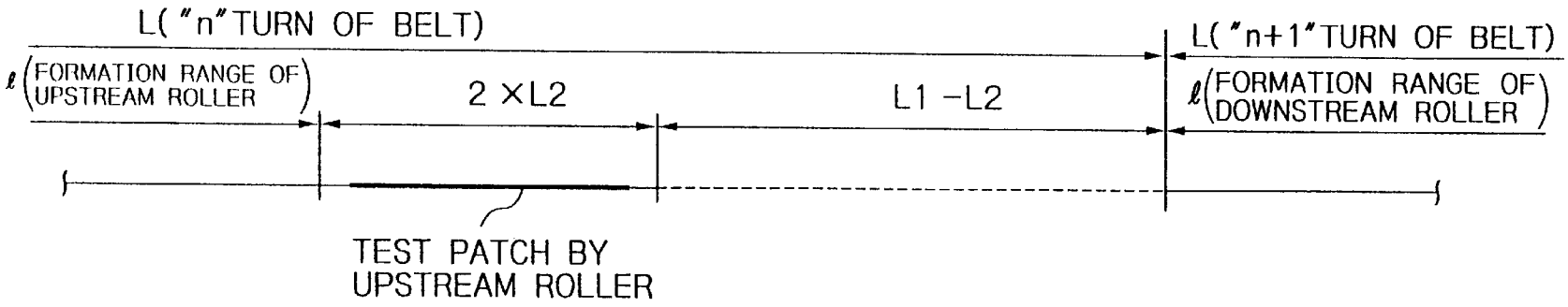
FIGS. 10A and 10B are timing charts for describing a fifth embodiment of the present invention.
Figure 10B:
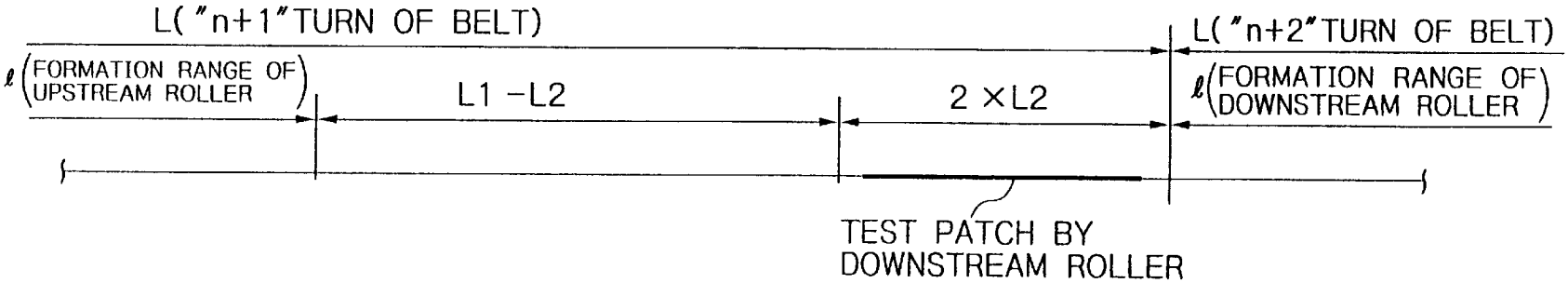

As shown in FIGS. 10A and 10B, in the second embodiment, a fifth embodiment selects the length L of the belt 10 that is l+L1+L2 and the length L1 that is greater than or equal to L2. In this case, a range of 2×L2 in which an image can be formed is available from the formation range assigned to the upstream developing roller 101 or 401 to the formation range assigned to the downstream developing roller 201 or 301.

In the case of L1−L2≧(L1+L2)/2, the control means selects a test patch image range p smaller than or equal to 2×L2 and prevents test patch images formed at the image stations I and II from overlapping each other on the belt 10. This implements image quality compensation control during image formation with the minimum necessary length of the belt 10 for image formation. Moreover, the sensor 73 should only sense the densities of the test patch images once for four turns of the belt 10, i.e., for two times of image transfer to paper sheets.

Specifically, FIG. 10A shows a case wherein one of the image stations I and II forms a test patch image during the "n" turn of the belt 10. As shown, after the formation range assigned to the upstream developing roller 101 or 401, the control means causes the developing roller 101 or 401 to form a test patch image in the respective color at any point in the range of 2×L2. The control means then switches the developing function from the upstream developing roller 101 or 401 to the downstream developing roller 201 or 301. Subsequently, the control means causes the developing roller 201 or 301 to start forming an image.

FIG. 10B shows a case wherein the other of the image stations I and II forms a test patch image during the "n+1" turn of the belt 10. As shown, after the formation range assigned to the upstream developing roller 101 or 401, the control means switches the developing function from the developing roller 101 or 401 to the downstream developing roller 201 or 301. The control means then causes the developing roller 201 or 301 to form a test patch image in the respective color at any point in the range of 2×L2. Subsequently, the control means causes the developing roller 201 or 301 to start forming an image.

With the above procedure, the illustrative embodiment also prevents test patch images of different colors from overlapping each other. This reduces the number of sensors for sensing the densities of test patch images or enhances accurate image quality compensation control and thereby reduces the size and cost of the apparatus or surely prevents image quality from falling.

Sixth Embodiment

Figure 11A:
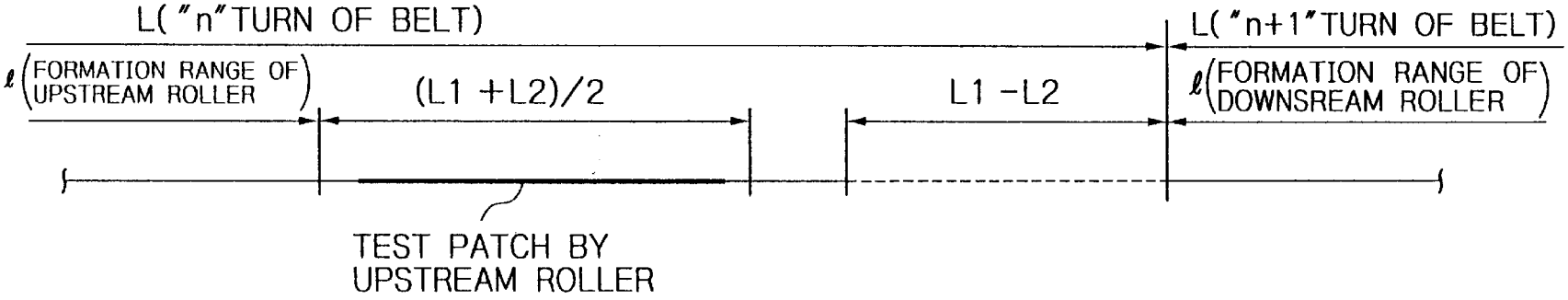
FIGS. 11A and 11B are timing charts for describing a sixth embodiment of the present invention.
Figure 11B:
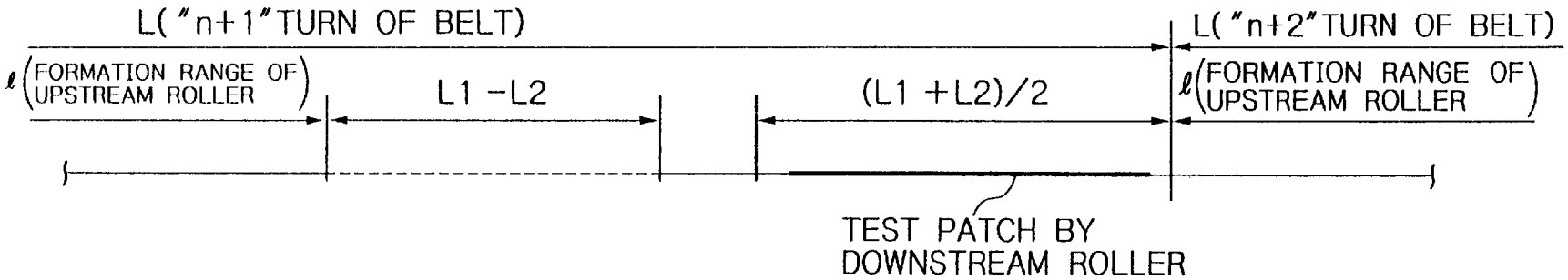

As shown in FIGS. 11A and 11B, in the second embodiment, a sixth embodiment selects the length L of the belt 10 that is l+L1+L2 and the length L1 that is greater than or equal to L2. In this case, a range of 2×L2 in which an image can be formed is available from the formation range assigned to the upstream developing roller 101 or 401 to the formation range assigned to the downstream developing roller 201 or 301.

In the case of L1−L2≧(L1+L2)/2, the control means selects a test patch range p smaller than or equal to (L1+L2)/2 and prevents test patch images formed at the image stations I and II from overlapping each other on the belt 10. This implements image quality compensation control during image formation with the minimum necessary length of the belt 10 for image formation. Moreover, the sensor 73 should only sense the densities of the test patch images once for four turns of the belt 10, i.e., for two times of image transfer to paper sheets.

Specifically, FIG. 11A shows a case wherein one of the image stations I and II forms a test patch image during the "n" turn of the belt 10. As shown, after the formation range assigned to the upstream developing roller 101 or 401, the control means causes the developing roller 101 or 401 to form a test patch image in the respective color at any point in the range of (L1+L2)/2. The control means then switches the developing function from the upstream developing roller 101 or 401 to the downstream developing roller 201 or 301. Subsequently, the control means causes the developing roller 201 or 301 to start forming an image.

FIG. 11B shows a case wherein the other of the image stations I and II forms a test patch image during the "n+1" turn of the belt 10. As shown, after the formation range assigned to the upstream developing roller 101 or 401, the control means switches the developing function from the developing roller 101 or 401 to the downstream developing roller 201 or 301. The control means then causes the developing roller 201 or 301 to form a test patch image in the respective color at any point in the range of (L1+L2)/2. Subsequently, the control means causes the developing roller 201 or 301 to start forming an image.

With the above procedure, the illustrative embodiment also prevents test patch images of different colors from overlapping each other. This reduces the number of sensors for sensing the densities of test patch images or enhances accurate image quality compensation control and thereby reduces the size and cost of the apparatus or surely prevents image quality from falling.

The fifth and sixth embodiment each may switch the developing function at any other suitable timing so long as test patch images formed at the image stations I and II do not overlap each other. In the third to sixth embodiments, two sensors 71 and 72 may be arranged to face the drums or two sensors 72 may be arranged to face the belt 10 while being spaced in the main scanning direction. In such a case, the control means may cause the sensors to sense the densities of test patch images of different colors once for two turns of the belt 10, i.e., for one time of image transfer to a paper sheet.

Seventh Embodiment

Figure 12A:
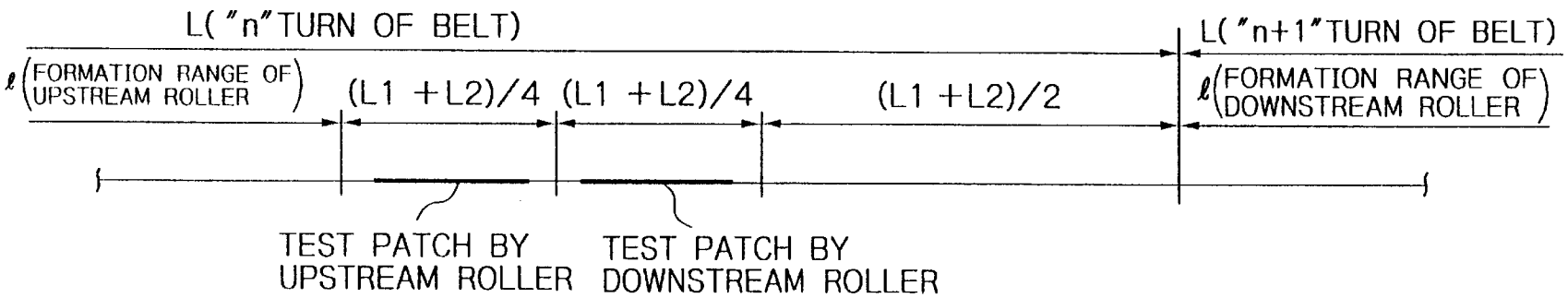
FIGS. 12A and 12B are timing charts for describing a seventh embodiment of the present invention.
Figure 12B:
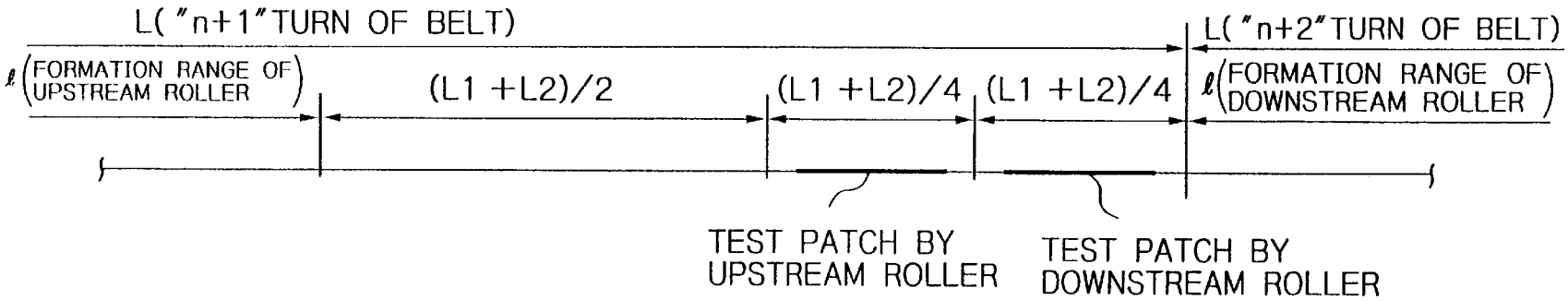

As shown in FIGS. 12A and 12B, in the second embodiment, a seventh embodiment selects the length L of the belt 10 that is l+L1+L2 and the length L1 that is smaller than or equal to L2. In this case, a range of L1+L2 in which an image can be formed is available from the formation range assigned to the upstream developing roller 101 or 401 to the formation range assigned to the downstream developing roller 201 or 301.

The control means selects a test patch range p smaller than or equal to (L1+L2)/4 and prevents test patch images formed at the image stations I and II from overlapping each other on the belt 10. This implements image quality compensation control during image formation with the minimum necessary length of the belt 10 for image formation. Moreover, the sensor 73 should only sense the densities of the test patch images once for two turns of the belt 10, i.e., for one time of image transfer to a paper sheet.

Specifically, FIG. 12A shows a case wherein one of the image stations I and II forms a test patch image during the "n" turn of the belt 10. As shown, after the formation range assigned to the upstream developing roller 101 or 401, the control means causes the developing roller 101 or 401 to form a test patch image in the respective color at any point in the range of (L1+L2)/4. The control means then switches the developing function from the upstream developing roller 101 or 401 to the downstream developing roller 201 or 301. Subsequently, the control means causes the developing roller 201 or 301 to form a test patch image in the respective color at any point in the range of (L1+L2)/4 and the start forming an image.

FIG. 12B shows a case wherein the other of the image stations I and II forms a test patch image during the "n+1" turn of the belt 10. As shown, after the formation range assigned to the upstream developing roller 101 or 401, the control means causes the developing roller 101 or 401 to form a test patch image at any point in the range of (L1+L2)/4 following a non-image portion, which extends over (L1+L2)/2. The control means then switches the developing function from the developing roller 101 or 401 to the downstream developing roller 201 or 301. Subsequently, the control means causes the developing roller 201 or 301 to form a test patch image in the respective color at any point in the range of (L1+L2)/4 and then start forming an image.

With the above procedure, the illustrative embodiment also prevents test patch images of different colors from overlapping each other. This reduces the number of sensors for sensing the densities of test patch images or enhances accurate image quality compensation control and thereby reduces the size and cost of the apparatus or surely prevents image quality from falling.

Eighth Embodiment

Figure 13A:
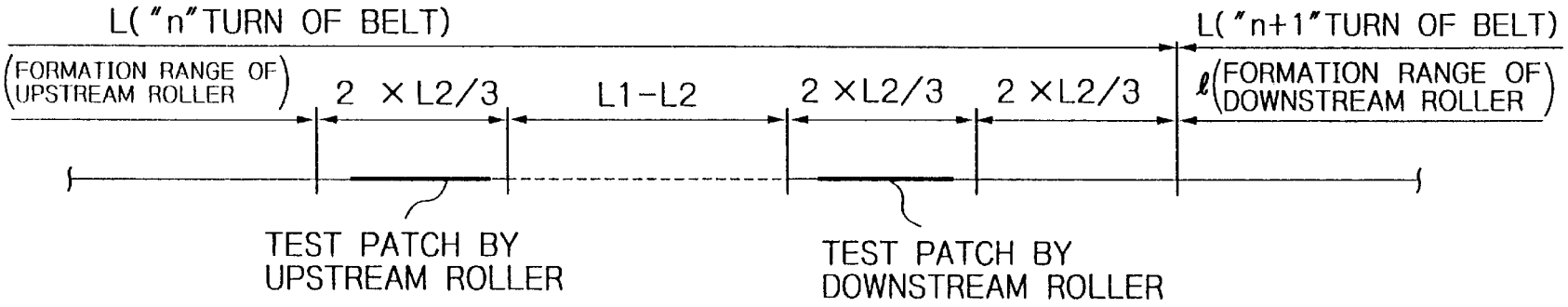
FIGS. 13A and 13B are timing charts for describing an eighth embodiment of the present invention.
Figure 13B:
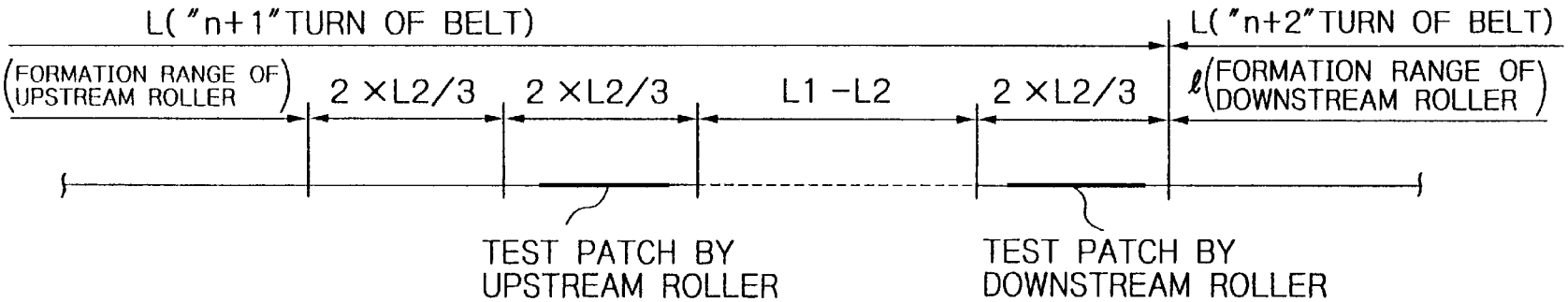

As shown in FIGS. 13A and 13B, in the second embodiment, an eighth embodiment selects the length L of the belt 10 that is l+L1+L2 and the length L1 that is greater than or equal to L2. In this case, a range of 2 ×L2 in which an image can be formed is available from the formation range assigned to the upstream developing roller 101 or 401 to the formation range assigned to the downstream developing roller 201 or 301.

In the case of L1−L2≧(L1+L2)/4, the control means selects a test patch image range p smaller than or equal to (L1+L2)/3 and prevents test patch images formed at the image stations I and II from overlapping each other on the belt 10. This implements image quality compensation control during image formation with the minimum necessary length of the belt 10 for image formation. Moreover, the sensor 73 should only sense the densities of the test patch images once for two turns of the belt 10, i.e., for one time of image transfer to a paper sheet.

Specifically, FIG. 13A shows a case wherein one of the image stations I and II forms a test patch image during the "n" turn of the belt 10. As shown, after the formation range assigned to the upstream developing roller 101 or 401, the control means causes the developing roller 101 or 401 to form a test patch image in the respective color at any point in the range of 2×L2/3. The control means then switches the developing function from the upstream developing roller 101 or 401 to the downstream developing roller 201 or 301. Subsequently, the control means causes the developing roller 201 or 301 to form a test patch image in the respective color at any point in the range of 2×L2/3. After a non-image portion extending over 2×L2/3, the control means causes the developing roller 201 or 203 to start forming an image.

FIG. 13B shows a case wherein the other of the image stations I and II forms a test patch image during the "n+1" turn of the belt 10. As shown, after the formation range assigned to the upstream developing roller 101 or 401, the control means causes the developing roller 101 or 401 to form a test patch image at any point in the range of 2×L2/3 following a non-image portion, which extends over 2 ×L2/3. The control means then switches the developing function from the developing roller 101 or 401 to the downstream developing roller 201 or 301. Subsequently, the control means causes the developing roller 201 or 301 to form a test patch image in the respective color at any point in the range of 2×L2/3 and then start forming an image.

With the above procedure, the illustrative embodiment also prevents test patch images of different colors from overlapping each other. This reduces the number of sensors for sensing the densities of test patch images or enhances accurate image quality compensation control and thereby reduces the size and cost of the apparatus or surely prevents image quality from falling.

Ninth Embodiment

Figure 14A:
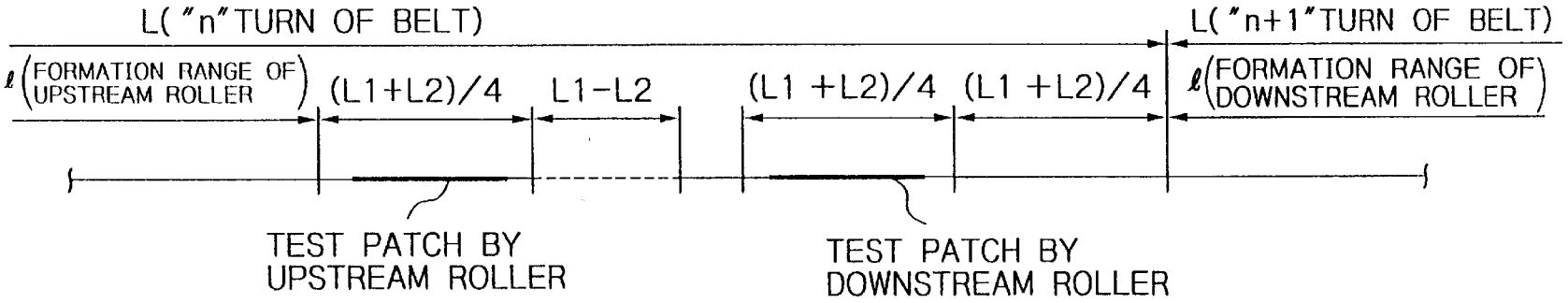
FIGS. 14A and 14B are timing charts for describing a ninth embodiment of the present invention.
Figure 14B:
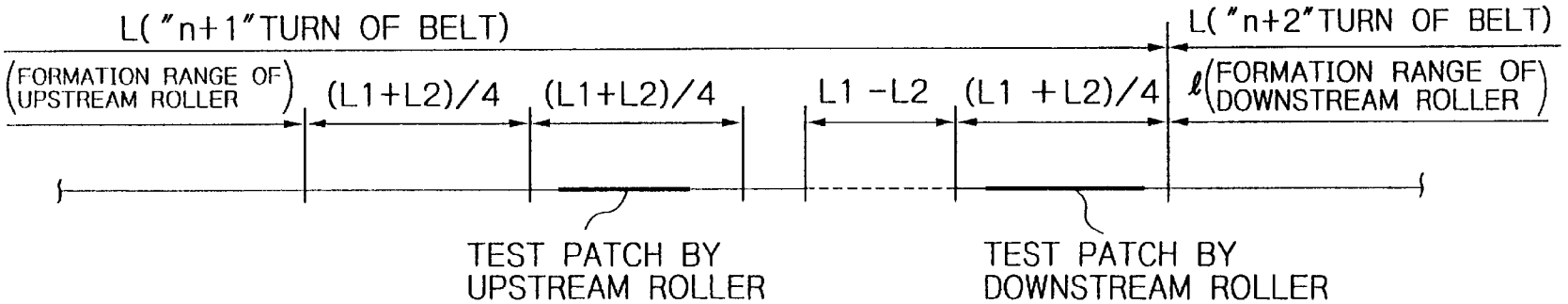

As shown in FIGS. 14A and 14B, in the second embodiment, a ninth embodiment selects the length L of the belt 10 that is l+L1+L2 and the length L1 that is greater than or equal to L2. In this case, a range of 2×L2 in which an image can be formed is available from the formation range assigned to the upstream developing roller 101 or 401 to the formation range assigned to the downstream developing roller 201 or 301.

In the case of L1−L2≦(L1+L2)/4, the control means selects a test patch image range p smaller than or equal to (L1+L2)/4 and prevents test patch images formed at the image stations I and II from overlapping each other on the belt 10. This implements image quality compensation control during image formation with the minimum necessary length of the belt 10 for image formation. Moreover, the sensor 73 should only sense the densities of the test patch images once for two turns of the belt 10, i.e., for one time of image transfer to a paper sheet.

Specifically, FIG. 14A shows a case wherein one of the image stations I and II forms a test patch image during the "n" turn of the belt 10. As shown, after the formation range assigned to the upstream developing roller 101 or 401, the control means causes the developing roller 101 or 401 to form a test patch image in the respective color at any point in the range of (L1+L2)/4. The control means then switches the developing function from the upstream developing roller 101 or 401 to the downstream developing roller 201 or 301. Subsequently, the control means causes the developing roller 201 or 301 to form a test patch image in the respective color at any point in the range of (L1+L2)/4. After a non-image portion extending over (L1+L2)/4, the control means causes the developing roller 201 or 203 to start forming an image.

FIG. 14B shows a case wherein the other of the image stations I and II forms a test patch image during the "n+1" turn of the belt 10. As shown, after the formation range assigned to the upstream developing roller 101 or 401, the control means causes the developing roller 101 or 401 to form a test patch image at any point in the range of (L1+L2)/4 following a non-image portion, which extends over (L1+L2)/4. The control means then switches the developing function from the developing roller 101 or 401 to the downstream developing roller 201 or 301. Subsequently, the control means causes the developing roller 201 or 301 to form a test patch image in the respective color at any point in the range of (L1+L2)/4 and then start forming an image.

With the above procedure, the illustrative embodiment also prevents test patch images of different colors from overlapping each other. This reduces the number of sensors for sensing the densities of test patch images or enhances accurate image quality compensation control and thereby reduces the size and cost of the apparatus or surely prevents image quality from falling.

The test patches shown in FIGS. 12A and 12B through 14A and 14B are only illustrative and may be formed at any other suitable timing so long as the test patches do not overlap each other on the belt 10.

Tenth Embodiment

This embodiment is identical with the first embodiment except for the following. As FIGS. 3A and 3B indicate, the prerequisite with the tenth embodiment is that the length L of the belt 10 be greater than or equal to l+L1+L2.

Figure 20A:
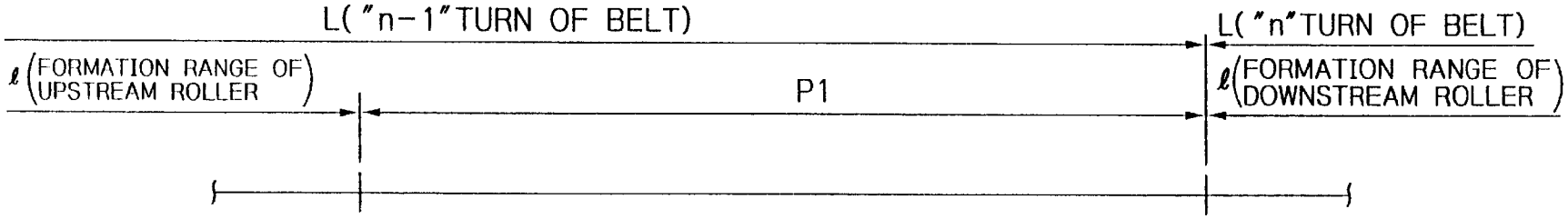
FIGS. 20A and 20B are timing charts for describing a tenth embodiment of the present invention in relation to the case of $L1 \leqq L2$.
Figure 20B:
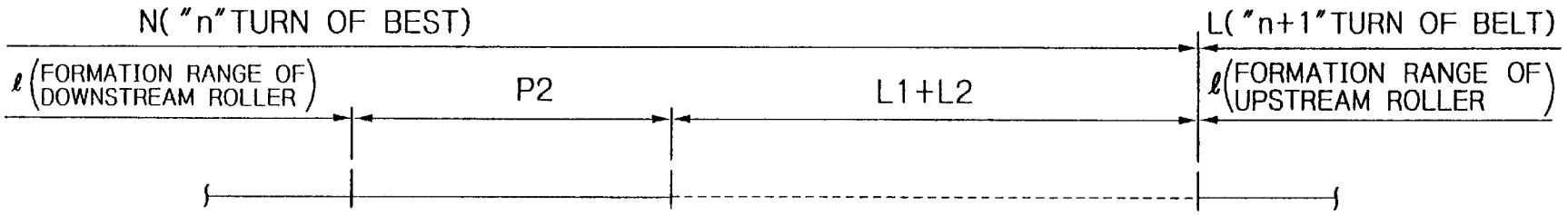
Figure 21A:
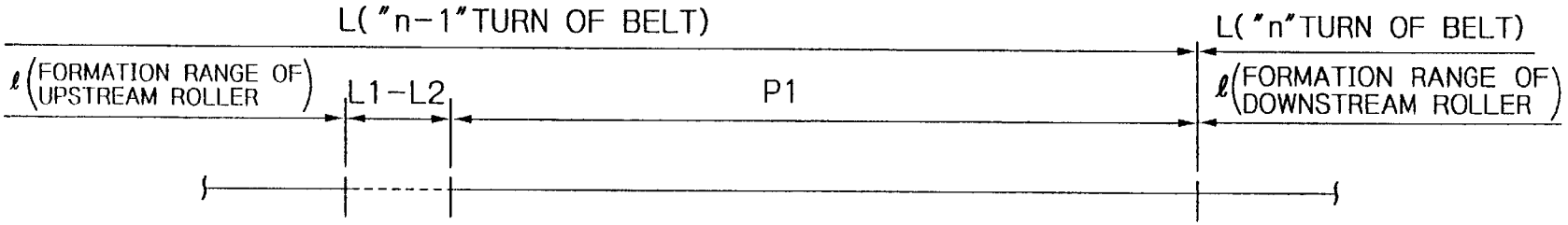
FIGS. 21A and 21B are timing charts for describing the tenth embodiment in relation to the case of $L1 \geqq L2$.
Figure 21B:
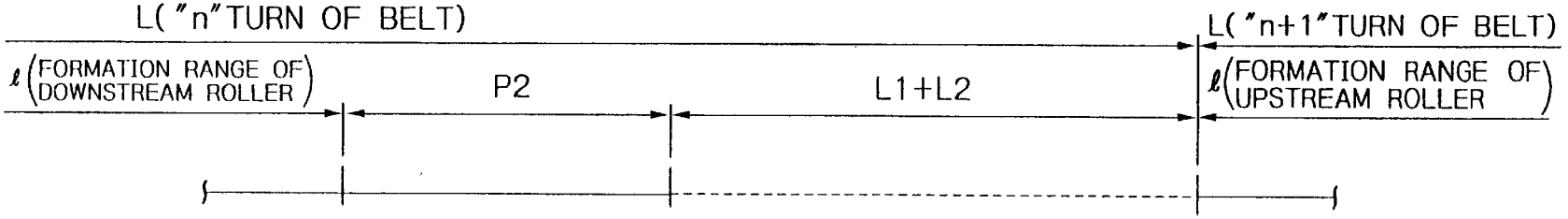

Assume that a maximum range of P1 is available for a test patch image from the formation range assigned to the upstream developing roller 101 or 401 to the formation range assigned to the downstream developing roller 201 or 301, respectively. Also, assume that a maximum range of P2 is available for a test patch image from the formation range assigned to the downstream developing roller 201 or 301 to the upstream developing roller 101 or 401. FIGS. 20A and 20B show the two ranges P1 and P2 derived from the relation of L1≦L2 while FIGS. 21A and 21B show the ranges P1 and P2 derived from the relation of L1≧L2.

As shown in FIG. 20A, in the condition of L1≦L2, the maximum range P available for a test patch image is L−l while the maximum range P2 is L−(l+L1+L2). Therefore, in the condition of L1≦L2, the illustrative embodiment selects P1−P2=L1+L2 in order to use the length L of the belt 10 most effectively for the formation of test patch images.

More specifically, in the condition of L1≦L2, the control means causes the charger 17 or 27 and associated writing means 18 or 28 to form a test patch latent image on the drum 16 or 26, respectively, at any point in the range P1. This is effected after the formation range assigned to the upstream developing roller 101 or 401, but before the formation range assigned to the downstream developing roller 201 or 301. The control means then causes the downstream developing roller 201 or 301 to develop the respective test patch latent image. Further, the control means causes the charger 17 or 27 and associated writing means 18 or 28 to form a test patch latent image on the drum 16 or 26, respectively, at any point in the range P2. This is effected after image formation by the downstream developing roller 201 or 301. The control means then causes the downstream developing rollers 201 and 301 to develop the test patch latent image. Subsequently, the control means switches the developing function from the downstream developing roller 201 or 301 to the upstream developing roller 101 or 401 and causes it to start forming an image.

As shown in FIG. 20A, in the condition of L1≧L2, the maximum range P1 available for a test patch image is L−(l+L1−L2) On the other hand, as shown in FIG. 5B, the maximum range P2 is L−(l+L1+L2). Therefore, in the condition of L1≧L2, the illustrative embodiment selects P1−P2=2×L2 in order to use the length L of the belt 10 most effectively for the formation of test patch images.

More specifically, in the condition of L1 L2, the control means switches the developing function from the upstream developing roller 101 or 401 from the downstream developing roller 201 or 301 after the formation range assigned to the developing roller 101 or 401. The control means then causes the downstream developing roller 201 or 301 to develop a test patch latent image formed on the drum 16 or 26 at any point in the range of P1. Thereafter, the control means causes the downstream developing roller 201 or 301 (charger 17 or 27 and writing means 18 or 28) to start forming an image. Further, after the image formation by the downstream developing roller 201 or 301, the control means causes the charger 17 or 27 and associated writing means 18 or 28 to form a test patch latent image on the drum 16 or 26, respectively, at any point in the range P2. The control means then causes the downstream developing rollers 201 and 301 to develop the test patch latent image. Subsequently, the control means switches the developing function from the downstream developing roller 201 or 301 to the upstream developing roller 101 or 401 and causes it to start forming an image.

As stated above, in the illustrative embodiment, the densities of test patch images respectively formed on the drum 16 or 26 are sensed in order to effect image quality compensation control. Further the range P1 is selected to be greater than the range P2. It follows that image quality compensation control can be effected during image formation by effectively using the length of the belt 10, promoting high-speed image formation and small-size configuration. The relations of L1≦L2 and P1−P2=L1+L2 particular to the illustrative embodiment further enhance high-speed image formation and small-size configuration. This is also achievable with the relations of L1≧L2 and P1−P2=2×L2.

Eleventh Embodiment

Figure 22A:
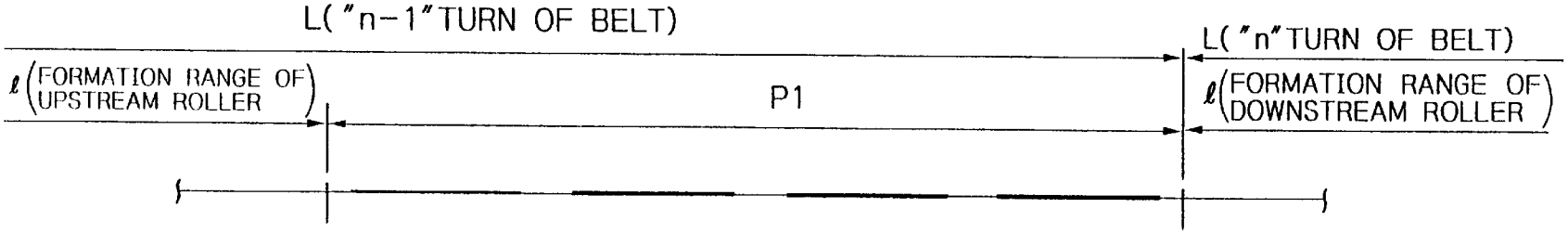
FIGS. 22A and 22B are timing charts for describing an eleventh embodiment of the present invention in relation to the case of $L1 \leqq L2$.
Figure 22B:
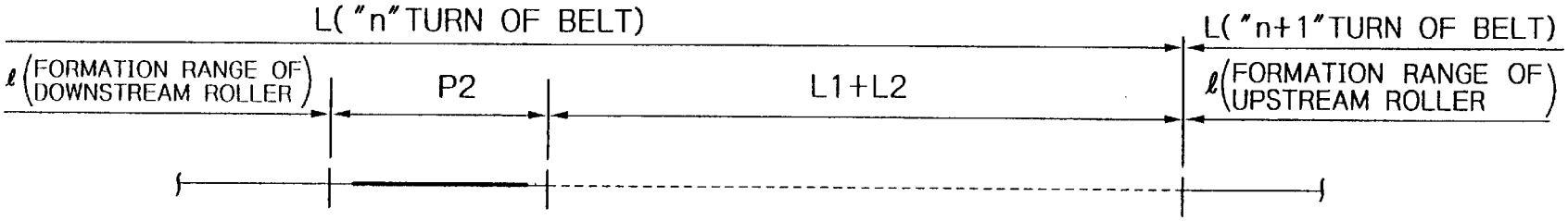

This embodiment is identical with the tenth embodiment except for the following. The range P1 available for a test patch image with respect to the length L of the belt 10 is greater than the range P2 also available for a test patch image. Therefore, for a given length of a test patch image in the direction of movement of the belt 10, a plurality of test patch images can be formed in the range P1. FIGS. 22A and 22B show the ranges P1 and P2 derived from the relation of L1≦L2 in the illustrative embodiment while FIGS. 22A and 22B show the ranges P1 and P2 derived from the relation of L1≧L2. The condition shown in FIGS. 22A and 22B pertain to a relation of L1+L2≧3×P2; the range P1 can accommodate four test patch images that extend over the entire range P2 each.

In the condition of L1≦L2, after the formation range assigned to the upstream developing roller 101 or 401, but before the formation assigned to the downstream developing roller 201 or 301, the control means causes the charger 17 or 27 and writing means 18 or 28 to sequentially form a plurality of test patch images, e.g., four test patch images at any point in the range P1. For this purpose, the control means varies a charge bias, a development bias, an amount of exposure and other process conditions or image forming conditions patch by patch. The downstream developing rollers 201 or 301 develop the four test patch images in the respective color. Also, after image formation by the downstream developing rollers 201 or 301, the control means causes the charger 17 or 27 and writing means 18 or 28 to form a single test patch image at any point in the range P2 and causes the developing roller 201 or 301 to develop it. Subsequently, the control means switches the developing function from the lower developing roller 201 or 301 to the upstream developing roller 101 or 401 and causes it to start forming an image.

Figure 23A:
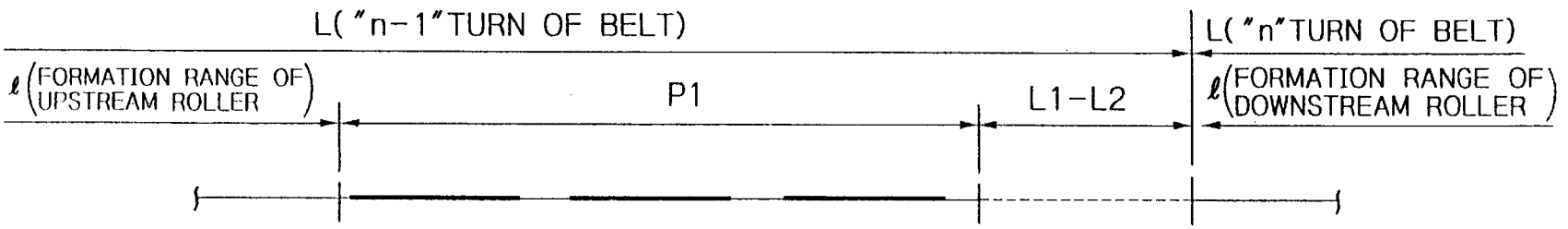
FIGS. 23A and 23B are timing charts for describing the eleventh embodiment in relation to the case of $L1 \geqq L2$.
Figure 23B:
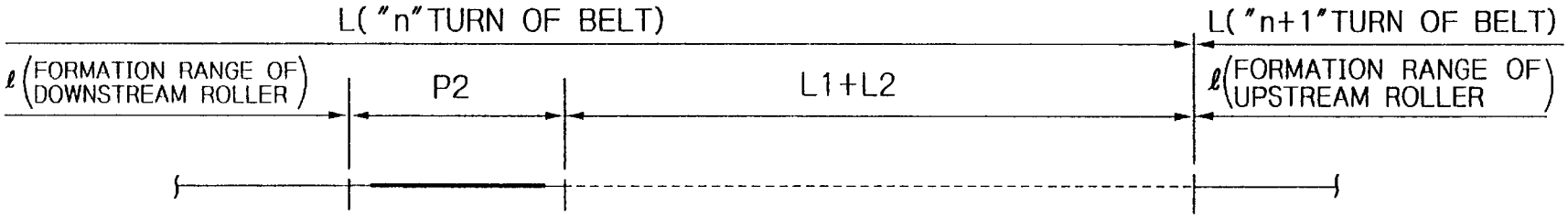

The condition shown in FIGS. 23A and 23B pertains to relations of L1+L2≧3×P2 and L1−L2≦P2; the range P1 can accommodate three test patch images that extend over the entire range P2 each.

In the condition of L1 L2, after the formation range assigned to the upstream developing roller 101 or 401, the control means causes the charger 17 or 27 and writing means 18 or 28 to sequentially form a plurality of test patch images, e.g., three test patch images at any point in the range P1. For this purpose, the control means varies a charge bias, a development bias, an amount of exposure and other process conditions or image forming conditions patch by patch. The upstream developing rollers 101 or 401 develop the three test patch images in the respective color. The control means then switches the developing function from the upstream developing roller 101 or 401 to the downstream developing roller 201 or 301 and causes it to start forming an image. Also, after image formation by the downstream developing rollers 201 or 301, the control means causes the charger 17 or 27 and writing means 18 or 28 to form a single test patch image at any point in the range P2 and causes the developing roller 201 or 301 to develop it. Subsequently, the control means switches the developing function from the lower developing roller 201 or 301 to the upstream developing roller 101 or 401 and causes it to start forming an image.

As stated above, the illustrative embodiment allows a plurality of test patch images to be formed in the range P1 by varying the process conditions or image forming conditions. By sensing the densities of such test patch images, it is possible to execute more accurate image quality compensation control. Of course, the number of test patch images that can be formed in the range P1 depends on the relation between P2, L1 and L2 and is not limited to the above numbers.

Twelfth Embodiment

This embodiment is identical with the tenth embodiment except for the following. In the illustrative embodiment, a test patch image for image quality compensation control is formed once for a single turn of the belt 10 during image formation. Referring again to FIG. 7, when the sensors 71 and 72 respectively sense the densities of test patch images formed on the drums 16 and 26, the sensors 71 and 72 increase the cost of the apparatus. In addition, the sensors 71 and 72 that face the drums 16 and 26, respectively, obstruct the miniaturization of the image stations.

On the other hand, assume that a single sensor 73 senses the densities of test patch images formed on the belt 10. Then, the test patch images formed at the image stations I and II must be prevented from overlapping each other. It is therefore necessary to form test patches in the ranges P1 and P2 at each of the image stations I and II once for eight turns of the belt 10, i.e., for four times of image transfer to paper sheets. This is apt to obstruct accurate image quality compensation control. Assume that the test patch forming positions of the ranges P1 and P2 and those of the image stations I and II are shifted from each other in the main scanning direction, and that a plurality of sensors 73 are arranged in the main scanning direction. This kind of configuration also increases the cost of the apparatus.

On the other hand, assume that the formation of a test patch by one image station and that of the formation of a test patch by the other image station are effected alternately every time the belt 10 makes one turn. Then, if the belt cleaner 61 is ON/OFF controlled in such a manner as to clean only the test patch portion of the belt 10 after the sensor 73 has sensed the density of the test patch image, then the frequency of test patch formation can be reduced to once for four turns of the belt 10, i.e., two times of image transfer to paper sheets. This, however, needs sophisticated, highly accurate control over the belt cleaner 61 and also increases the cost, as stated earlier.

Figure 24A:
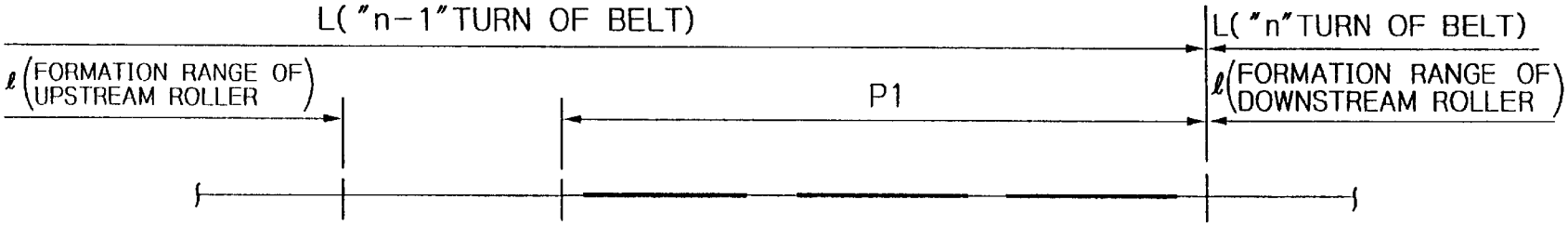
FIGS. 24A and 24B are timing charts for describing a twelfth embodiment of the present invention in relation to the case of $L1 \leqq L2$.
Figure 24B:
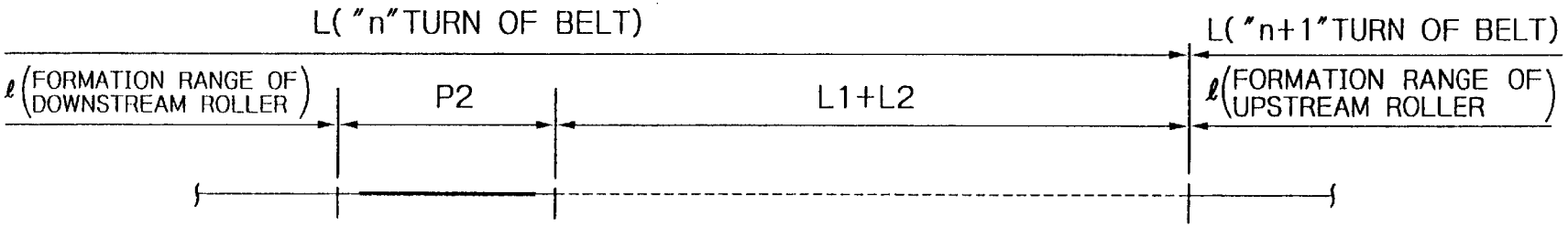
Figure 25A:
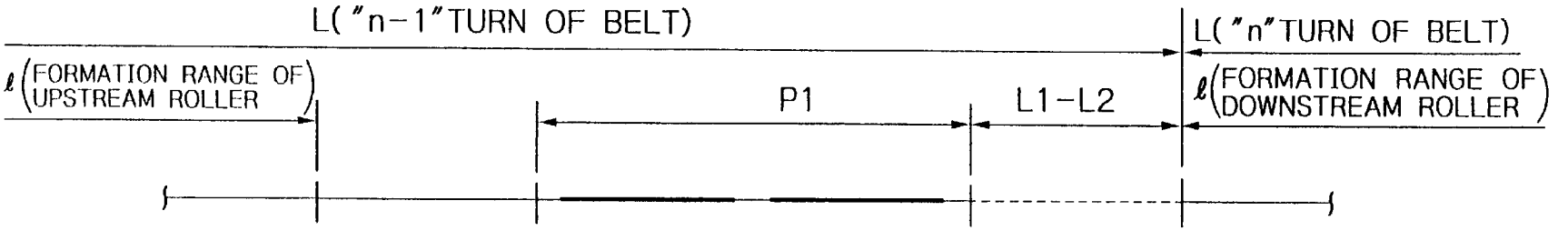
FIGS. 25A and 25B are timing charts for describing the twelfth embodiment in relation to the case of $L1 \geqq L2$.
Figure 25B:
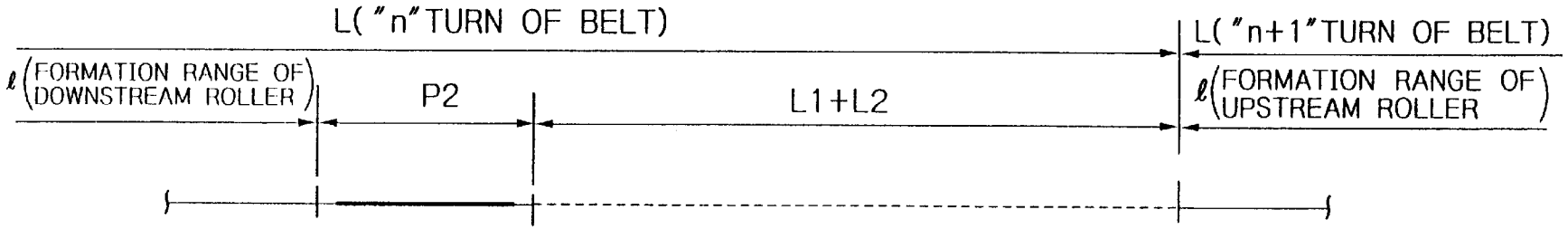
Figure 26A:
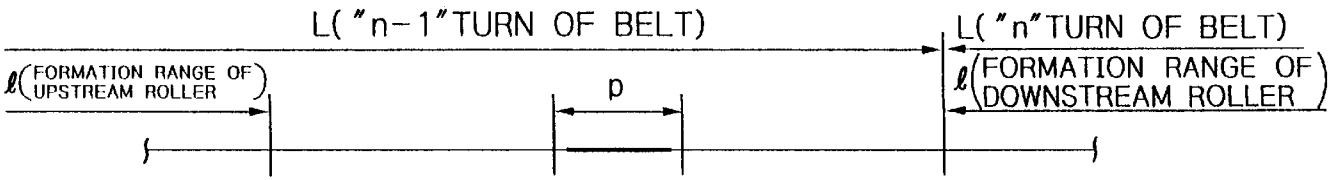
FIGS. 26A through 26D are timing charts for describing the twelfth embodiment in relation to a case of $L1<$and $L2$ and $L1+L2>P2$.
Figure 26B:
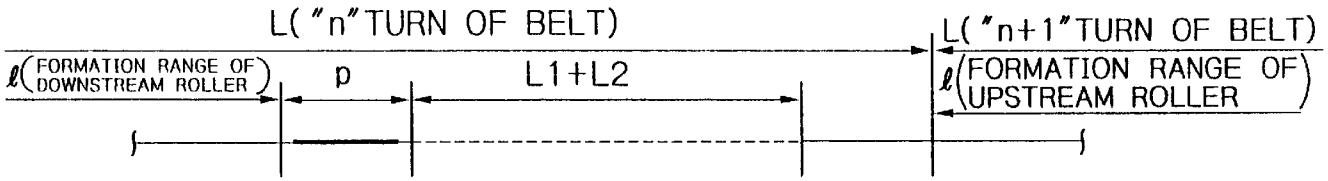
Figure 26C:
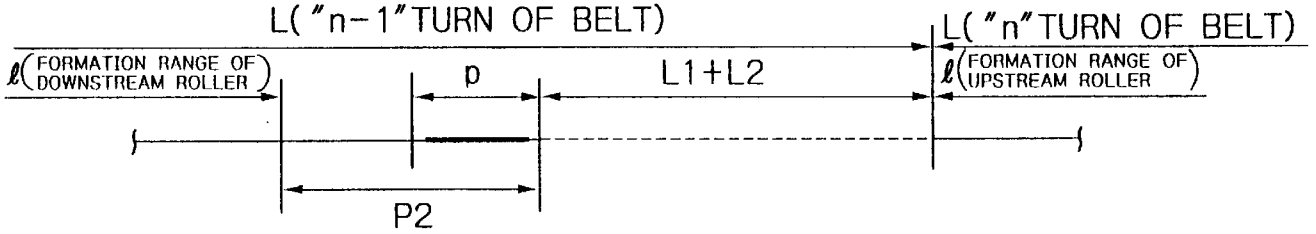
Figure 26D:
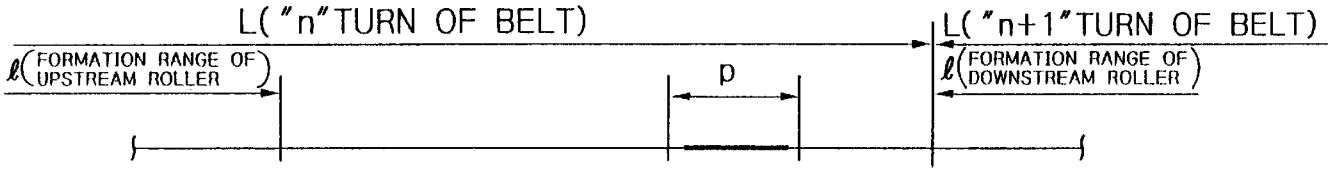
Figure 27A:
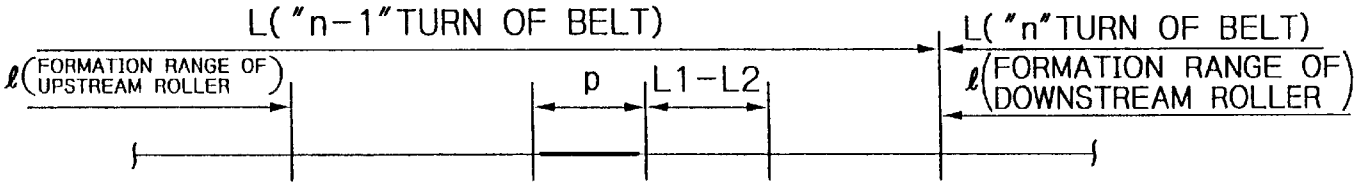
FIGS. 27A through 27D are timing charts for describing the twelfth embodiment in relation to a case of $L1>$and $L2$ and $L1+L2>P2+L1-L2$.
Figure 27B:
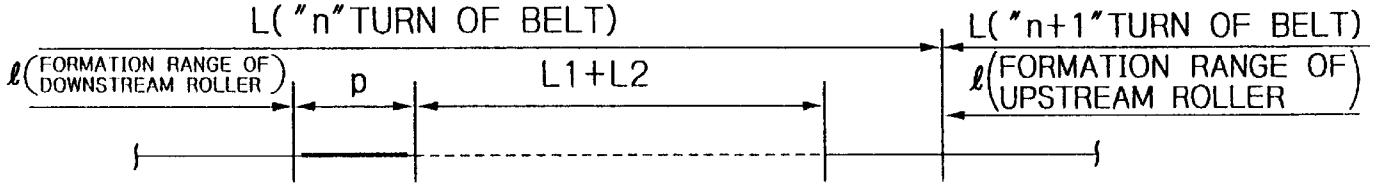
Figure 27C:
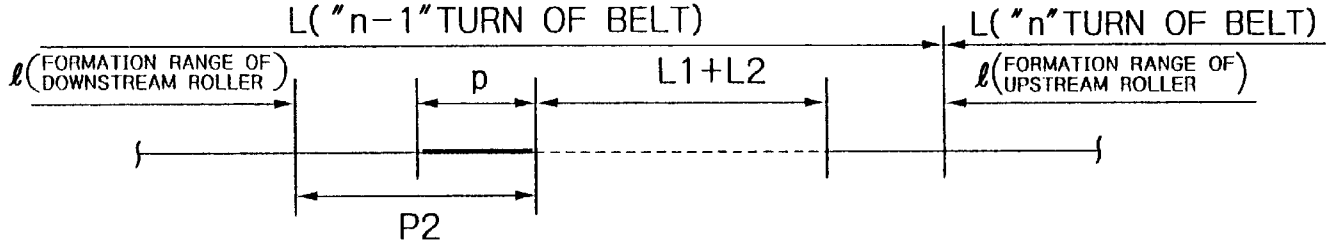
Figure 27D:
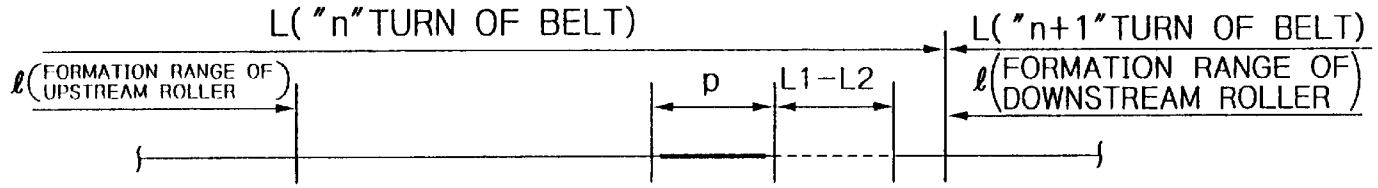

FIGS. 25A and 25B show the ranges P1 and P2 derived from the relation of L1≦L2 in the illustrative embodiment while FIGS. 26A and 26B show the ranges P1 and P2 derived from the relation of L1≧L2. As shown in FIGS. 24A and 24B, in the illustrative embodiment, P2=L−(1+L1+L2) holds. The illustrative embodiment therefore selects L1<L2 in order to prevent test patches formed in the ranges P1 and P2 from overlapping each other on the belt 10. This allows a single sensor 73 to sense the densities of the test patch images of different colors present on the belt 10 once for four turns of the belt 10, i.e., two times of image transfer to paper sheets.

In the condition of L1≦L2, after the formation range assigned to the upstream developing roller 101 or 401, but before the formation range assigned to the downstream developing roller 201 or 301, the control means causes the charger 17 or 27 and writing means 18 or 28 to sequentially form a plurality of test patch images, e.g., three test patch images at any point in the range P1. For this purpose, the control means varies a charge bias, a development bias, an amount of exposure and other process conditions or image forming conditions patch by patch. The downstream developing roller 201 or 301 develops the three test patch images in the respective color. Also, after image formation by the downstream developing rollers 201 or 301, the control means causes the charger 17 or 27 and writing means 18 or 28 to form a single test patch image at any point in the range P2 and causes the developing roller 201 or 301 to develop it. Subsequently, the control means switches the developing function from the lower developing roller 201 or 301 to the upstream developing roller 101 or 401 and causes it to start forming an image.

The condition shown in FIGS. 25A and 25B pertains to relations of P2=L−(l+L1+L2) and P1≦2×L2. In this case, by preventing the test patch images formed in the ranges P1 and P2 from overlapping each other on the belt 10, it is possible to allow a single sensor 73 to sense the image densities of the test patches of different colors on the belt 10 once for four turns of the belt 10, i.e., for two times of image transfer to paper sheets.

In the condition of L1>L2 after the formation range assigned to the upstream developing roller 101 or 401, the control means causes the charger 17 or 27 and writing means 18 or 28 to sequentially form a plurality of test patch images, e.g., two test patch images at any point in the range P1. For this purpose, the control means varies a charge bias, a development bias, an amount of exposure and other process conditions or image forming conditions patch by patch. The upstream developing roller 101 or 401 develops the two test patch images in the respective color. The control means then switches the developing function from the upstream developing roller 101 or 401 to the downstream developing roller 201 or 301 and causes it to start forming an image. Also, after image formation by the downstream developing rollers 201 or 301, the control means causes the charger 17 or 27 and writing means 18 or 28 to form a single test patch image at any point in the range P2 and causes the developing roller 201 or 301 to develop it. Subsequently, the control means switches the developing function from the lower developing roller 201 or 301 to the upstream developing roller 101 or 401 and causes it to start forming an image.

As stated above, in the illustrative embodiment, in the condition of $L1 \leqq L2$, the range P1 is smaller than or equal to L1+L2. In addition, the test patch image formed in the range P1 does not overlap with the test patch image formed in the range P2 on the belt 10. The illustrative embodiment therefore executes more accurate image quality compensation control.

In the condition of $L1 \geqq L2$, the range P1 is smaller than or equal to 2×L2. In addition, the test patch image formed in the range P1 does not overlap the test patch image formed in the range P2, so that the number of sensors is reduced to make the apparatus miniature and low cost.

Hereinafter will be studied a system that causes a single sensor 73 to sense the densities of the test patches of different colors once for two turns of the belt 10, i.e., for one time of image transfer to a paper sheet. The test patches to be described each are formed before color switching that follows the formation of an image.

FIGS. 26A through 26D show the case of L1<L2. As shown, to form a test patch image of a particular color in the range p following each formation range, it is necessary to satisfy a relation of $p \leqq (L-(l+L1+L2)/2$, so that test patch images formed by the developing rollers 101, 201, 301 and 401 do not overlap each other. More specifically, assume that the minimum length necessary for forming a test patch image is p. Then, if L1+L2 is greater than 2×p, i.e., if p is smaller than (L1+L2)/2, then the minimum necessary length L of the belt 10 is l+L1+L2+2×p. Assuming that L1+L2 is smaller than 2×p, i.e., p is greater than (L1+L2)/2, then the minimum necessary length L of the belt 10 is l+4×p.

FIGS. 27A through 27D show the case of L1>L2. As shown, to form a test patch image of a particular color in the range p following each formation range, it is necessary to satisfy a relation of $p \leqq (L-(l+L1+L2)/2$, so that test patch images formed by the developing rollers 101, 201, 301 and 401 do not overlap each other. More specifically, assume that the minimum length necessary for forming a test patch image is p. Then, if L1+L2 is greater than L1−L2+2×p, i.e., if p is smaller than L2, then the minimum necessary length L of the belt 10 is l+L1+L2+2×p. Assuming that L1+L2 is smaller than L1−L2+2×p, then the minimum necessary length L of the belt 10 is l+L1−L2+4×p.

Embodiments to be described hereinafter each form a plurality of test patch images in the range P1 for thereby effectively using the limited length of the belt 10.

Thirteenth Embodiment

This embodiment pertains to the relation of L1<L2 and is identical with the eleventh embodiment except for the following. FIGS. 28A through 28D show test patch ranges p particular to the illustrative embodiment.

Figures 28A, 28B, 28C, 28D:
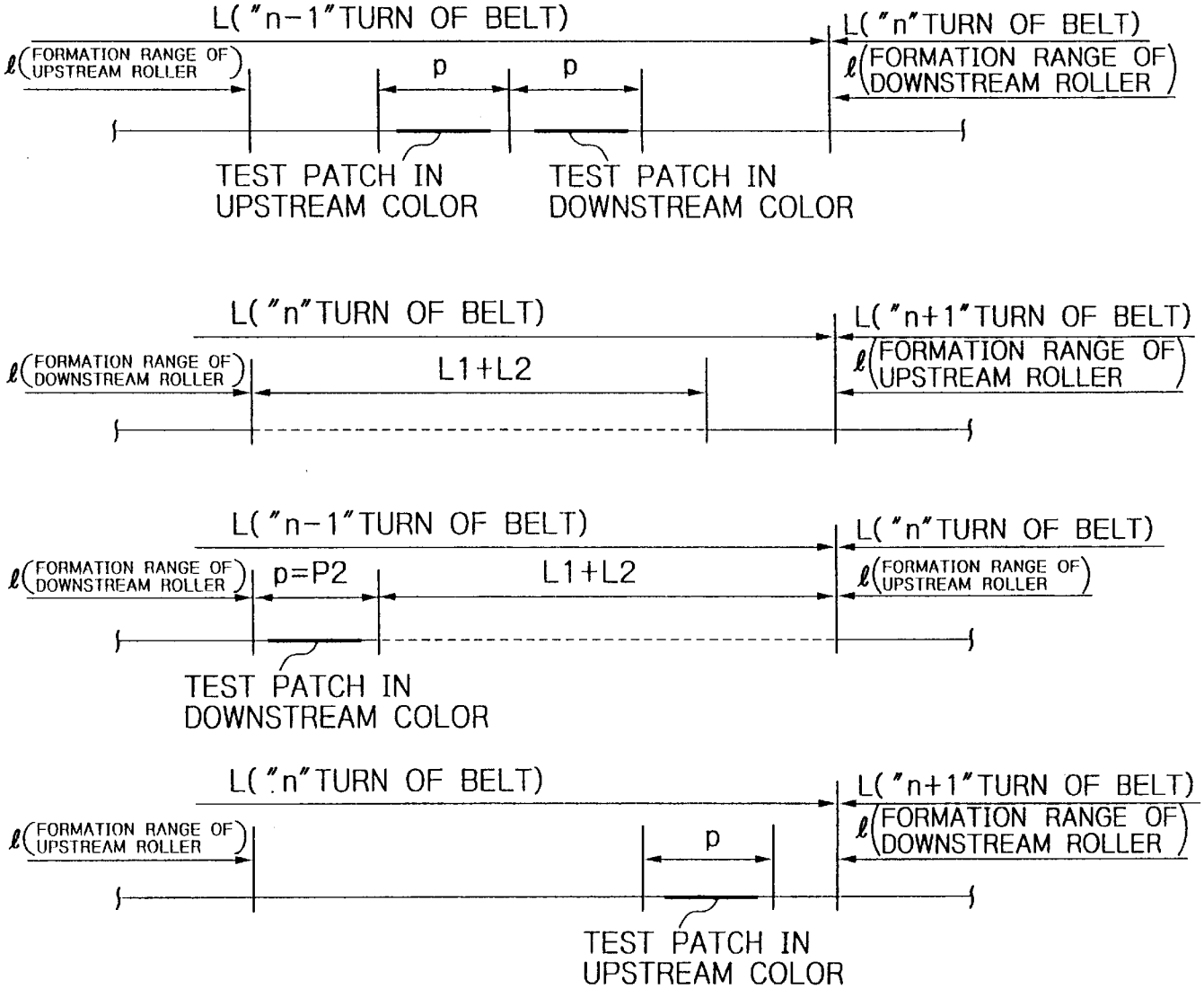
FIGS. 28A through 28D are timing charts for describing a thirteenth embodiment of the present invention.

As shown in FIG. 28A, during the "n−1" turn of the belt 10, the control means causes the upstream developing section of one of the image stations I and II to form a test patch image after the formation range assigned to the upstream developing roller. This test patch image is formed in the range P1 extending from the formation range assigned to the above upstream developing roller to the associated downstream developing roller. The control means then switches the developing function from the upstream developing section to the downstream developing section. Subsequently, the control means causes the downstream developing section to form a test patch image and then causes the downstream developing roller to start forming an image. That is, the plurality of test patch images included in the eleventh embodiment are implemented as an upstream and a downstream test patch image. As shown in FIG. 28B, during the "n" turn of the belt 10, a test patch image is not formed in the range following the formation range assigned to the downstream developing roller, but preceding the formation range assigned to the upstream developing roller.

As shown in FIG. 28C, during the "n−1" turn of the belt 10, the control means causes the downstream developing section of the other image station to form a test patch image after the formation range assigned to the downstream developing roller. This test patch image is formed in the range P2 extending from the formation range assigned to the above downstream developing roller to the formation range assigned to the associated upstream developing roller. The control means then switches the developing function from the downstream developing section to the upstream developing section. Subsequently, the control means causes the upstream developing section to start forming an image. As shown in FIG. 28D, during the "n" turn of the belt 10, the control means switches the developing function from the upstream developing section to the downstream developing section after the formation range assigned to the upstream developing roller. The control means then causes the downstream developing section to form a test patch image in the range P1 after the formation range assigned to the upstream developing roller. Thereafter, the control means causes the downstream developing roller to start forming an image.

When test patch images each having a length p in the direction of movement of the belt 10 in the respective colors, there should hold a relation of $p \leqq L-(l+L1+L2)$, so that the test patch images developed by the developing rollers 101, 201, 301 and 401 do not overlap each other. Assume that the minimum necessary length for forming a test patch image is p. Then, in the case of L1+L2>3×p, i.e., p<(L1+L2)/3, the minimum necessary length L of the belt 10 is 1+L1+L2+p. On the other hand, in the case of L1+L2<3×p, i.e., p>(L1+L2)/3, the minimum necessary length L of the belt 10 is 1+4×p. By comparing the illustrative embodiment with the embodiment described with reference to FIG. 26, it will be seen that the illustrative embodiment reduces the minimum necessary length L by p in the range of $p<(L1+L2)/3$ or by $L1+L2$ p ×2 in the range of $(L1+L2)/3 <p<(L1+L2)/2$.

Fourteenth Embodiment

This embodiment pertains to the relation of $L1>L2$ and is identical with the eleventh embodiment except for the following. FIGS. 29A through 29D show test patch image ranges p particular to the illustrative embodiment.

Figure 29A:
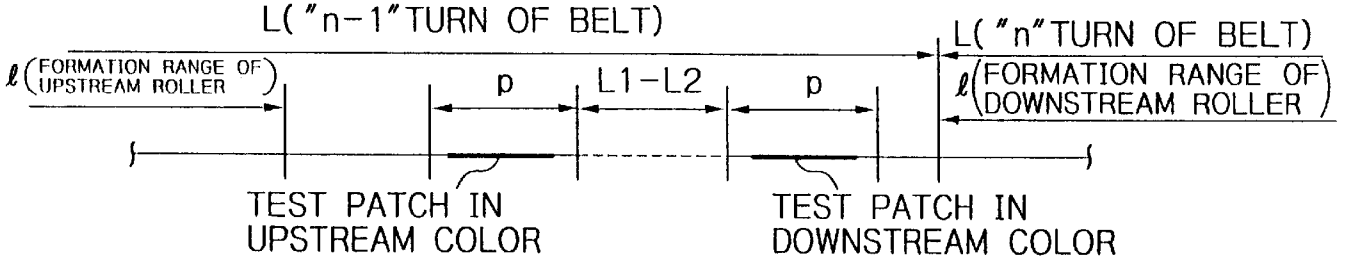
FIGS. 29A through 29D are timing charts for describing a fourteenth embodiment of the present invention.
Figure 29B:
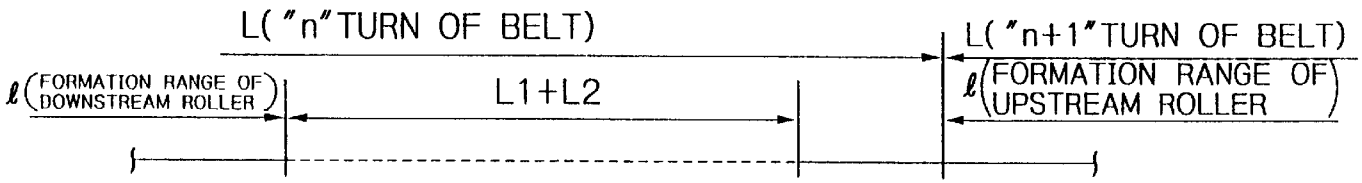

As shown in FIG. 29A, during the "n−1" turn of the belt 10, the control means causes the upstream developing section of one of the image stations I and II to form a test patch image. Specifically, after the formation range assigned to the upstream developing roller, the control means causes the upstream developing roller to form a test patch image in the range P1 extending from the formation range assigned to the upstream developing roller to the formation range assigned to the downstream developing roller. The control means then switches the developing function from the upstream developing section to the downstream developing section. Subsequently, the control means causes the downstream developing section to form a test patch image and then causes the downstream developing roller to start forming an image. That is, the plurality of test patch images included in the eleventh embodiment are implemented as an upstream and a downstream test patch image. As shown in FIG. 29B, during the "n" turn of the belt 10, a test patch image is not formed in the range following the formation range assigned to the downstream developing roller, but preceding the formation range assigned to the upstream developing roller.

Figure 29C:
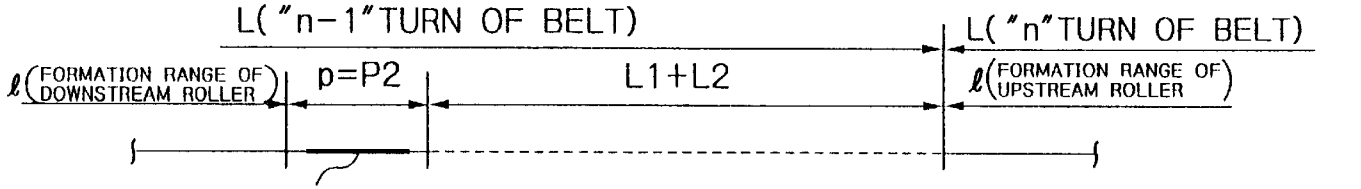
Figure 29D:
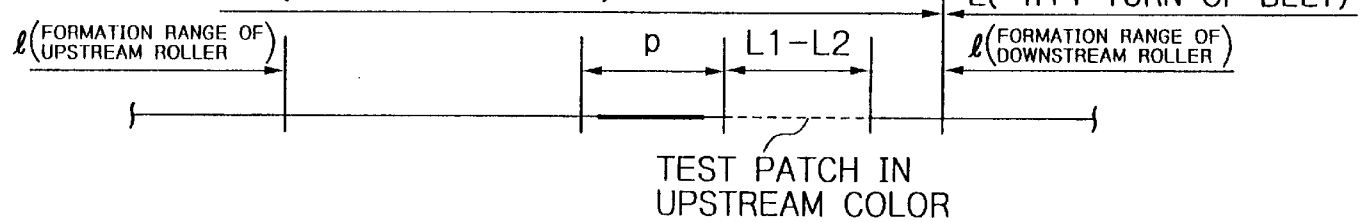

As shown in FIG. 29C, during the "n−1" turn of the belt 10, the control means causes the downstream developing section of the other image station to form a test patch image after the formation range assigned to the downstream developing roller. This test patch image is formed in the range P2 extending from the formation range assigned to the above downstream developing roller to the formation range assigned to the associated upstream developing roller. The control means then switches the developing function from the downstream developing section to the upstream developing section. Subsequently, the control means causes the upstream developing section to start forming an image. As shown in FIG. 29D, during the "n" turn of the belt 10, the control means causes, after the formation range assigned to the upstream developing roller, the upstream developing roller to form a test patch image in the range P1. Subsequently, the control means switches the developing function from the upstream developing section to the downstream developing section and causes the downstream developing roller to start forming an image.

When test patch images each having a length p in the direction of movement of the belt 10 in the respective colors, there should hold a relation of $p \leqq L-(l+L1+L2)$, so that the test patch images developed by the developing rollers 101, 201, 301 and 401 do not overlap each other. Assume that the minimum necessary length for forming a test patch image is p. Then, in the case of $L1+L2>L1-L2+2\times p$, i.e., $p<L2$, the minimum necessary length L of the belt 10 is $l+L1+L2+p$. On the other hand, in the case of $L1+L2<L1-L2+2\times p$, i.e., $p>L2$, the minimum necessary length L of the belt 10 is $l+L1-L2+3\times p$. By comparing the illustrative embodiment with the embodiment described with reference to FIG. 27, it will be seen that the illustrative embodiment reduces the minimum necessary length L by p.

On the other hand, assume the relation of $p<L1-2$. Then, when $L1+L2>3\times p$, i.e., $p<(L1+L2)/3$ holds, the minimum necessary length L of the belt 10 is $l+L1+L2+p$. Also, when $L1+L2<3\times p$, i.e., $p>(L1+L2)/3$ holds, the minimum necessary length L is $l+4\times p$. By comparing the illustrative embodiment with the embodiment described with reference to FIGS. 27A through 27D, it will be seen that the illustrative embodiment reduces, in the case of $L2<(L1+L2)/3$, the minimum necessary length L by p in the range of $P<L2$, by $-2\times L2+3\times p$ in the range of $L2<p<(L1+L2)/3$, or by $L1-L2$ in the range of $p>(L1+L2)/3$. Further, in the case of $(L1+L2)/3<L2$, the illustrative embodiment reduces the minimum necessary length L by p in the range of $p<(L1+L2)/3$, by $L1+L2-2\times p$ in the range of $(L1+L2)/3<p<L2$, or by $L1-L2$ in the range of $p>L2$.

In each of the thirteenth and fourteenth embodiments shown and described, an upstream test patch image and a downstream test patch image are formed in the range P1. The upstream test patch image follows the formation range assigned to the upstream developing roller. The downstream test patch image precedes the formation range assigned to the downstream developing roller and is formed after the switching of the developing function. The embodiments therefore miniaturize the belt 10 and therefore the entire apparatus while reducing the cost.

Fifteenth Embodiment

This embodiment pertains to the relation of $L1<L2$ and is identical with the thirteenth embodiment except for the following. FIGS. 30A through 30D show test patch image ranges p particular to the illustrative embodiment.

As shown in FIGS. 30A through 30D, after the formation range assigned to the upstream developing roller 101 or 401, the developing roller 101 or 401 forms a test patch image in the test patch image range P1 extending from the above formation range to the formation range assigned to the downstream developing roller 201 or 301, respectively. The developing function is then switched from the upstream developing roller 101 or 401 to the downstream developing roller 201 or 301, respectively. The downstream developing roller 201 or 301 forms a test patch image and then starts forming an image. That is, the plurality of test patch images in the eleventh embodiment are implemented as an upstream test patch image and a downstream test patch image. Also, the range P2 is selected to be zero.

Figure 30A:
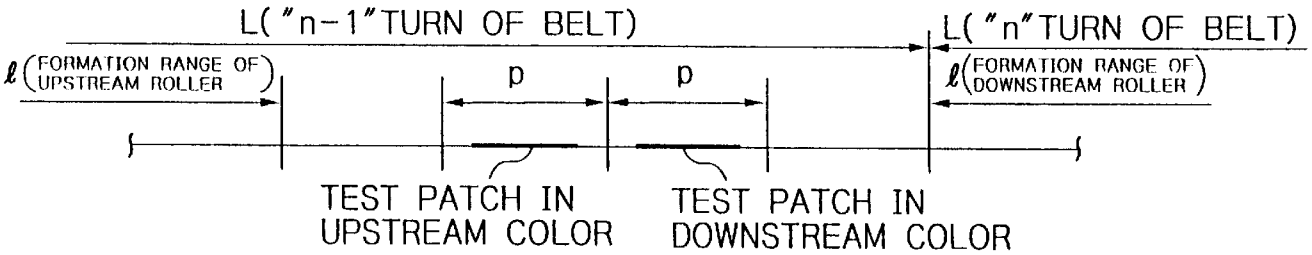
FIGS. 30A through 30D are timing charts for describing a fifteenth embodiment of the present invention.
Figure 30B:
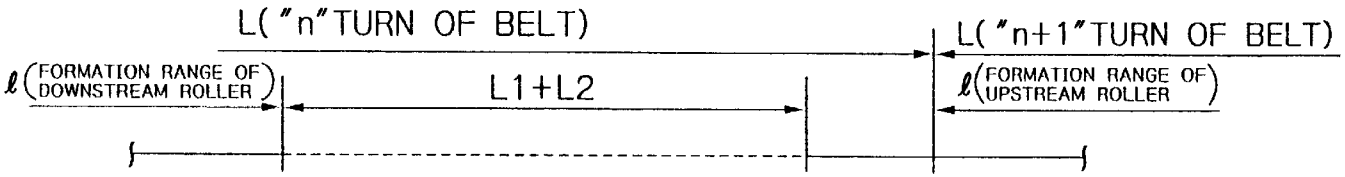

For example, as shown in FIG. 30A, during "n−1" turn of the belt 10, the control means causes the upstream developing roller of one of the image stations I and II to form a test patch image after the formation range assigned to the upstream developing roller. This test patch image is formed in the range P1 extending from the formation range assigned to the upper developing roller to the formation range assigned to the associated downstream developing roller. The control means then switches the developing function from the upper developing roller to the downstream developing roller. Subsequently, the control means causes the downstream developing roller to form a test patch image and then start forming an image. As shown in FIG. 30B, during the "n" turn of the belt 10, a test patch image is not formed in the range following the formation range assigned to the downstream developing roller, but preceding the formation range assigned to the upstream developing roller.

Figure 30C:
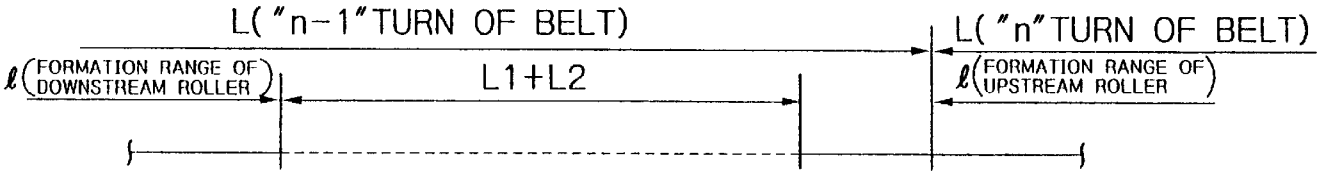
Figure 30D:
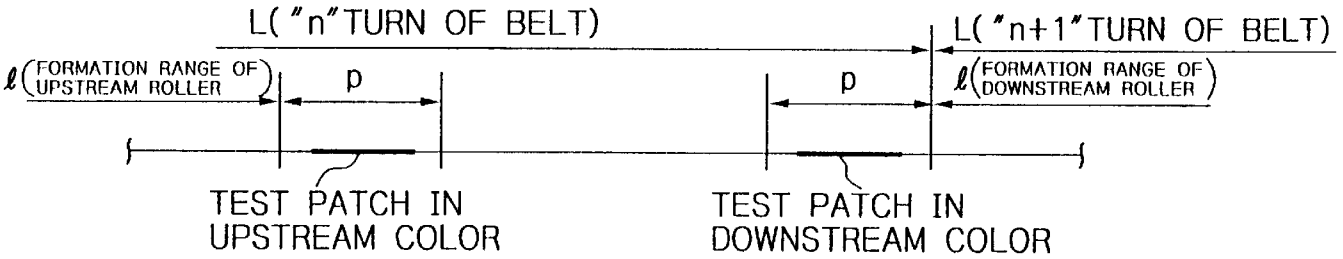

As shown in FIG. 30C, during the "n−1" turn of the belt 10, the control means prevents the other image station from forming a test patch image over the range following the formation range assigned to the downstream developing roller, but preceding the upstream developing roller. As shown in FIG. 30D, during the "n" turn of the belt 10, the control means causes the upstream developing roller to form a test patch image in the range P1, which follows the formation range assigned to the upstream developing roller. The control means then switches the developing function from the upstream developing roller to the downstream developing roller. Subsequently, the control means causes the downstream developing roller to form a test patch image in the range P and then causes it to start forming an image.

When test patch images each having a length p in the direction of turn of the belt 10 in the respective colors, there should hold a relation of $p \leqq (L-1)/4$, so that the test patch images developed by the developing rollers 101, 201, 301 and 401 do not overlap each other. Assume that the minimum necessary length for forming a test patch image is p. Then, in the case of $L1+L2<4\times p$, i.e., $p<(L1+L2)/4$, the minimum necessary length L of the belt 10 is $l+4\times p$. On the other hand, in the case of $L1+L2>4\times p$, i.e., $p>(L1+L2)/4$, the minimum necessary length L of the belt 10 is $l+L1+L2$. By comparing the illustrative embodiment with the thirteenth embodiment, it will be seen that the illustrative embodiment reduces the minimum necessary length L by p in the range of $p<(L1+L2)/4$ or by $L1+L2-3\times p$ in the range of $(L1+L2)/4<p<(L1+L2)/3$.

Sixteenth Embodiment

This embodiment pertains to the relation of $L1>L2$ and is identical with the fourteenth embodiment except for the following. FIGS. 31A through 31D show test patch image ranges p particular to the illustrative embodiment.

As shown in FIGS. 31A through 31D, after the formation range assigned to the upstream developing roller 101 or 401, the developing roller 101 or 401 forms a test patch image in the test patch image range P1 extending from the above formation range to the formation range assigned to the downstream developing roller 201 or 301, respectively. The developing function is then switched from the upstream developing roller 101 or 401 to the downstream developing roller 201 or 301, respectively. The downstream developing roller 201 or 301 then forms a test patch image and then starts forming an image. That is, the plurality of test patch images in the eleventh embodiment are implemented as an upstream test patch image and a downstream test patch image. Also, the range P2 is selected to be zero.

Figure 31A:
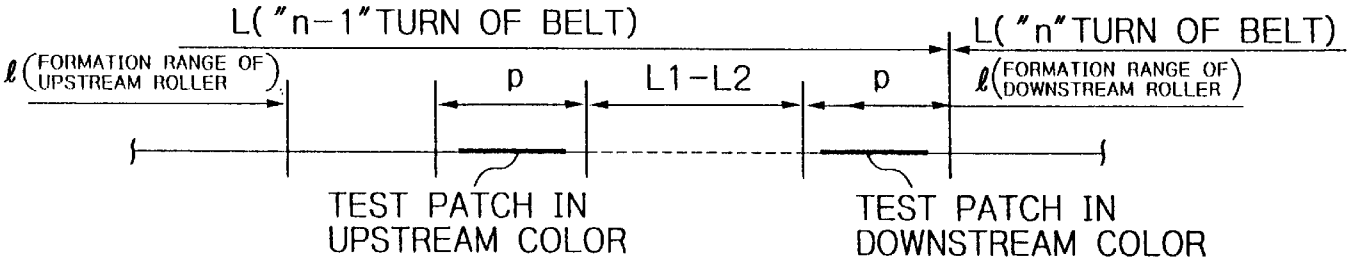
FIGS. 31A through 31D are timing charts for describing a sixteenth embodiment of the present invention.
Figure 31B:
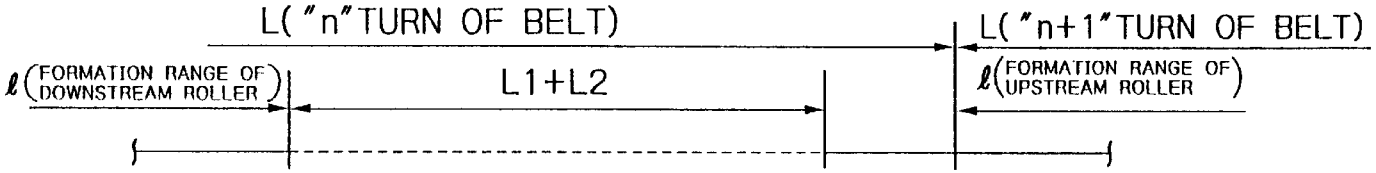

For example, as shown in FIG. 31A, during "n−1" turn of the belt 10, the control means causes the upstream developing roller of one of the image stations I and II to form a test patch image in the range P following the formation range assigned to the upstream developing roller. The control means then switches the developing function from the upstream developing roller to the downstream developing roller. Subsequently, the control means causes the downstream developing roller to form a test patch image in the range P and then start forming an image. As shown in FIG. 31B, during the "n" turn of the belt 10, a test patch image is not formed in the range following the formation range assigned to the downstream developing roller, but preceding the formation range assigned to the upstream developing roller.

Figure 31C:
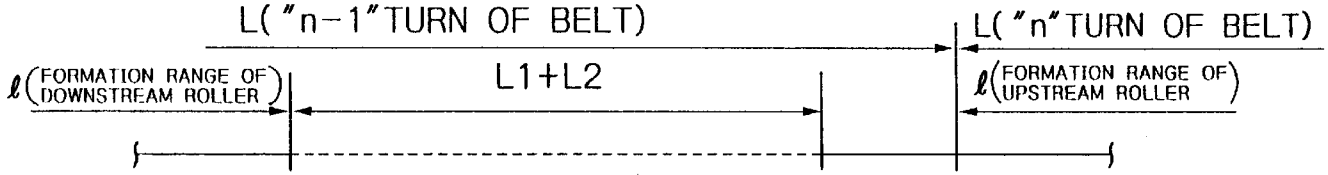
Figure 31D:
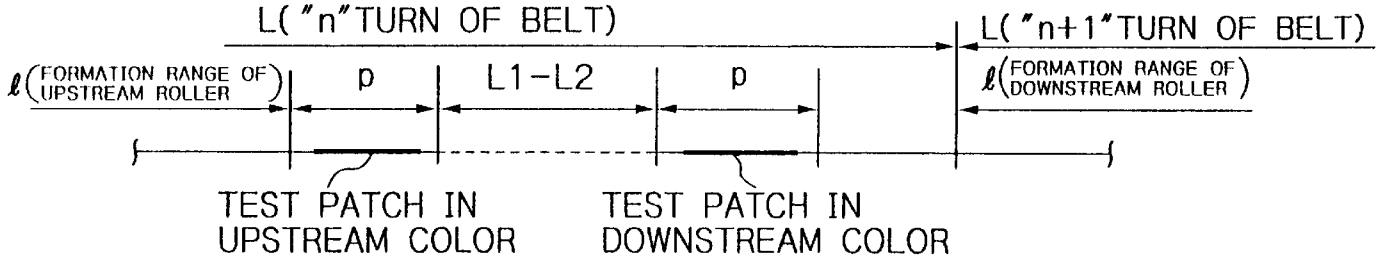

As shown in FIG. 31C, during the "n−1" turn of the belt 10, the control means prevents the other image station from forming a test patch image over the range following the formation range assigned to the downstream developing roller, but preceding the upstream developing roller. As shown in FIG. 31D, during the "n" turn of the belt 10, the control means causes the upstream developing roller to form a test patch image in the range P1, which follows the formation range assigned to the upstream developing roller. The control means then switches the developing function from the upstream developing roller to the downstream developing roller. Subsequently, the control means causes the downstream developing roller to form a test patch image in the range P and then causes it to start forming an image.

When test patch images each having a length p in the direction of movement of the belt 10 in the respective colors, there should hold a relation of $p \leqq (L-l-(L1-L2))/3$, so that the test patch images developed by the developing rollers 101, 201, 301 and 401 do not overlap each other. Assume that the minimum necessary length for forming a test patch image is p. Then, in the case of $L1+L2<L1-L2+3\times p$, i.e., $p>2\times L2/3$, the minimum necessary length L of the belt 10 is $1+L1-L2+3\times p$. On the other hand, in the case of $L1+L2>L1-L2+3\times p$, i.e., $p>2\times L2/3$, the minimum necessary length L of the belt 10 is $l+L1+L2$. By comparing the illustrative embodiment with the fourteenth embodiment, it will be seen that the illustrative embodiment reduces the minimum necessary length L by p in the range of $p<2\times L2/3$ or by $2\times L2-2\times p$ in the range of $2\times L2/3<p<L2$.

Seventeenth Embodiment

This embodiment pertains to the relations of $L1>L2$ and $p>L1-L2$ and is identical with the fourteenth embodiment except for the following. FIGS. 32A through 32D show test patch image ranges p particular to the illustrative embodiment.

As shown in FIGS. 32A through 32D, after the formation range assigned to the upstream developing roller 101 or 401, the developing roller 101 or 401 forms a test patch image in the test patch image range P1 extending from the above formation range to the formation range assigned to the downstream developing roller 201 or 301, respectively. The developing function is then switched from the upstream developing roller 101 or 401 to the downstream developing roller 201 or 301, respectively. The downstream developing roller 201 or 301 then forms a test patch image and then starts forming an image. That is, the plurality of test patch images in the eleventh embodiment are implemented as an upstream test patch image and a downstream test patch image. Also, the range P2 is selected to be zero.

Figure 32A:
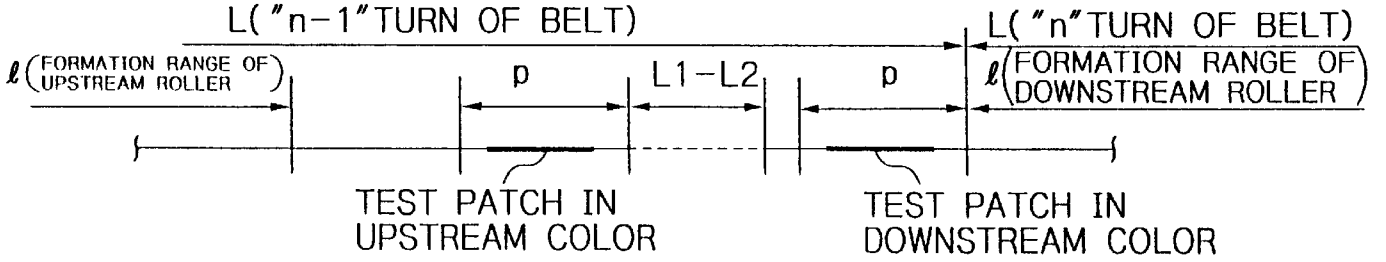
FIGS. 32A through 32D are timing charts for describing a seventeenth embodiment of the present invention.
Figure 32B:
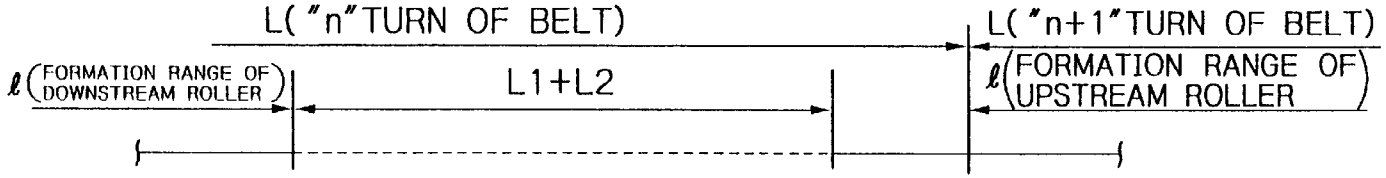

For example, as shown in FIG. 32A, during "n−1" turn of the belt 10, the control means causes the upstream developing roller of one of the image stations I and II to form a test patch image in the range P following the formation range assigned to the upstream developing roller. The control means then switches the developing function from the upstream developing roller to the downstream developing roller. Subsequently, the control means causes the downstream developing roller to form a test patch image in the range P and then start forming an image. As shown in FIG. 32B, during the "n" turn of the belt 10, a test patch image is not formed in the range following the formation range assigned to the downstream developing roller, but preceding the formation range assigned to the upstream developing roller.

Figure 32C:
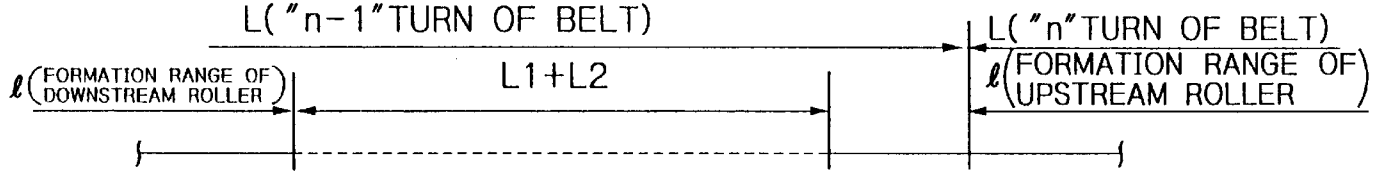
Figure 32D:
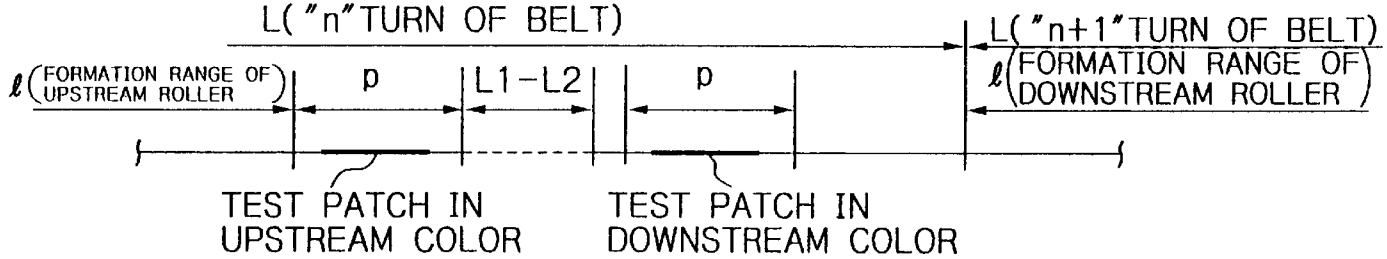

As shown in FIG. 32C, during the "n−1" turn of the belt 10, the control means prevents the other image station from forming a test patch image over the range following the formation range assigned to the downstream developing roller, but preceding the upstream developing roller. As shown in FIG. 32D, during the "n" turn of the belt 10, the control means causes the upstream developing roller to form a test patch image in the range P1, which follows the formation range assigned to the upstream developing roller. The control means then switches the developing function from the upstream developing roller to the downstream developing roller. Subsequently, the control means causes the downstream developing roller to form a test patch image in the range P and then causes it to start forming an image.

When test patch images each having a length p in the direction of turn of the belt 10 in the respective colors, there should hold a relation of $p \leqq (L-1)/4$, so that the test patch images developed by the developing rollers 101, 201, 301 and 401 do not overlap each other. Assume that the minimum necessary length for forming a test patch image is p. Then, in the case of $L1+L2<4\times p$, i.e., $p>(L1+L2)/4$, the minimum necessary length L of the belt 10 is $l+4\times p$. On the other hand, in the case of $L1+L2>4\times p$, i.e., $p<(L1+L2)/4$, the minimum necessary length L of the belt 10 is $l+L1+L2$. By comparing the illustrative embodiment with the fourteenth embodiment, it will be seen that the illustrative embodiment reduces the minimum necessary length L by p in the range of $p<(L1+L2)$ or by $(L1+L2-3\times p$ in the range of $(L1+L2)/4<p<(L1+L2)/3$.

In the fifteenth to seventeenth embodiments shown and described, after the upstream developing unit 100 or 400 has formed an image, it forms a test patch image. Subsequently, the developing function is switched from the upstream developing unit 100 or 400 to the downstream developing unit 200 or 300. The downstream developing unit forms a test patch image and then forms an image. This further promotes the miniaturization of the belt 10 and thereby makes the apparatus more compact and lower in cost.

The test patches shown in FIGS. 28A through 28D to 32A through 32D are only illustrative and may be formed at any other suitable timing so long as the test patches do not overlap each other on the belt 10.

Eighteenth Embodiment

Briefly, this embodiment differs from the first embodiment in that it senses the position of a test pattern image and controls the image forming timing instead of sensing the density of a test patch image for image quality control.

To control the image forming timing during image formation, it is necessary to form a test pattern image on the drum 16 or 26 at each image station I or II in the range extending from the formation range assigned to one developing roller to the formation range assigned to the other developing roller.

As shown in FIGS. 3A and 3B, assume the range extending from the formation range assigned to the downstream developing roller 201 or 301 to the formation range assigned to the upstream developing roller 101 or 401. Then, the non-formable range is broader in the above range than in the range extending from the formation range assigned to the upstream developing roller 101 or 401 to the formation range assigned to the downstream developing roller 201 or 301. It is therefore necessary to increase the circumferential length of the belt 10 for thereby allotting a sufficient area for a test pattern image. In this respect, the belt 10 can be reduced in size if a test pattern image is formed in the range extending from the formation range assigned to the upstream developing roller 101 or 401 to the formation range assigned to the downstream developing roller 201 or 301.

Figure 33A:
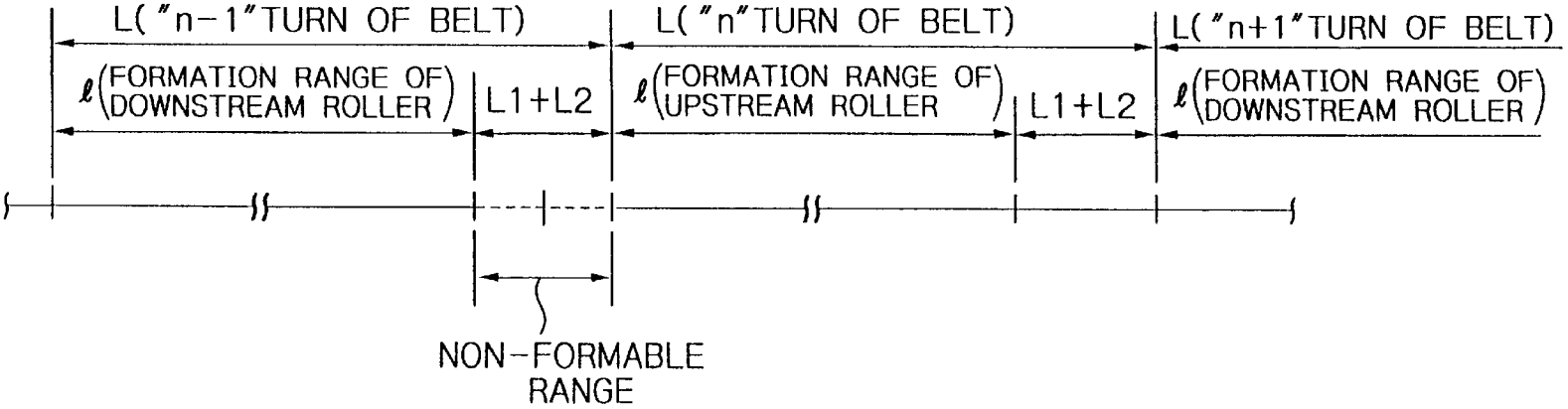
FIGS. 33A and 33B are timing charts for describing an eighteenth embodiment of the present invention.
Figure 33B:
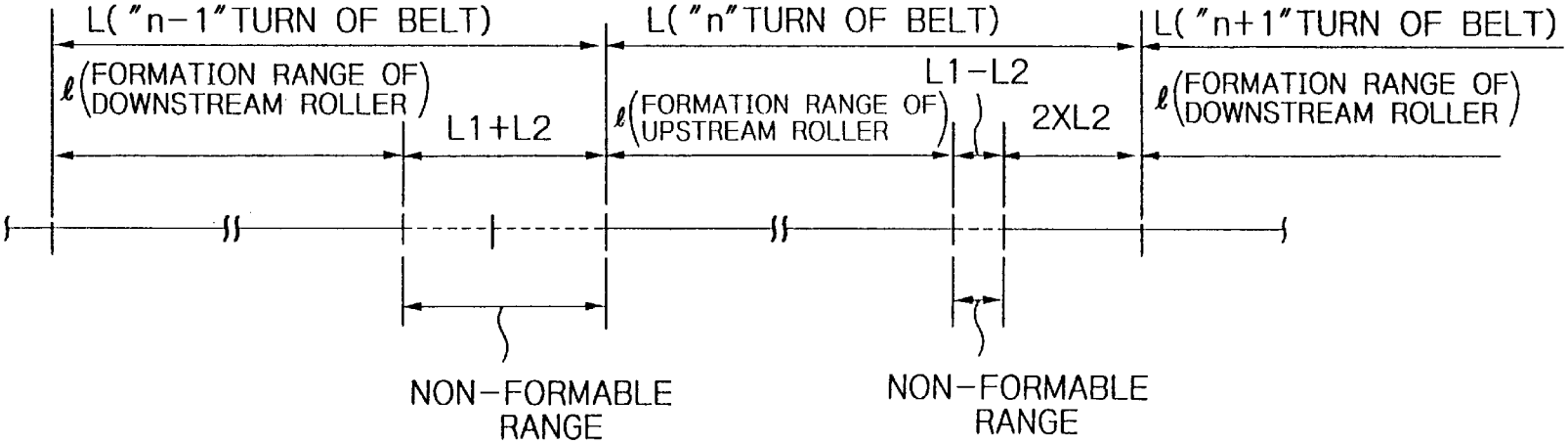

As FIGS. 3A and 3B indicate, the prerequisite with the illustrative embodiment is that the length L of the belt 10 be greater than or equal to $l+L1+L2$ in order to effect image formation. The minimum necessary length L of the belt 10 is $1+L1+L2$ when only image formation and the switching of the developing function are taken into account as essential operation. FIGS. 33A and 33B respectively show test pattern images corresponding to the case of $L1 \leqq L2$ and the case of $L1 \geqq L2$.

As shown in FIG. 33A, in the case of L1 L2, the length L of the belt 10 is $1+L1+L2$. A formable range of $L1+L2$ in which an image can be formed extends from the formation range assigned to the upstream developing roller 101 or 401 to the formation range assigned to the downstream developing roller 201 or 301, respectively. In the illustrative embodiment, a range Q (an abstract value for the range, not specifically shown in the drawings) that is smaller than or equal to $L1+L2$ is allotted to a test pattern image in the direction of rotation of the drum. This allows a test pattern image to be formed without increasing the length of the belt 10 and therefore implements control over the image forming timing during image formation with the minimum necessary length of the belt 10.

Figure 34:
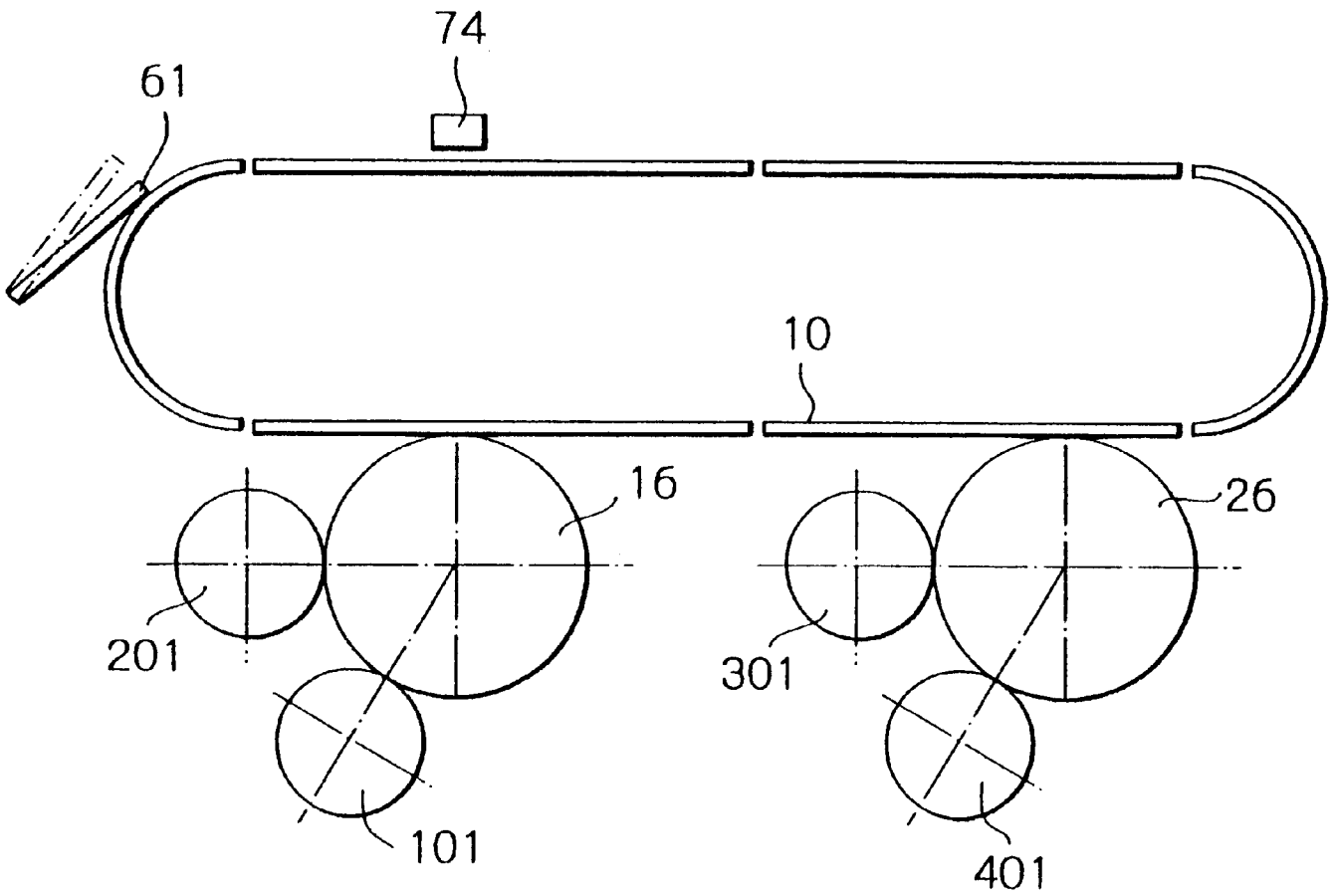
FIG. 34 is a view showing a specific arrangement for practicing the eighteenth embodiment.

FIG. 34 shows a specific sensor 74 responsive to the test pattern images and located to face the belt 10. The test pattern image formed on each of the drums 16 and 26 is transferred to the belt 10 while the sensor 74 senses the position of the test pattern image. The cleaning means 61 removes the test pattern images from the belt 10. The writing means 18 and 28 each are implemented by laser optics including a laser and a polygonal mirror. A laser beam issuing from the laser scans the surface of the drum 16 or 26 by way of the polygonal mirror.

Timing control means, not shown, determines, based on the output of the sensor 74, a shift of each test pattern image on the belt 10 in the subscanning direction. The timing control means controls, based on the determined shift, the rotation phase of the polygonal mirror belonging to the writing means 18 or 28. As a result, the actual image forming position in the subscanning direction coincides with a preselected image forming position at each of the image stations I and II. More specifically, the timing control means controls the image forming position of the image station I in accordance with the output of the sensor 74 representative of the position of the test pattern image formed on the drum 16. The timing control means then controls the image forming position of the image station II in accordance with the output of the sensor 74 representative of the position of the test pattern image formed on the drum 26.

Figure 35A:
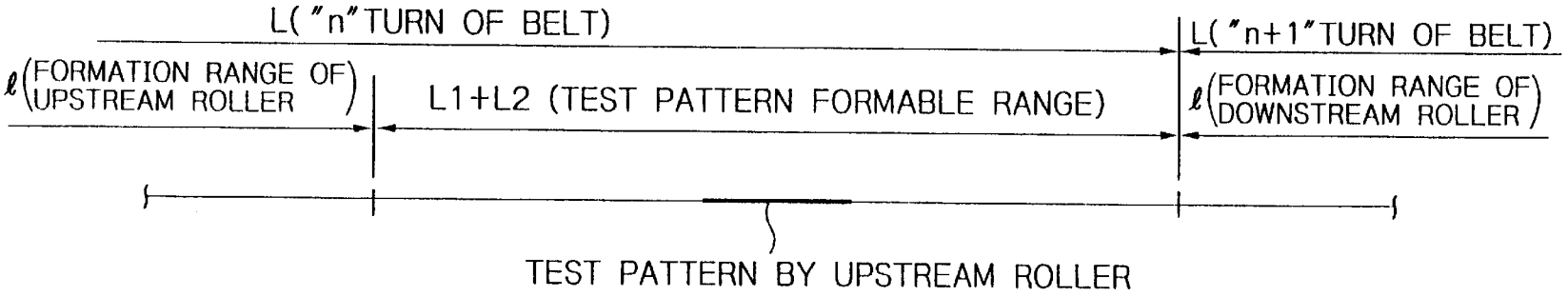
FIGS. 35A, 35B, 36A and 36B are timing charts for describing the eighteenth embodiment.
Figure 35B:
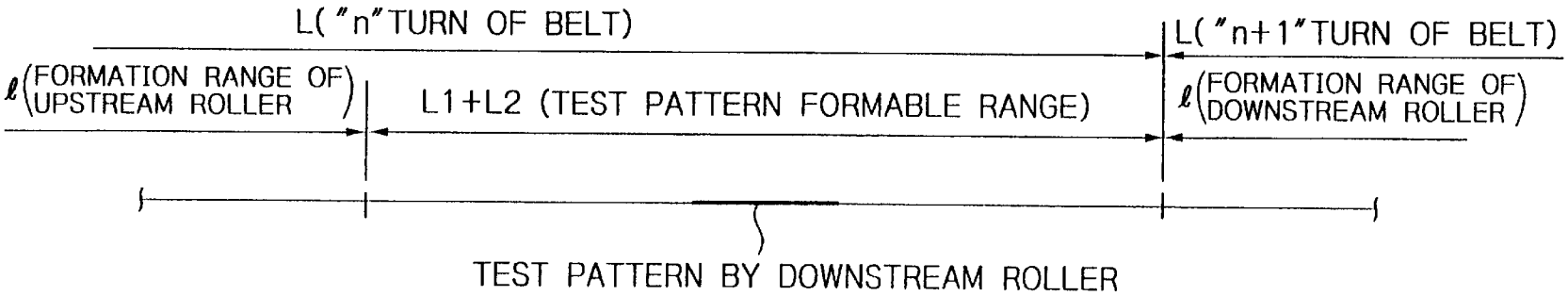

As shown in FIG. 35A, in the case of $L1 \leqq L2$, the timing control means causes the upstream developing roller 101 or 401 of the image station I or II, respectively, to form a test pattern image at any point in the range of $L1+L2$, which follows the formation range assigned to the upstream developing roller 101 or 401. The timing control means then switches the developing function from the upstream developing roller 101 or 401 to the downstream developing roller 201 or 301 and then causes the developing roller 201 or 301 to start forming an image.

As shown in FIG. 33B, in the case of $L1 \geqq L2$, the length L of the belt 10 is $1+L1+L2$. A formable range of $2\times L2$ extends from the formation range assigned to the upstream developing roller 100 or 400 to the formation range assigned to the downstream developing roller 201 or 301, respectively. In the illustrative embodiment, a range Q (an abstract value for the range, not specifically shown in the drawings) that is smaller than or equal to $2\times L2$ is allotted to a test pattern image in the direction of rotation of the drum. This allows a test pattern image to be formed without increasing the length of the belt 10 and therefore implements control over the image forming timing during image formation with the minimum necessary length of the belt 10.

As shown in FIG. 33B, in the case of $L1 \geqq L2$, the length L of the belt 10 is $l+L1+L2$. A formable range of $2\times L2$ extends from the formation range assigned to the upstream developing roller 100 or 400 to the formation range assigned to the downstream developing roller 201 or 301, respectively. In the illustrative embodiment, a range Q that is smaller than or equal to 2 ×L2 is allotted to a test pattern image in the direction of rotation of the drum. This allows a test pattern image to be formed without increasing the length of the belt 10 and therefore implements control over the image forming timing during image formation with the minimum necessary length of the belt 10.

Figure 36A:
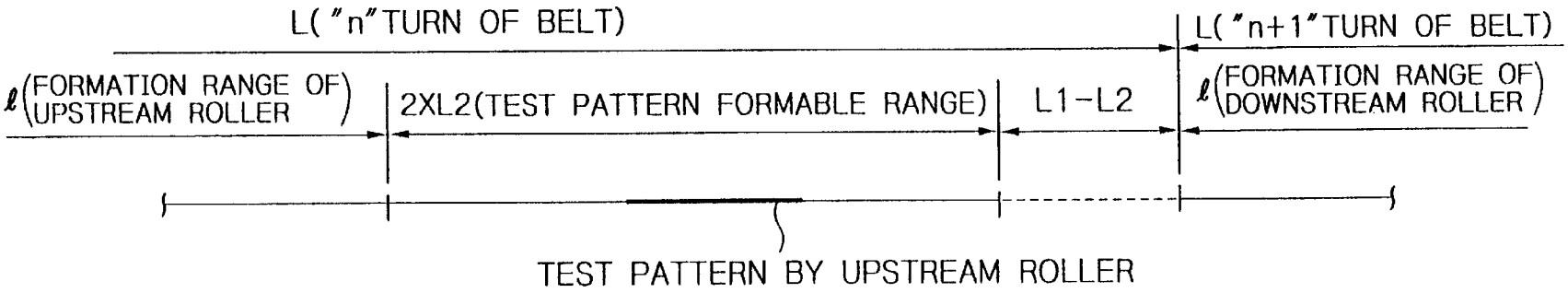

As shown in FIG. 36A, in the case of L1≧L2, the timing control means causes the upstream developing roller 101 or 401 of the image station I or II, respectively, to form a test pattern image at any point in the range of 2 ×L2, which follows the formation range assigned to the upstream developing roller 101 or 401. The timing control means then switches the developing function from the upstream developing roller 101 or 401 to the downstream developing roller 201 or 301 and then causes the developing roller 201 or 301 to start forming an image.

Figure 36B:
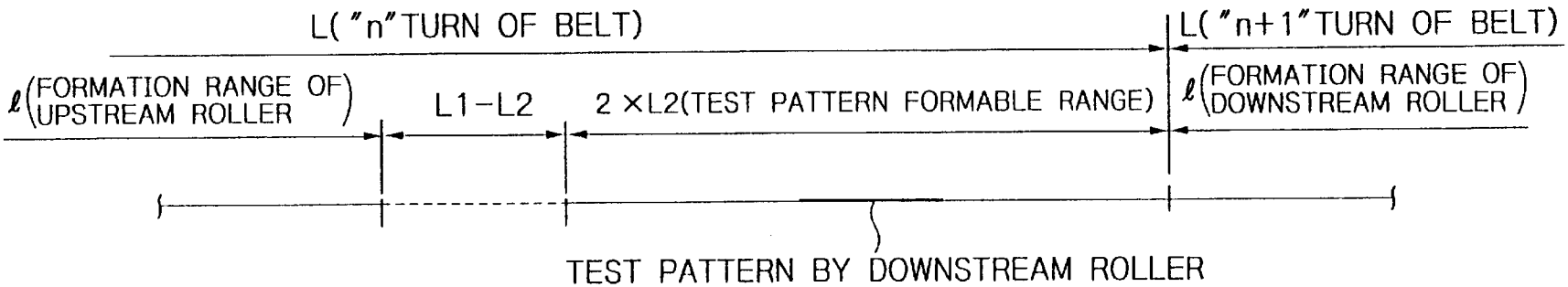

As shown in FIG. 36B, in the case of L1≧L2, the timing control means switches the developing function from the upstream developing roller 101 or 401 to the downstream developing roller 201 or 301 after the formation range assigned to the upstream developing roller l0l or 401. The timing control means then causes the downstream developing roller 201 or 301 to form a test pattern image at any point in the range of 2×L2. Subsequently, the timing control means causes the downstream developing roller 201 or 301 to start forming an image.

As stated above, the illustrative embodiment forms a test pattern image on each of the drums 16 and 26 and controls the image forming position or image forming timing at each of the image stations I and II. In addition, the test pattern image follows an image formed by the upstream developing section 100 or 400 or precedes an image to be formed by the downstream developing section 200 or 300. This realizes the timing control during image formation without resorting to an extra length of the belt 10 and thereby implements high-speed image formation and compact configuration.

Further, the length L of the belt 10 is l+L1+L2 while the length L1 is smaller than or equal to L2. This, coupled with the fact that the test pattern image range Q is smaller than or equal to L1+L2, realizes the timing control during image formation with the minimum necessary length of the belt 10 and further enhances high-speed image formation and small-size configuration. This is also true when the length L is l+L1+L2, L1 is greater than or equal to L2, and the range Q is smaller than or equal to 2×L2.

Nineteenth Embodiment

This embodiment differs from the eighteenth embodiment in the following respect. In the eighteenth embodiment, a test pattern image for image forming timing control during image formation can be formed only in the range extending from the formation range assigned to the upstream developing roller 101 or 401 to the formation range assigned to the downstream developing roller 201 or 301, respectively. A test pattern image is therefore formed once for two turns of the belt 10, i.e., once for one time of image transfer to a paper sheet.

As shown in FIG. 34, the sensor 74 faces the belt 10. It is therefore necessary to prevent test pattern images formed at the image stations I and II from overlapping each other on the belt 10. Therefore, when an upstream test pattern image and a downstream test pattern image are formed alternately with each other, each test pattern image is formed once for four consecutive turns of the belt 10, i.e., once for two times of image transfer to paper sheets. This is apt to obstruct accurate control over the image forming timing.

Assume that the image stations I and II form test pattern images at respective positions spaced in the main scanning direction, and that two sensors 74 are arranged in the main scanning direction. Then, the two sensors 74 increase the cost although the image stations I and II can form test pattern images once for two turns of the belt 10, i.e., one time of image transfer to a paper sheet. On the other hand, assume that test pattern images are formed at the image stations I and II alternately with each other and then sensed by the sensors 74. Then, if the belt cleaner 61 is ON/OFF controlled in such a manner as to clean only the test pattern portions of the belt 10, the frequency of test pattern formation can be reduced to once for four turns of the belt 10, i.e., one times of image transfer to paper sheets. This, however, needs sophisticated, highly accurate control over the belt cleaner 61 and also increases the cost.

Figure 37A:
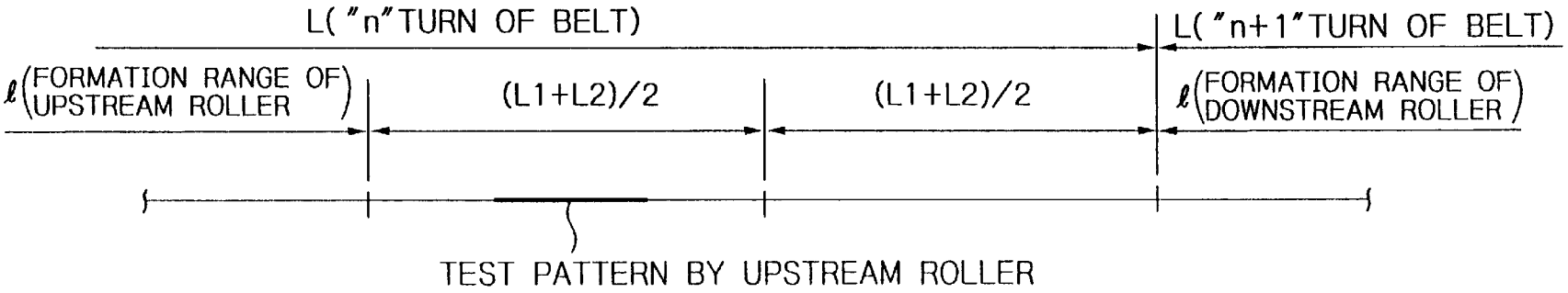
FIGS. 37A and 37B are timing charts for describing a nineteenth embodiment of the present invention.
Figure 37B:
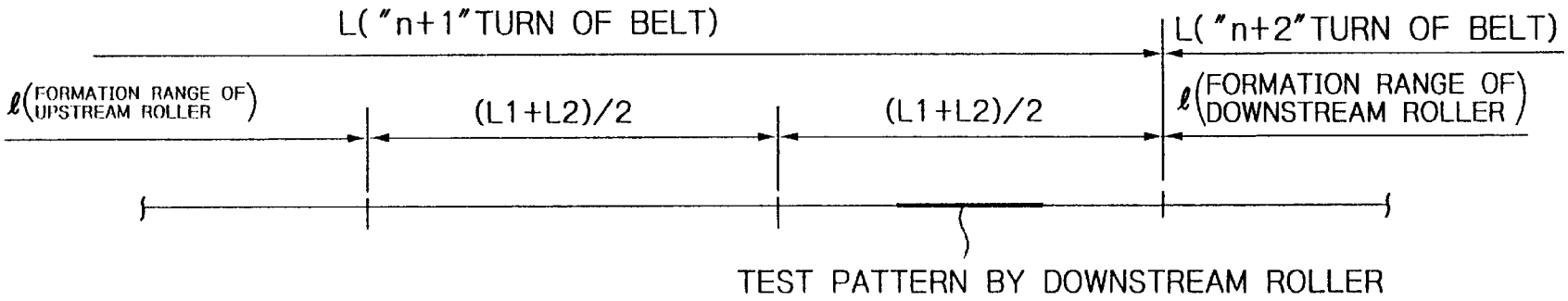

As shown in FIGS. 37A and 37B, in the illustrative embodiment, the circumferential length L of the belt 10 is l+L1+L2 while the length L1 is smaller than or equal to L2. A formable range of L1+L2 in which an image can be formed is available in the region extending from the formation range assigned to the upstream developing roller 101 or 401 to the formation range assigned to the downstream developing roller 201 or 301, respectively. The test pattern range Q at each of the image stations I and II is selected to be smaller than or equal to (L1+L2)/2. The test pattern images formed at the image stations I and II are prevented from overlapping each other on the belt 10. In this condition, it is possible to control the image forming timing during image formation with the minimum necessary length of the belt 10 and to sense the positions of the test pattern images once for two turns of the belt 10, i.e., once for one time of image transfer to a paper sheet with the single sensor 74.

FIG. 37A shows how one of the image stations I and II forms a test pattern image during the "n" turn of the belt 10. As shown, after the formation range assigned to the upstream developing roller of the image station, the timing control means causes the developing roller to form a test pattern image at any point in the range of (L1+L2)/2. The timing control means then switches the developing function form the upstream developing roller to the downstream developing roller. Subsequently, after the non-image range of (L1+L2)/2, the timing control means causes the downstream developing roller to start forming an image.

FIG. 37B shows how the other image station forms a test pattern image during the "n+1" turn of the belt 10. As shown, after a non-image range of (L1+L2)/2 that follows the formation range assigned to the upstream roller of the image station, the timing control means switches the developing function from the upstream developing roller to the downstream developing roller. The timing control means then causes the downstream developing roller to form a test pattern image at any point in the range of (L1+L2)/2. Thereafter, the timing control means causes the downstream developing roller to start forming an image.

As stated above, the range Q in which each image station I or II forms a test pattern image is smaller than or equal to (L1+L2)/2. This, coupled with the fact that the test pattern images do not overlap on the belt 10, reduces the number of sensors required to sense the positions of the test pattern images or enhances accurate control over the image forming timing. Consequently, the illustrative embodiment reduces the size and cost of the apparatus or surely prevents image positions from being shifted.

Twentieth Embodiment

Figure 38A:
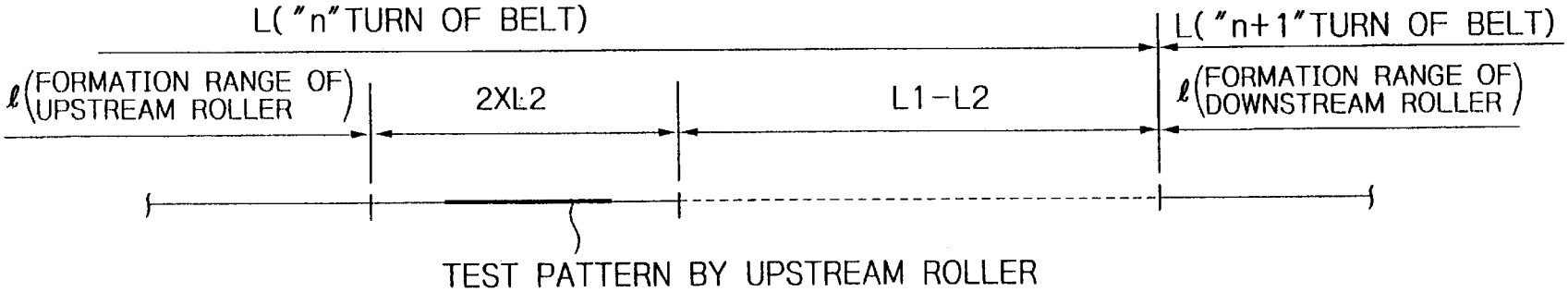
FIGS. 38A and 38B are timing charts for describing a twentieth embodiment of the present invention.
Figure 38B:
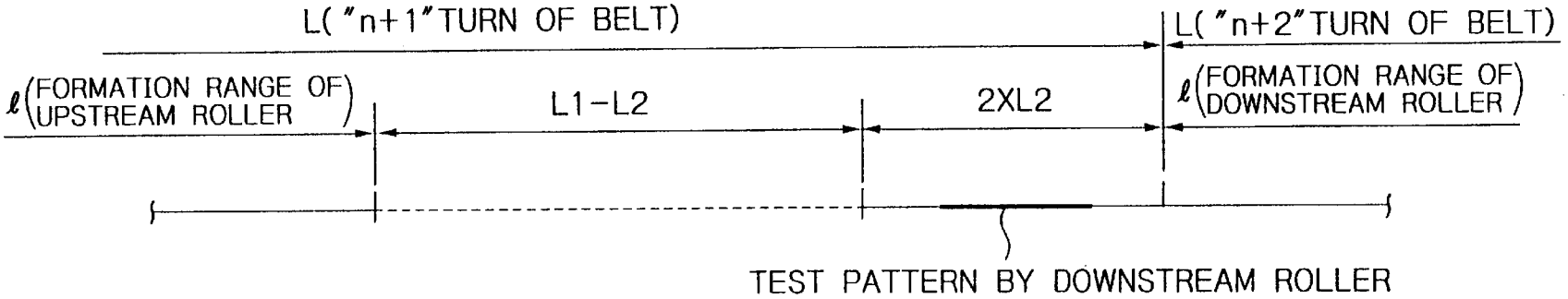

This embodiment is similar to the eighteenth embodiment except for the following. As shown in FIGS. 38A and 38B, in the illustrative embodiment, the length L of the belt 10 is l+L1+L2 while the length L1 is greater than or equal to L2. In this case, a range of 2×L2 in which an image can be formed is available from the formation range assigned to the upstream developing roller 101 or 401 to the formation range assigned to the downstream developing roller 201 or 301.

In the case of L1−L2≦(L1+L2)/2, the control means selects a test pattern range Q smaller than or equal to 2×L2 and prevents test patch images formed at the image stations I and II from overlapping each other on the belt 10. This implements image forming timing control during image formation with the minimum necessary length of the belt 10 for image formation. Moreover, the sensor 73 should only sense the densities of the test pattern images once for two turns of the belt 10, i.e., for one time of image transfer to a paper sheet.

Specifically, FIG. 38A shows a case wherein one of the image stations I and II forms a test pattern image during the "n" turn of the belt 10. As shown, after the formation range assigned to the upstream developing roller 101 or 401, the timing control means causes the developing roller 101 or 401 to form a test pattern image in the respective color at any point in the range of 2×L2. The control means then switches the developing function from the upstream developing roller 101 or 401 to the downstream developing roller 201 or 301. Subsequently, the control means causes the developing roller 201 or 301 to start forming an image.

FIG. 33B shows a case wherein the other of the image stations I and II forms a test pattern image during the "n+1" turn of the belt 10. As shown, after the formation range assigned to the upstream developing roller 101 or 401, the control means switches the developing function from the upstream developing roller to the downstream developing roller. The control means then causes the downstream developing roller to form a test pattern image at any point in the range of 2×L2. Subsequently, the timing control means causes the downstream developing roller to start forming an image.

With the above procedure, the illustrative embodiment also reduces the number of sensors for sensing the densities of test pattern images or enhances accurate image forming timing control and thereby reduces the size and cost of the apparatus or surely prevents image quality from falling.

Twenty-first Embodiment

Figure 39A:
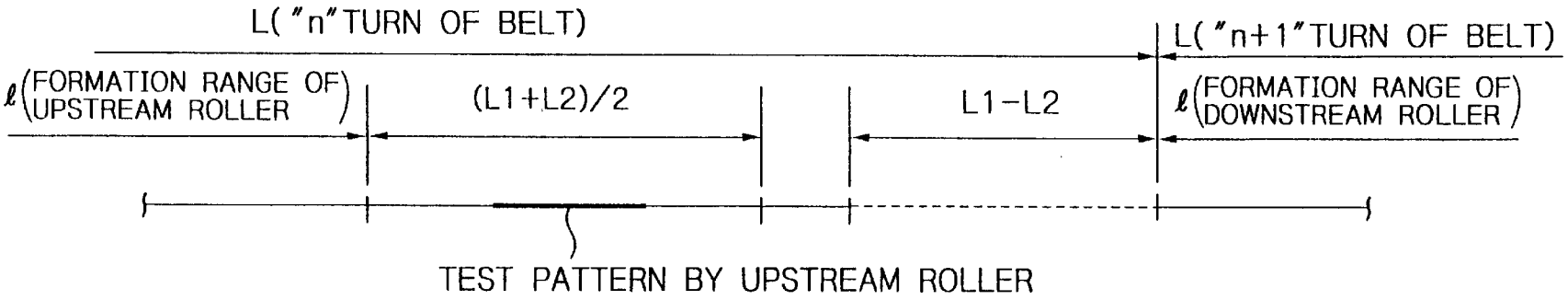
FIGS. 39A and 39B are timing charts for describing a twenty-first embodiment of the present invention.
Figure 39B:
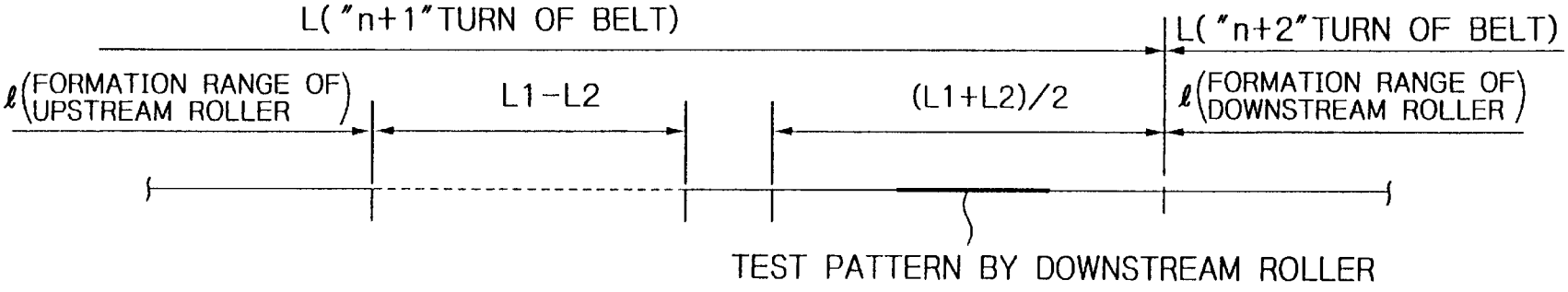

This embodiment is similar to the eighteenth embodiment except for the following. As shown in FIGS. 39A and 39B, in the illustrative embodiment, the length L of the belt 10 is l+L1+L2 while the length L1 is greater than or equal to L2. In this case, a range of 2×L2 in which an image can be formed is available from the formation range assigned to the upstream developing roller 101 or 401 to the formation range assigned to the downstream developing roller 201 or 301.

In the case of L1−L2≦(L1+L2)/2, the control means selects a test pattern range Q smaller than or equal to (L1+L2)/2 and prevents test pattern images formed at the image stations I and II from overlapping each other on the belt 10. This implements image forming timing control during image formation with the minimum necessary length of the belt 10 for image formation. Moreover, the sensor 73 should only sense the densities of the test pattern images once for two turns of the belt 10, i.e., for one time of image transfer to a paper sheet.

Specifically, FIG. 39A shows a case wherein one of the image stations I and II forms a test pattern image during the "n" turn of the belt 10. As shown, after the formation range assigned to the upstream developing roller, the timing control means causes the developing roller to form a test pattern image in the respective color at any point in the range of (L1+L2)/2. The control means then switches the developing function from the upstream developing roller to the downstream developing roller. Subsequently, the control means causes the downstream developing roller to start forming an image.

FIG. 39B shows a case wherein the other of the image stations I and II forms a test pattern image during the "n+1" turn of the belt 10. As shown, after the formation range assigned to the upstream developing roller 101 or 401, the control means switches the developing function from the upstream developing roller to the downstream developing roller. The control means then causes the downstream developing roller to form a test pattern image at any point in the range of (L1+L2)/2 and start forming an image.

With the above procedure, the illustrative embodiment also reduces the number of sensors for sensing the densities of test pattern images or enhances accurate image forming timing control and thereby reduces the size and cost of the apparatus or surely prevents image quality from falling.

The timing for switching the developing function described in relation to the nineteenth to twenty-first embodiments is only illustrative. The crux is that the timing prevents test pattern images formed at the two image stations from overlapping each other on the belt 10.

Twenty-second Embodiment

This embodiment is similar to the first embodiment, but differs from the first embodiment in that it shifts the image forming position on the belt 10 for each image output.

Figure 40A:
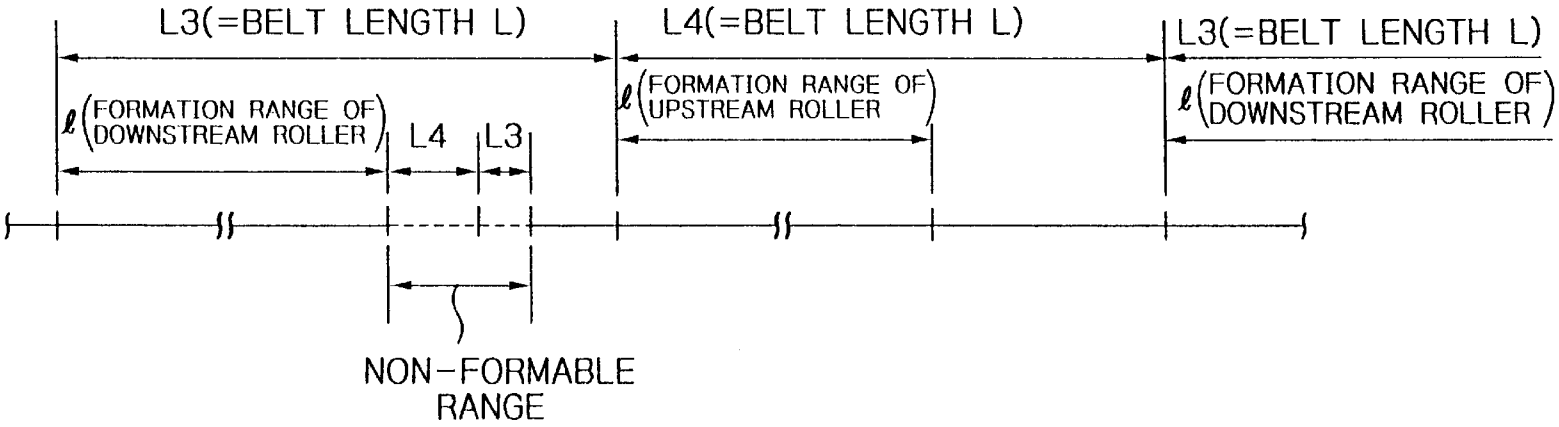
FIGS. 40A and 40B are timing charts for describing a twenty-second embodiment of the present invention.
Figure 40B:
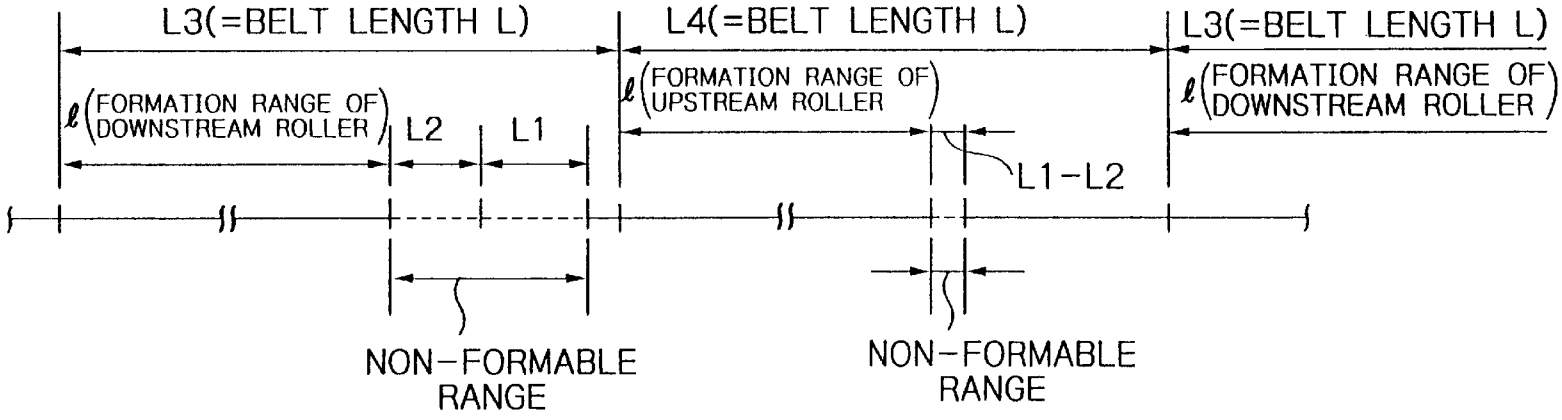

Assume that the belt 10 moves by a length L3 from the beginning of image formation by the downstream developing roller 201 or 301 to the beginning of image formation by the upstream developing roller 101 or 401. Also, assume that the belt 10 moves by a length L4 from the beginning of image formation by the upstream developing roller 101 or 401 to the beginning of image formation by the downstream developing roller 201 or 301. Further, assume that the belt 10 has a length L, as in the previous embodiments. FIG. 40A shows formation ranges and non-formable ranges in relation to the operation of FIGS. 1A and 1B. FIG. 40B shows formation ranges and non-formable ranges in relation to the operation of FIGS. 2A and 2B.

Assume that the formation range assigned to each developing section for a single turn of the belt 10 is l. Then, the formation range l includes, in addition to the actual length of an output image, a test pattern range for image density control, a test pattern range for image position control, and a margin for absorbing a registration error. Further, images are formed on a plurality of paper sheets during a single turn of the belt 10, the formation range l includes an interval between the paper sheets.

As shown in FIGS. 40A and 40B, the non-formable range is broader in the interval from the beginning of image formation by the downstream developing roller 201 or 301 to the beginning of image formation by the upstream developing roller 101 or 401 than in the interval from the latter to the former.

To extend the life of the belt 10 and to obviate deterioration of images due to fog toner, the image forming position on the belt 10 maybe shifted. One of the simplest methods of shifting the image forming position on the belt 10 is shifting, by a preselected amount, the position where an image begins to be formed on the belt 10 image by image. In the illustrative embodiment, four images of different colors are transferred to the belt 10 one above the other for two turns of the belt 10. Therefore, a difference is provided between the circumferential length that the belt 10 moves from the first turn for forming the first image (image transfer) to the beginning of the formation of the second image and the circumferential length that it moves from the second turn for forming the first image to the beginning of the first turn for forming the second image. As a result, the image forming position on the belt 10 is shifted by the above difference.

As shown in FIGS. 40A and 40B, assume that the belt 10 moves over a circumferential length of L4 from the formation start position assigned to the upstream roller 101 or 401 to the formation start position assigned to the downstream developing roller 201 or 301, respectively. Then, the length L4 is selected to be shorter than the previously mentioned length L3 over which the belt 10 moves from the formation start position assigned to the downstream developing roller 201 or 301 to the formation start position assigned to the upstream developing roller 101 or 401, respectively. In addition, the length L of the belt 10 is selected to be L3. In this condition, it is possible to effectively use the limited length of the belt 10 and to guarantee a shift of L3−L4 on the belt 10. Moreover, the illustrative embodiment reduces the length over which the belt 10 moves for outputting an image by L3−L4, compared to the case of L3=L4, and thereby enhances high-speed image output.

As stated above, the illustrative embodiment sets up a relation of L3>L4. The illustrative embodiment causes each downstream developing section 200 or 300 to form an image, switches the developing function from the developing section 200 or 300 to the associated upstream developing section 100 or 400, and then causes the developing section 100 or 400 to form an image. In addition, the length L of the belt 10 is equal to L3. This successfully extends the life of the belt 10, obviates fog ascribable to toner, and realizes high-speed image formation.

Twenty-third Embodiment

This embodiment differs from the twenty-second embodiment in the following respect.

Figure 41A:
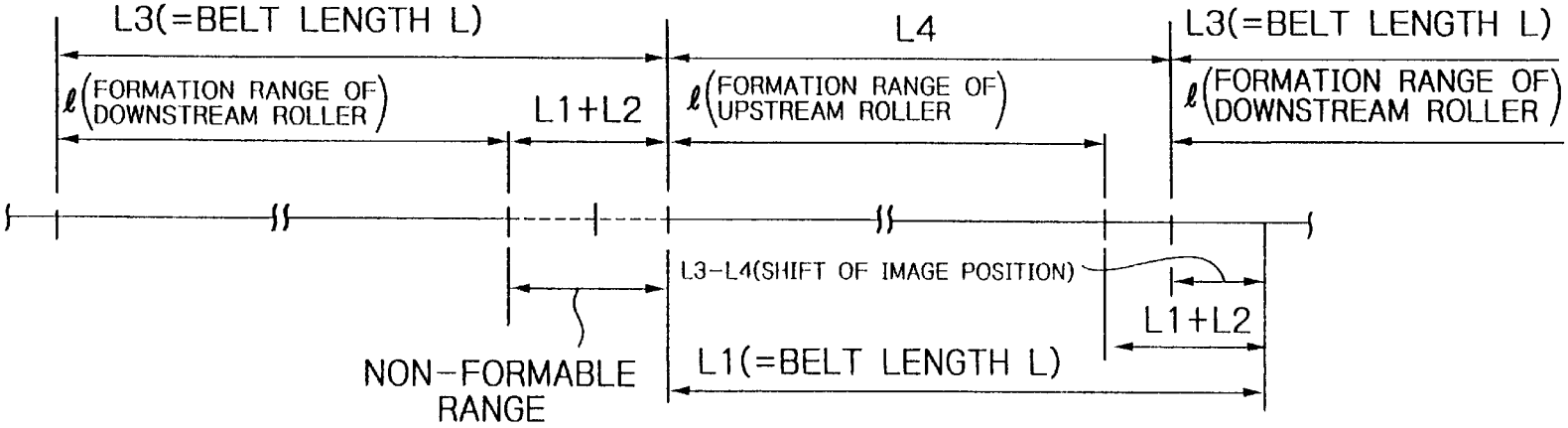
FIGS. 41A and 41B are timing charts for describing a twenty-third embodiment of the present invention.

As shown in FIG. 40A, assume that the developing rollers 201 and 301 start forming images on the associated drums 16 and 26 before the upstream developing rollers 101 and 401. Then, in the illustrative embodiment, the length L(=L3) of the belt 10 must be greater than or equal to l+L1+L2. To minimize the length L of the belt 10, the length L(=L3) is l+L1+L2 when only image formation and the switching of the developing function are taken into account as minimum necessary operation. FIG. 41A shows formation ranges and non-formable ranges on the belt 10 set up in the above conditions and in the condition of L=L3>L4.

As shown in FIG. 41A, a non-formable range of L1+L2 in which an image cannot be formed exists from the beginning of image formation by the downstream developing roller 201 or 301 to that of image formation by the associated upstream developing roller 101 or 401. In the illustrative embodiment, by setting up a relation of L4≧L3−(L1+L2), it is possible to implement a shift of L3−L4 (≦L1+L2) of an image on the belt 10 and therefore to enhance miniaturization and high-speed image formation. It will be seen that a relation of L3−L4=L1+L2 is most effective to enhance high-speed image formation.

Twenty-fourth Embodiment

This embodiment differs from the twenty-second embodiment in the following respect.

Figure 41B:
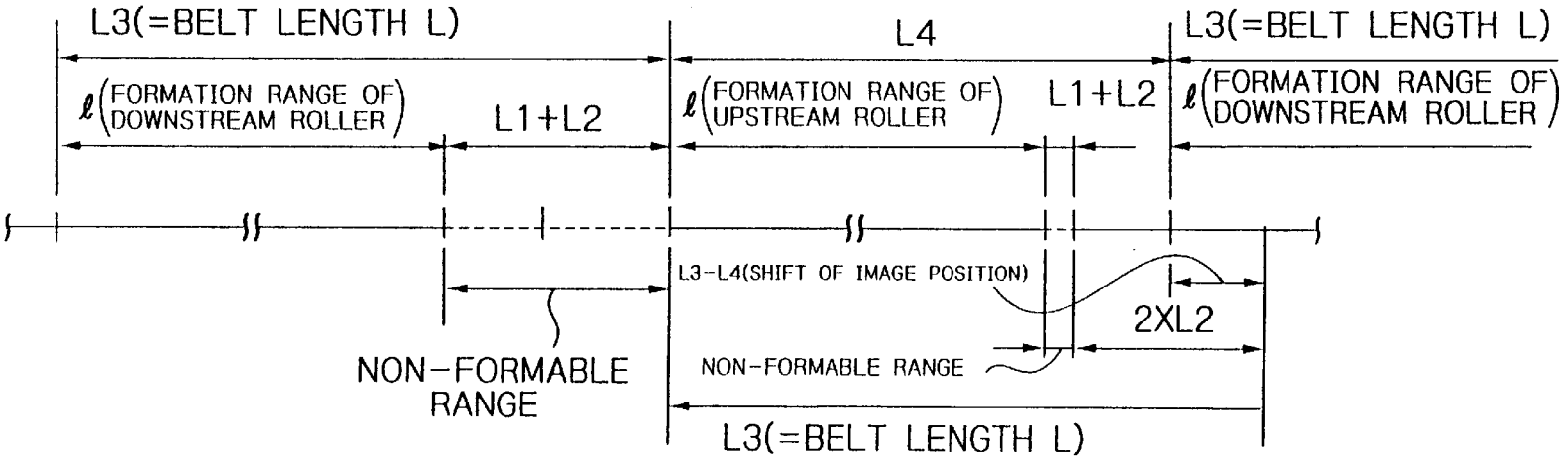

As shown in FIG. 40B, assume that the developing rollers 201 and 301 start forming images on the associated drums 16 and 26 before the upstream developing rollers 101 and 401. Then, in the illustrative embodiment, the length L(=L3) of the belt 10 must be greater than or equal to l+L1+L2. To minimize the length L of the belt 10, the length L(=L3) is l+L1+L2 when only image formation and the switching of the developing function are taken into account as minimum necessary operation. FIG. 41B shows formation ranges and non-formable ranges on the belt 10 set up in the above conditions and in the condition of L=L3>L4.

As shown in FIG. 41B, a non-formable range of L1+L2 in which an image cannot be formed exists from the beginning of image formation by the downstream developing roller 201 or 301 to that of image formation by the associated upstream developing roller 101 or 401. Further, a non-formable range of L1−L2 from the beginning of image formation by the upstream developing roller 101 or 401 to that of image formation by the downstream developing roller 201 or 301. In the illustrative embodiment, by setting up a relation of L4≧L3−(2×L2), it is possible to implement a shift of L3−L4 (≦2×L2) of an image on the belt 10 and therefore to enhance miniaturization and high-speed image formation. It will be seen that a relation of L3−L4=2×L2 is most effective to enhance high-speed image formation.

Twenty-fifth Embodiment

This embodiment is similar to the twenty-second embodiment except for the following.

Figure 42A:
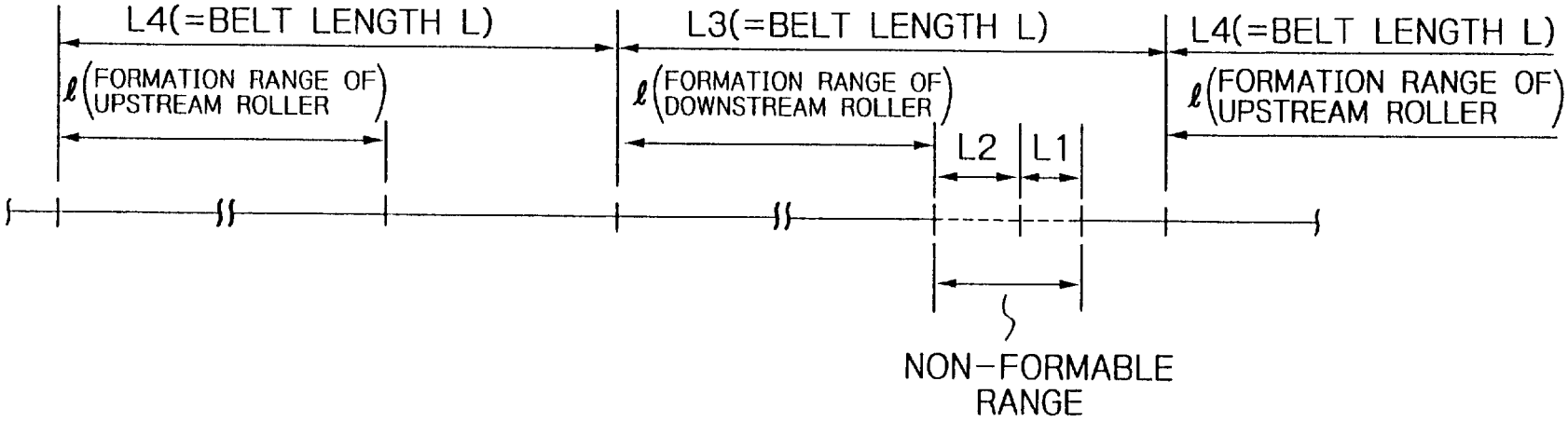
FIGS. 42A and 42B are timing charts for describing a twenty-fifth embodiment of the present invention.
Figure 42B:
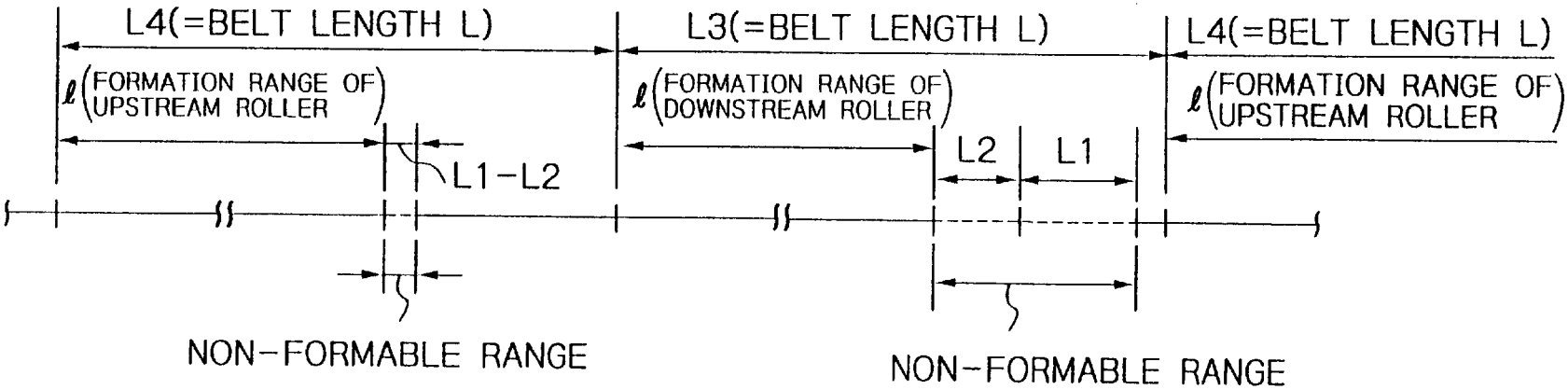

Again, assume that the belt 10 moves by the length L3 from the beginning of image formation by the downstream developing roller 201 or 301 to the beginning of image formation by the upstream developing roller 101 or 401. Also, assume that the belt 10 moves by the length L4 from the beginning of image formation by the upstream developing roller 101 or 401 to the beginning of image formation by the downstream developing roller 201 or 301. Further, assume that the belt 10 has a length L, as in the previous embodiments. FIG. 42A shows formation ranges and non-formable ranges in relation to the operation of FIGS. 1A and 1B. FIG. 42B shows formation ranges and non-formable ranges in relation to the operation of FIGS. 2A and 2B.

Assume that the formation range assigned to each developing section for a single turn of the belt 10 is l. Then, the formation range 1 includes, in addition to the actual length of an output image, a test pattern range for image density control, a test pattern range for image position control, and a margin for absorbing a registration error. Further, images are formed on a plurality of paper sheets during a single turn of the belt 10, the formation range l includes an interval between the paper sheets.

As shown in FIGS. 42A and 42B, the non-formable range is broader in the interval from the beginning of image formation by the downstream developing roller 201 or 301 to the beginning of image formation by the upstream developing roller 101 or 401 than in the interval from the latter to the former.

Again, to extend the life of the belt 10 and to obviate deterioration of images due to fog toner, the image forming position on the belt 10 may be shifted. One of the simplest methods of shifting the image forming position on the belt 10 is shifting, by a preselected amount, the position where an image begins to be formed on the belt 10 image by image. In the illustrative embodiment, four images of different colors are transferred to the belt 10 one above the other for two turns of the belt 10. Therefore, a difference is provided between the circumferential length that the belt 10 moves from the first turn for forming the first image (image transfer) to the beginning of the formation of the second image and the circumferential length that it moves from the second turn for forming the first image to the beginning of the first turn for forming the second image. As a result, the image forming position on the belt 10 is shifted by the above difference.

As shown in FIGS. 42A and 42B, assume that the belt 10 moves over the circumferential length of L4 from the formation start position assigned to the upstream roller 101 or 401 to the formation start position assigned to the downstream developing roller 201 or 301, respectively. Then, the length L4 is selected to be shorter than the previously mentioned length L3 over which the belt 10 moves from the formation start position assigned to the downstream developing roller 201 or 301 to the formation start position assigned to the upstream developing roller 101 or 401, respectively. In addition, the length L of the belt 10 is selected to be L4. In this condition, it is possible to effectively use the limited length of the belt 10 and to guarantee a shift of L3−L4 on the belt 10. Moreover, the illustrative embodiment reduces the length that the belt 10 moves for outputting an image by L3−L4, compared to the case of L3=L4, and thereby miniaturize the apparatus.

The illustrative embodiment also successfully extends the life of the belt 10, obviates fog ascribable to toner, and realizes high-speed image formation.

Twenty-sixth Embodiment

This embodiment differs from the twenty-fifth embodiment in the following respect.

Figure 43A:
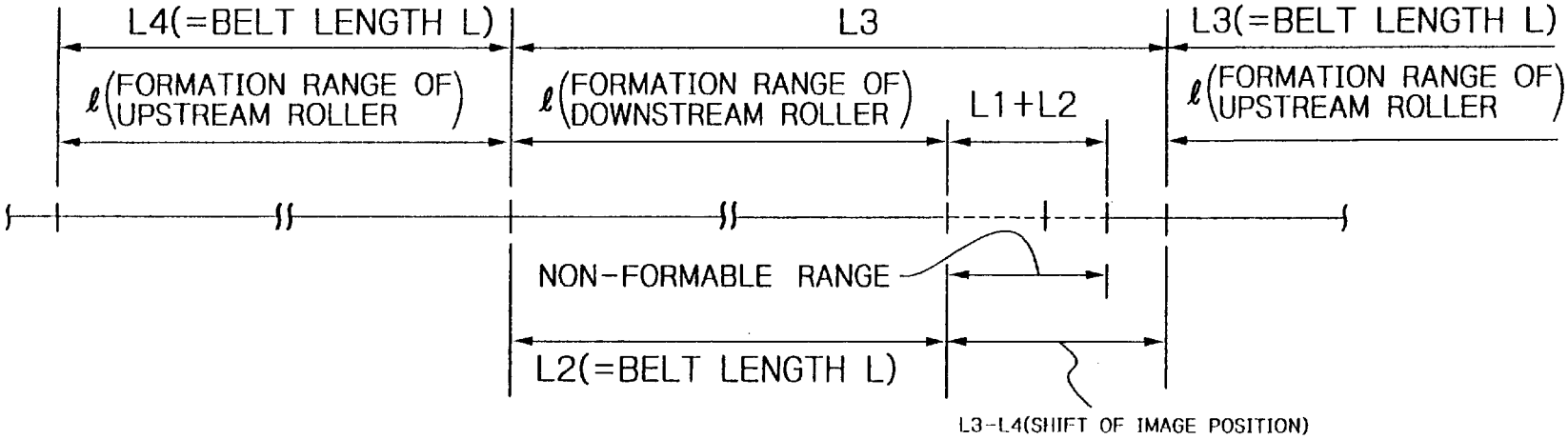
FIGS. 43A and 43B are timing charts for describing a twenty-sixth embodiment of the present invention.

As shown in FIG. 42A, assume that the upstream developing rollers 101 and 401 start forming images on the associated drums 16 and 26 before the downstream developing rollers 201 and 301. Then, in the illustrative embodiment, the length L(=L4) of the belt 10 must be greater than or equal to l. To minimize the length L of the belt 10, the length L(=L4) is l when only image formation and the switching of the developing function are taken into account as minimum necessary operation. FIG. 43A shows formation ranges and non-formable ranges on the belt 10 set up in the above conditions and in the condition of L>L4=L.

As shown in FIG. 43A, a non-formable range of L1+L2 in which an image cannot be formed exists from the beginning of image formation by the downstream developing roller 201 or 301 to that of image formation by the associated upstream developing roller 101 or 401. In the illustrative embodiment, by setting up a relation of L3≧L4+(L1+L2), it is possible to implement a shift of L3−L4 (≧L1+L2) of an image on the belt 10 and therefore to enhance miniaturization and high-speed image formation. It will be seen that a relation of L3−L4=L1+L2 is most effective to enhance high-speed image formation.

Twenty-seventh Embodiment

This embodiment differs from the twenty-fifth embodiment in the following respect.

Figure 43B:
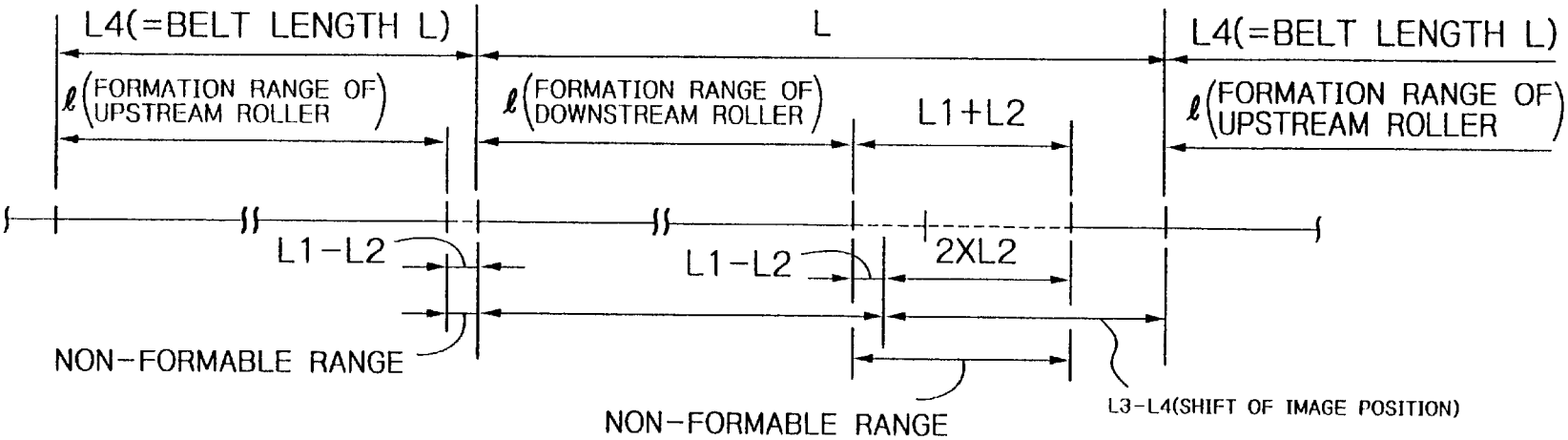

As shown in FIG. 42B, assume that the upstream developing rollers 101 and 401 start forming images on the associated drums 16 and 26 before the downstream developing rollers 201 and 301. Then, in the illustrative embodiment, the length L(=L4) of the belt 10 must be greater than or equal to l+(L1−L2). To minimize the length L of the belt 10, the length L(=L4) is l+(L1−L2) when only image formation and the switching of the developing function are taken into account as minimum necessary operation. FIG. 43B shows formation ranges and non-formable ranges on the belt 10 set up in the above conditions and in the condition of L3>L4=L.

As shown in FIG. 43B, a non-formable range of L1+L2 in which an image cannot be formed exists from the beginning of image formation by the downstream developing roller 201 or 301 to that of image formation by the associated upstream developing roller 101 or 401. Further, a non-formable range exists from the beginning of image formation by the upstream developing roller 100 or 400 to that of image formation by the downstream developing roller 201 or 301. In the illustrative embodiment, by setting up a relation of L3≧L4+(2×L2), it is possible to implement a shift of L3−L4 (≧2×L2) of an image on the belt 10 and therefore to enhance miniaturization and high-speed image formation. It will be seen that a relation of L3−L4=2×L2 is most effective to enhance high-speed image formation.

In summary, it will be seen that the present invention provides an image forming method having various unprecedented advantages, as enumerated below.

(1) When image quality correction control is executed during image formation in order to guarantee image quality, the method reduces the circumferential length required of an intermediate image transfer body to thereby enhance high-speed image formation and the miniaturization of an apparatus for practicing the method.

(2) Image quality correction control is practicable with the minimum necessary length of the intermediate image transfer body for image formation.

(3) The method reduces the number of sensors responsive to the densities of test patch images used for image quality compensation control or enhances accurate control for thereby reducing the size and cost of the apparatus or surely preventing image quality from falling.

(4) The method is capable of optimally using the length of the intermediate image transfer body and therefore further enhancing high-speed image formation and miniaturization.

(5) When image forming timing control is executed during image formation in order to prevent an image forming position from being shifted on the intermediate image transfer body, the method reduces the length required of the intermediate image transfer body to thereby enhance high-speed image formation and miniaturization.

(6) Image forming timing control is practicable with the minimum necessary length of the intermediate image transfer body for image formation, so that high-speed image formation and miniaturization are further enhanced.

(7) The method reduces the number of sensors responsive to the densities of test pattern images used for image forming timing control or enhances accurate control for thereby reducing the size and cost of the apparatus or surely preventing image quality from falling.

(8) The method extends the life of the intermediate image transfer body and image deterioration ascribable to fog while enhancing high-speed image formation.

Various modifications will become possible for those skilled in the art after receiving the teachings of the present disclosure without departing from the scope thereof.

What is claimed is:

1. A method of forming an image, comprising:

using a plurality of image stations each comprising a single rotatable image carrier and two developing means each for developing a particular latent image formed on said single image carrier in a respective color to thereby produce a toner image, switching a developing function from one of said two developing means to the other developing means while said single image carrier is in rotation, sequentially transferring toner images produced by said two developing means to an intermediate image transfer body one above the other, and transferring a resulting color image from said intermediate image transfer body to a recording medium, wherein a test patch image is formed on said single image carrier at each image station before image formation using only a downstream one of said two developing means in a direction of rotation of said single image carrier, and wherein image quality compensation control is effected by sensing a density of said test patch image.

2. The method as claimed in claim 1, wherein assuming that said intermediate image transfer body has a circumferential length L, that image formation using each developing means occurs over a range l for a single turn of said intermediate image transfer body, that an outer circumference of said image carrier moves over a circumferential length L1 within a period of time necessary for switching the developing function, and that developing positions respectively assigned to said upstream developing means and said downstream developing means are spaced from each other by a circumferential length L2 on the outer circumference of said image carrier, then there hold a relation of $L=l+L1+L2$ and a relation of $L1 \leqq L2$ while the test patch image is formed over a range p that is smaller than or equal to $L1+L2$.

3. The method as claimed in claim 2, wherein the range p is smaller than or equal to $(L1+L2)/2$, and said method forms, after image formation using said upstream developing means, a test patch image to be developed by said upstream developing means, switches the developing function from said upstream developing means to said downstream developing means, forms a test patch image to be developed by said downstream developing means, and then effects image formation using said downstream developing means.

4. The method as claimed in claim 2, wherein the range p is smaller than or equal to $(L1+L2)/2$, said plurality of image stations comprise two image stations, and said method causes one image station to form, after image formation using said upstream developing means, a test patch image to be developed by said upstream developing means, switch the developing function from said upstream developing means to said downstream developing means, and then effect image formation using said downstream developing means, and causes the other image station to switch, after image formation using said upstream developing means, the developing function from said upstream developing means to said downstream developing means, form a test patch image to be developed by said downstream developing means, and then effect image formation using said downstream developing means, said test patch images not overlapping each other on said intermediate image transfer body.

5. The method as claimed in claim 2, wherein the range p is smaller than or equal to $(L1+L2)/4$, said plurality of image stations comprise two image stations, said method causes each image station to form, after image formation using said upstream developing means, a test patch image to be developed by said upstream developing means, switch the developing function from said upstream developing means to said downstream developing means, form a test patch image to be developed by said downstream developing means, and then effect image formation using said downstream developing means, said test patch images not overlapping each other on said intermediate image transfer body.

6. The method as claimed in claim 1, wherein assuming that said intermediate image transfer body has a circumferential length L, that image formation using each developing means occurs over a range l for a single turn of said intermediate image transfer body, that an outer circumference of said image carrier moves over a circumferential length L1 within a period of time necessary for switching the developing function, and that developing positions respectively assigned to said upstream developing means and said downstream developing means are spaced from each other by a circumferential length L2 on the outer circumference of said image carrier, then there hold a relation of $L=l+L1+L2$ and a relation of $L1 \geqq L2$ while the test patch image is formed over a range p that is smaller than or equal to $2 \times L2$.

7. The method as claimed in claim 6, wherein the range p is smaller than or equal to L2, and said method forms, after image formation using said upstream developing means, a test patch image to be developed by said upstream developing means, switches the developing function from said upstream developing means to said downstream developing means, forms a test patch image to be developed by said downstream developing means, and then effects image formation using said downstream developing means.

8. The method as claimed in claim 6, wherein there hold a relation of $L1-L2 \geqq (L1+L2)/2$ and a relation of $p \leqq 2 \times L2$, said plurality of image stations comprise two image stations, and said method causes one image station to form, after image formation using said upstream developing means, a test patch image to be developed by said upstream developing means, switch the developing function from said upstream developing means to said downstream developing means, and then effect image formation using said downstream developing means, and causes the other image station to switch, after image formation using said upstream developing means, the developing function from said upstream developing means to said downstream developing means, form a test patch image to be developed by said downstream developing means, and then effect image formation using said downstream developing means, said test patch images not overlapping each other on said intermediate image transfer body.

9. The method as claimed in claim 6, wherein there hold a relation of $L1-L2 \leqq (L1+L2)/2$ and a relation of $p \leqq (L1+L2)/2$, said plurality of image stations comprise two image stations, said method causes one image station to form, after image formation using said upstream developing means, a test patch image to be developed by said upstream developing means, switch the developing function from said upstream developing means to said downstream developing means, effect image formation using said downstream developing means, and causes the other image station to switch, after image formation using said upstream developing means, the developing function from said upstream developing means to said downstream developing means, form a test patch image to be developed by said downstream developing means, and then effect image formation using said downstream developing means, said test patch images not overlapping each other on said intermediate image transfer body.

10. The method as claimed in claim 6, wherein there hold a relation of $L1-L2 \geqq (L1+L2)/4$ and a relation of $p \leqq 2 \times L2/3$, said plurality of image stations comprise two image stations, said method causes each image station to form, after image formation using said upstream developing means, a test patch image to be developed by said upstream developing means, switch the developing function from said upstream developing means to said downstream developing means, form a test patch image to be developed by said downstream developing means, and then effect image formation using said downstream developing means, said test patch images not overlapping each other on said intermediate image transfer body.

11. The method as claimed in claim 6, wherein there hold a relation of $L1-L2 \leqq (L1+L2)/4$ and a relation of $p \leqq (L1+L2)/4$, said plurality of image stations comprise two image stations, said method causes each image station to form, after image formation using said upstream developing means, a test patch image to be developed by said upstream developing means, switch the developing function from said upstream developing means to said downstream developing means, form a test patch image to be developed by said downstream developing means, and then effect image formation using said downstream developing means, said test patch images not overlapping each other on said intermediate image transfer body.

12. In a method of forming an image by:

using a plurality of image stations each comprising a single rotatable image carrier and first and second developing means arranged side by side while facing an outer circumference of said image carrier each for developing a particular latent image formed on said single image carrier in a respective color to thereby produce a toner image, switching a developing function from one of said first and second developing means to the other developing means while said single image carrier is in rotation, sequentially transferring toner images produced by said first and second developing means to an intermediate image transfer body one above the other, and transferring a resulting color image from said intermediate image transfer body to a recording medium with image transferring means:

1) a test patch image is formed over a range of P1 on said single image carrier:

a) after image formation using an upstream one of said first and second developing means in a direction of rotation of said single image carrier, or b) before image formation using a downstream one of said first and second developing means, while 2) a test patch image is formed over a range of P2 on said single image carrier:

a) after image formation using the downstream developing means, or b) before image formation using the upstream developing means, wherein $P1>P2$, and whereby image quality compensation control is effected by sensing a density of at least one of said test patch images.

13. The method as claimed in claim 12, wherein assuming that an outer circumference of said image carrier moves over a circumferential length L1 within a period of time necessary for switching the developing function, and that developing positions respectively assigned to said upstream developing means and said downstream developing means are spaced from each other by a circumferential length L2 on the outer circumference of said image carrier, then there hold a relation of $L1 \leqq L2$ and a relation of $P1-P2=L1+L2$.

14. The method as claimed in claim 13, wherein a relation of $P1 \leqq L1+L2$ holds, and the test patch image formed in the range of P1 and the test patch image formed in the range of P2 do not overlap each other on said intermediate image transfer body.

15. The method as claimed in claim 14, wherein the test patch image formed in the range P1 comprises a plurality of test patch images that are a test patch image developed in a first color after image formation using said downstream developing means and a test patch image developed, after switching of the developing function from upstream developing means to said downstream developing means, in a downstream color before image formation using said downstream developing means.

16. The method as claimed in claim 15, wherein said plurality of image stations comprise two image stations, and said method causes each image station to effect image formation using said upstream developing means; form a test patch image to be developed in the first color, switches the developing function from said upstream developing means to said downstream developing means, forms a test patch image to be developed in the downstream color, and then effect image formation using said downstream developing means.

17. The method as claimed in claim 12, wherein assuming that an outer circumference of said image carrier moves over a circumferential length L1 within a period of time necessary for switching the developing function, and that developing positions respectively assigned to said upstream developing means and said downstream developing means are spaced from each other by a circumferential length L2 on the outer circumference of said image carrier, then there hold a relation of $L1 \geqq L2$ and a relation of $P1-P2=2 \times L2$.

18. The method as claimed in claim 17, wherein a relation of $P1 \leqq 2 \times L2$ holds, and the test patch image formed in the range of P1 and the test patch image formed in the range of P2 do not overlap each other on said intermediate image transfer body.

19. The method as claimed in claim 18, wherein the test patch image formed in the range P1 comprises a plurality of test patch images that are a test patch image developed in a first color after image formation using said downstream developing means and a test patch image developed, after switching of the developing function from upstream developing means to said downstream developing means, in a downstream color before image formation using said downstream developing means.

20. The method as claimed in claim 19, wherein said plurality of image stations comprise two image stations, and said method causes each image station to effect image formation using said upstream developing means, form a test patch image to be developed in the first color, switches the developing function from said upstream developing means to said downstream developing means, forms a test patch image to be developed in the downstream color, and then effect image formation using said downstream developing means.

21. The method as claimed in claim 12, wherein a plurality of test patch images are formed in the range P1.

22. The method as claimed in claim 21, wherein the plurality of test patch images formed in the range P1 comprise a test patch image developed in a first color after image formation using said downstream developing means and a test patch image developed, after switching of the developing function from upstream developing means to said downstream developing means, in a downstream color before image formation using said downstream developing means.

23. The method as claimed in claim 22, wherein said plurality of image stations comprise two image stations, and said method causes each image station to effect image formation using said upstream developing means, form a test patch image to be developed in the first color, switches the developing function from said upstream developing means to said downstream developing means, forms a test patch image to be developed in the downstream color, and then effect image formation using said downstream developing means.

24. A method of forming an image, comprising:

using a plurality of image stations each comprising a single rotatable image carrier and first and second developing means arranged side by side while facing an outer circumference of said image carrier each for developing a particular latent image formed on said single image carrier in a respective color to thereby produce a toner image, switching a developing function from one of said first and second developing means to the other developing means while said single image carrier is in rotation, sequentially transferring toner images produced by said first and second developing means to an intermediate image transfer body one above the other, and transferring a resulting color image from said intermediate image transfer body to a recording medium with image transferring means, wherein a test pattern image is formed on said single image carrier before image formation using only a downstream one of said first and second developing means in a direction of rotation of said single image carrier, and wherein timing control is executed for causing image forming positions of said plurality of image stations to coincide in a subscanning direction by sensing positions of test pattern images formed on said intermediate image transfer body.

25. The method as claimed in claim 24, wherein assuming that said intermediate image transfer body has a circumferential length L, that image formation using each developing means occurs over a range l for a single turn of said intermediate image transfer body, that an outer circumference of said image carrier moves over a circumferential length L1 within a period of time necessary for switching the developing function, and that developing positions respectively assigned to said upstream developing means and said downstream developing means are spaced from each other by a circumferential length L2 on the outer circumference of said image carrier, then there hold a relation of $L=l+L1+L2$ and a relation of $L \leqq L2$ while the test patch image is formed over a range Q that is smaller than or equal to $L1+L2$ in a direction of rotation of said image carrier.

26. The method as claimed in claim 25, wherein a relation of $Q \leqq (L1+L2)/2$ holds, and the plurality of test pattern images do not overlap each other on said intermediate image transfer body.

27. The method as claimed in claim 24, wherein assuming that said intermediate image transfer body has a circumferential length L, that image formation using each developing means occurs over a range l for a single turn of said intermediate image transfer body, that an outer circumference of said image carrier moves over a circumferential length L1 within a period of time necessary for switching the developing function, and that developing positions respectively assigned to said upstream developing means and said downstream developing means are spaced from each other by a circumferential length L2 on the outer circumference of said image carrier, then there hold a relation of $L=l+L1+L2$ and a relation of $L1 \geqq L2$ while the test patch image is formed over a range Q that is smaller than or equal to $2 \times L2$ in a direction of rotation of said image carrier.

28. The method as claimed in claim 27, wherein:

$L1-L2 \geqq (L1+L2)/2$, $Q \leqq 2 \times L2$ and the plurality of test pattern images do not overlap each other on said intermediate image transfer body.

29. The method as claimed in claim 27, wherein:

$L1-L2\ (L1+L2)/2$, $Q \leqq 2(L1+L2)/2$, and the plurality of test pattern images do not overlap each other on said intermediate image transfer body.

30. In a method of forming an image by using a plurality of image stations each comprising a single rotatable image carrier and first and second developing means arranged side by side while facing an outer circumference of said image carrier each for developing a particular latent image formed on said single image carrier in a respective color to thereby produce a toner image, and by switching a developing function from one of said first and second developing means to the other developing means while said single image carrier is in rotation, sequentially transferring toner images produced by said first and second developing means to an intermediate image transfer body one above the other, and transferring a resulting color image from said intermediate image transfer body to a recording medium with image transferring means, said intermediate image transfer body moves over a circumferential length L3 from a beginning of development by a downstream one of said first and second developing means in a direction of rotation of said image carrier to a beginning of image formation by an upstream one of said first and second developing means, and moves over a circumferential length L4 from a beginning of image formation by said upstream developing means to a beginning of image formation by said downstream developing means, there holds a relation of L3>L4, said plurality of image stations each effects image formation using said downstream developing means, switches the developing function from said downstream developing means to said upstream developing means, and then effects image formation using said upstream developing means, and said intermediate image transfer body has a length L equal to the circumferential length L3.

31. The method as claimed in claim 30, wherein assuming that an outer circumference of said image carrier moves over a circumferential length L1 within a period of time necessary for switching the developing function, and that developing positions respectively assigned to said upstream developing means and said downstream developing means are spaced from each other by a circumferential length L2 on the outer circumference of said image carrier, then there hold a relation of $L1 \leqq L2$ and a relation of $L3-L4 \leqq L1+L2$.

32. The method as claimed in claim 31, wherein a relation of $L3-L4=L1+L2$ holds.

33. The method as claimed in claim 30, wherein assuming that an outer circumference of said image carrier moves over a circumferential length L1 within a period of time necessary for switching the developing function, and that developing positions respectively assigned to said upstream developing means and said downstream developing means are spaced from each other by a circumferential length L2 on the outer circumference of said image carrier, then there hold a relation of $L1>L2$ and a relation of $L3-L4 \leqq 2\times L2$.

34. The method as claimed in claim 33, wherein a relation of $L3-L4=2\times L2$ holds.

35. In a method of forming an image by using a plurality of image stations each comprising a single rotatable image carrier and first and second developing means arranged side by side while facing an outer circumference of said image carrier each for developing a particular latent image formed on said single image carrier in a respective color to thereby produce a toner image, and by switching a developing function from one of said first and second developing means to the other developing means while said single image carrier is in rotation, sequentially transferring toner images produced by said first and second developing means to an intermediate image transfer body one above the other, and transferring a resulting color image from said intermediate image transfer body to a recording medium with image transferring means, said intermediate image transfer body moves over a circumferential length L3 from a beginning of development by a downstream one of said first and second developing means in a direction of rotation of said image carrier to a beginning of image formation by an upstream one of said first and second developing means, and moves over a circumferential length L4 from a beginning of image formation by said upstream developing means to a beginning of image formation by said downstream developing means, there holds a relation of L3>L4, said plurality of image stations each effects image formation using said upstream developing means, switches the developing function from said upstream developing means to said downstream developing means, and then effects image formation using said downstream developing means, and said intermediate image transfer body has a length L equal to the circumferential length L4.

36. The method as claimed in claim 35, wherein assuming that an outer circumference of said image carrier moves over a circumferential length L1 within a period of time necessary for switching the developing function, and that developing positions respectively assigned to said upstream developing means and said downstream developing means are spaced from each other by a circumferential length L2 on the outer circumference of said image carrier, then there hold a relation of $L1 \leqq L2$ and a relation of $L3-L4 \geqq L1+L2$.

37. The method as claimed in claim 36, wherein a relation of $L3-L4=L1+L2$ holds.

38. The method as claimed in claim 35, wherein assuming that an outer circumference of said image carrier moves over a circumferential length L1 within a period of time necessary for switching the developing function, and that developing positions respectively assigned to said upstream developing means and said downstream developing means are spaced from each other by a circumferential length L2 on the outer circumference of said image carrier, then there hold a relation of $L1 \geqq L2$ and a relation of $L3-L4 \geqq 2\times L2$.

39. The method as claimed in claim 38, wherein a relation of $L3-L4=2\times L2$ holds.

* * * * *